US009510721B2

(12) United States Patent
Pedlar et al.

(10) Patent No.: US 9,510,721 B2
(45) **Date of Patent: *Dec. 6, 2016**

(54) FLOOR CLEANING APPARATUS

(71) Applicant: Karcher North America, Inc., Denver, CO (US)

(72) Inventors: Roger Pedlar, Lakewood, CO (US); Daniel Pearson, Littleton, CO (US); Eric L. Shark, Littleton, CO (US); Daniel C. Venard, Centennial, CO (US); Brian J. Doll, Denver, CO (US); Rusty Simmons, Englewood, CO (US); Nevin Green, Highlands Ranch, CO (US); Loi X. Tran, Highlands Ranch, CO (US); Robert S. Gorsky, Highlands Ranch, CO (US); Steven W. Tucker, Centennial, CO (US); Todd Leifheit, Littleton, CO (US)

(73) Assignee: Karcher North America, Inc., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/938,699

(22) Filed: Nov. 11, 2015

(65) Prior Publication Data

US 2016/0095489 A1 Apr. 7, 2016

Related U.S. Application Data

(63) Continuation of application No. 14/504,263, filed on Oct. 1, 2014, now Pat. No. 9,192,276, which is a (Continued)

(51) Int. Cl.
*A47L 11/03* (2006.01)
*A47L 11/16* (2006.01)
(Continued)

(52) U.S. Cl.
CPC ..... *A47L 11/4066* (2013.01); *A47L 11/24* (2013.01); *A47L 11/4027* (2013.01); *A47L 11/4041* (2013.01); *A47L 11/4044* (2013.01)

(58) Field of Classification Search
CPC ..... A47L 11/03; A47L 11/16; A47L 11/24; A47L 11/4027; A47L 11/4041; A47L 11/4044; A47L 11/4066
See application file for complete search history.

(56) References Cited

U.S. PATENT DOCUMENTS 1,268,963 A 6/1918 Gray
1,596,041 A 8/1926 Young
(Continued)

FOREIGN PATENT DOCUMENTS

AT 0231900 2/1964
AU 226251 6/1959
(Continued)

OTHER PUBLICATIONS

Notice of Allowance for U.S. Appl. No. 14/643,768 mailed Jun. 22, 2016, 7 pages.
(Continued)

*Primary Examiner* — Randall Chin
(74) *Attorney, Agent, or Firm* — Sheridan Ross P.C.

(57) ABSTRACT

A floor treatment apparatus is provided that includes a chassis that supports at least one cleaning element. The chassis is supported by a plurality of wheels, one which is steerable via a steering wheel interconnected to a housing also associated with the chassis. The chassis provided includes a plurality of movable housing members, one of which is associated with the steering wheel. To access the internal components of the floor treatment apparatus, the front housing is rotated or moved away from the other
(Continued)

housings wherein the steering wheel does not require disconnection to allow this movement.

20 Claims, 49 Drawing Sheets

Related U.S. Application Data continuation of application No. 14/133,248, filed on Dec. 18, 2013, now Pat. No. 8,887,340, which is a continuation of application No. 12/912,554, filed on Oct. 26, 2010, now abandoned, which is a continuation-in-part of application No. 11/868,353, filed on Oct. 5, 2007, now Pat. No. 8,245,345, which is a continuation of application No. 11/059,663, filed on Feb. 15, 2005, now Pat. No. 7,533,435, which is a continuation of application No. 10/737,027, filed on Dec. 15, 2003, now abandoned, which is a continuation-in-part of application No. 10/438,485, filed on May 14, 2003, now abandoned, said application No. 12/912,554 is a continuation-in-part of application No. 11/253,100, filed on Oct. 17, 2005, now abandoned, and a continuation-in-part of application No. 11/352,191, filed on Feb. 9, 2006, now abandoned, and a continuation-in-part of application No. 11/351,653, filed on Feb. 9, 2006, now abandoned, and a continuation-in-part of application No. 12/511,704, filed on Jul. 29, 2009, now Pat. No. 8,302,240, said application No. 14/133,248 is a continuation-in-part of application No. 13/964,046, filed on Aug. 10, 2013, now Pat. No. 9,015,887, which is a continuation of application No. 13/888,140, filed on May 6, 2013, now Pat. No. 8,528,142.

(60) Provisional application No. 60/545,153, filed on Feb. 16, 2004, provisional application No. 60/627,606, filed on Nov. 12, 2004.

(51) Int. Cl.
*A47L 11/40* (2006.01)
*A47L 11/24* (2006.01)

(56) References Cited

U.S. PATENT DOCUMENTS

| | | | |
|---|---|---|---|
| 1,632,665 | A | 6/1927 | Mitchell |
| 1,639,959 | A | 8/1927 | Owen |
| 1,888,339 | A | 11/1932 | White |
| 1,900,889 | A | 3/1933 | Becker |
| 1,995,084 | A | 3/1935 | Wichle |
| 1,999,696 | A | 4/1935 | Kitto |
| 2,192,397 | A | 3/1940 | Carlson |
| 2,263,762 | A | 11/1941 | Dow et al. |
| 2,668,979 | A | 2/1954 | MacFarland |
| 2,709,070 | A | 5/1955 | Bielstein |
| 2,864,462 | A | 12/1958 | Brace |
| 2,937,881 | A | 5/1960 | Norrie |
| 3,005,224 | A | 10/1961 | Taski |
| 3,020,576 | A | 2/1962 | Gerber |
| 3,040,363 | A | 6/1962 | Krammes et al. |
| 3,065,490 | A | 11/1962 | Arones |
| 3,093,853 | A | 6/1963 | Tamny |
| 3,186,021 | A | 6/1965 | Krier et al. |
| 3,189,931 | A | 6/1965 | Krier et al. |
| 3,193,862 | A | 7/1965 | Lyon |
| D202,170 | S | 9/1965 | Little et al. |
| 3,204,280 | A | 9/1965 | Campbell |
| 3,206,787 | A | 9/1965 | Daniels et al. |
| 3,224,524 | A | 12/1965 | Laher |
| 3,233,274 | A | 2/1966 | Kroll |
| 3,284,830 | A | 11/1966 | Kroll |
| 3,322,350 | A | 5/1967 | Heinicke |
| D213,586 | S | 3/1969 | Howard et al. |
| 3,436,788 | A | 4/1969 | Tamny |
| 3,461,479 | A | 8/1969 | Tierney |
| 3,504,858 | A | 4/1970 | Liddiard |
| 3,506,080 | A | 4/1970 | Hott |
| RE26,950 | E | 9/1970 | Hays |
| 3,584,439 | A | 6/1971 | Gronholz |
| 3,604,051 | A | 9/1971 | Wendel et al. |
| 3,631,558 | A | 1/1972 | Kovacevoc |
| 3,639,936 | A | 2/1972 | Ashton |
| 3,670,359 | A | 6/1972 | Gutbrod |
| 3,701,177 | A | 10/1972 | Meyer et al. |
| 3,702,488 | A | 11/1972 | Kasper |
| 3,705,437 | A | 12/1972 | Rukavina, Jr. et al. |
| 3,705,746 | A | 12/1972 | McLeod |
| 3,755,993 | A | 9/1973 | Cote |
| 3,760,649 | A | 9/1973 | Decouzon et al. |
| 3,797,744 | A | 3/1974 | Smith |
| 3,833,961 | A | 9/1974 | Fortman et al. |
| 3,837,029 | A | 9/1974 | Kasper |
| 3,846,865 | A | 11/1974 | Holman |
| 3,871,826 | A | 3/1975 | Bakay |
| 3,879,789 | A | 4/1975 | Kasper |
| 3,883,301 | A | 5/1975 | Emrick et al. |
| 3,886,623 | A | 6/1975 | Landesman et al. |
| 3,892,003 | A | 7/1975 | Peabody |
| 3,896,520 | A | 7/1975 | Williams |
| 3,927,899 | A | 12/1975 | Bough |
| 3,933,451 | A | 1/1976 | Johansson |
| 3,955,236 | A | 5/1976 | Mekelburg |
| 4,010,507 | A | 3/1977 | Johnson |
| 4,019,218 | A | 4/1977 | Cyphert |
| 4,037,289 | A | 7/1977 | Dojan |
| 4,041,567 | A | 8/1977 | Burgoon |
| 4,046,321 | A | 9/1977 | Hewett |
| 4,108,268 | A | 8/1978 | Block |
| 4,109,342 | A | 8/1978 | Vermillion |
| 4,135,669 | A | 1/1979 | Bridges et al. |
| 4,173,052 | A | 11/1979 | Burgoon et al. |
| 4,196,492 | A | 4/1980 | Johnson et al. |
| 4,200,952 | A | 5/1980 | Smies et al. |
| 4,200,953 | A | 5/1980 | Overton |
| 4,210,978 | A | 7/1980 | Johnson et al. |
| 4,214,338 | A | 7/1980 | Kyle et al. |
| 4,219,901 | A | 9/1980 | Burgoon et al. |
| 4,293,971 | A | 10/1981 | Block |
| 4,310,944 | A | 1/1982 | Kroll et al. |
| 4,314,385 | A | 2/1982 | Wimsatt et al. |
| 4,328,014 | A | 5/1982 | Burgoon et al. |
| 4,339,841 | A | 7/1982 | Waldhauser et al. |
| 4,348,783 | A | 9/1982 | Swanson et al. |
| 4,354,569 | A | 10/1982 | Eichholz |
| D267,084 | S | 11/1982 | Bittinger |
| 4,363,152 | A | 12/1982 | Karpanty |
| 4,383,551 | A | 5/1983 | Lynch et al. |
| 4,429,433 | A | 2/1984 | Burgoon |
| D273,621 | S | 4/1984 | Haub et al. |
| 4,457,036 | A | 7/1984 | Carlson et al. |
| 4,457,043 | A | 7/1984 | Oeberg et al. |
| 4,467,494 | A | 8/1984 | Jones |
| 4,492,002 | A | 1/1985 | Waldhauser et al. |
| 4,499,624 | A | 2/1985 | Bloom et al. |
| 4,532,667 | A | 8/1985 | Komesker et al. |
| 4,538,695 | A | 9/1985 | Bradt |
| 4,553,626 | A | 11/1985 | Kazmierczak et al. |
| 4,554,701 | A | 11/1985 | Van Raaij |
| 4,572,023 | A | 2/1986 | Euler |
| 4,580,313 | A | 4/1986 | Blehert |
| 4,586,208 | A | 5/1986 | Trevarthen |
| 4,596,061 | A | 6/1986 | Henning |
| 4,611,363 | A | 9/1986 | Samuelsson |
| 4,633,541 | A | 1/1987 | Block |
| 4,654,918 | A | 4/1987 | Cooper |
| D290,053 | S | 5/1987 | Block |
| D290,054 | S | 5/1987 | Block |
| 4,675,935 | A | 6/1987 | Kasper et al. |

(56) References Cited

U.S. PATENT DOCUMENTS

| | | | |
|---|---|---|---|
| 4,696,593 | A | 9/1987 | Bayless |
| 4,715,087 | A | 12/1987 | Todd et al. |
| 4,716,980 | A | 1/1988 | Butler |
| 4,759,094 | A | 7/1988 | Palmer et al. |
| 4,773,113 | A | 9/1988 | Russell |
| 4,787,646 | A | 11/1988 | Kamlukin et al. |
| 4,799,286 | A | 1/1989 | Rubin |
| 4,803,753 | A | 2/1989 | Palmer |
| 4,805,258 | A | 2/1989 | Sitarski et al. |
| 4,809,397 | A | 3/1989 | Jacobs et al. |
| 4,819,676 | A | 4/1989 | Blehert et al. |
| 4,821,958 | A | 4/1989 | Shaffer |
| 4,839,037 | A | 6/1989 | Bertelsen et al. |
| 4,847,944 | A | 7/1989 | Lackner |
| 4,850,077 | A | 7/1989 | Venturini |
| 4,874,055 | A | 10/1989 | Beer |
| 4,879,784 | A | 11/1989 | Shero |
| 4,884,313 | A | 12/1989 | Zoni |
| 4,920,997 | A | 5/1990 | Vetter et al. |
| 4,922,575 | A | 5/1990 | Riemann |
| 4,991,254 | A | 2/1991 | Roden et al. |
| 5,005,597 | A | 4/1991 | Popelier et al. |
| 5,026,488 | A | 6/1991 | Mesheau |
| 5,027,464 | A | 7/1991 | Knowlton |
| 5,044,043 | A | 9/1991 | Field et al. |
| 5,045,118 | A | 9/1991 | Mason et al. |
| 5,054,150 | A | 10/1991 | Best et al. |
| 5,054,158 | A | 10/1991 | Williams et al. |
| 5,058,235 | A | 10/1991 | Charky |
| 5,075,921 | A | 12/1991 | Gleadall |
| D323,797 | S | 2/1992 | Oslapas et al. |
| 5,090,083 | A | 2/1992 | Wulff |
| 5,093,955 | A | 3/1992 | Blehert et al. |
| 5,109,566 | A | 5/1992 | Kobayashi et al. |
| 5,117,944 | A | 6/1992 | Hurtevent |
| 5,127,124 | A | 7/1992 | Palmer et al. |
| 5,135,080 | A | 8/1992 | Haston |
| 5,138,742 | A | 8/1992 | Charky |
| 5,168,947 | A | 12/1992 | Rodenborn |
| 5,174,730 | A | 12/1992 | Nieuwkamp et al. |
| 5,184,372 | A | 2/1993 | Mache |
| 5,212,848 | A | 5/1993 | Geyer |
| 5,217,166 | A | 6/1993 | Schulze et al. |
| 5,221,026 | A | 6/1993 | Williams |
| 5,226,941 | A | 7/1993 | Uibel et al. |
| 5,239,720 | A | 8/1993 | Wood et al. |
| 5,245,144 | A | 9/1993 | Stammen |
| 5,265,300 | A | 11/1993 | O'Hara et al. |
| 5,279,672 | A | 1/1994 | Betker et al. |
| 5,303,448 | A | 4/1994 | Hennessey et al. |
| 5,307,538 | A | 5/1994 | Rench et al. |
| 5,311,892 | A | 5/1994 | Adelt et al. |
| 5,349,718 | A | 9/1994 | Gibbon |
| 5,360,307 | A | 11/1994 | Schemm et al. |
| 5,364,114 | A | 11/1994 | Petersen |
| 5,372,376 | A | 12/1994 | Pharaoh |
| 5,377,376 | A | 1/1995 | Wood et al. |
| 5,377,382 | A | 1/1995 | Bores et al. |
| 5,383,605 | A | 1/1995 | Teague |
| 5,390,690 | A | 2/1995 | Blaga |
| 5,403,473 | A | 4/1995 | Moorehead et al. |
| 5,416,949 | A | 5/1995 | Jute |
| 5,419,006 | A | 5/1995 | Duthie |
| 5,426,805 | A | 6/1995 | Fisher |
| 5,435,038 | A | 7/1995 | Sauers |
| RE35,033 | E | 9/1995 | Waldhauser |
| 5,455,985 | A | 10/1995 | Hamline et al. |
| D364,012 | S | 11/1995 | Bothun et al. |
| 5,465,451 | A | 11/1995 | Stegens |
| 5,465,456 | A | 11/1995 | Fellhauer et al. |
| 5,467,500 | A | 11/1995 | O'Hara et al. |
| 5,485,653 | A | 1/1996 | Knowlton et al. |
| 5,500,979 | A | 3/1996 | Worwag |
| D369,446 | S | 4/1996 | Smith |
| 5,502,868 | A | 4/1996 | Braeendle |
| 5,509,162 | A | 4/1996 | Burgoon |
| D370,320 | S | 5/1996 | Hachtmann |
| 5,524,320 | A | 6/1996 | Zachhuber |
| 5,537,712 | A | 7/1996 | Weber et al. |
| 5,555,595 | A | 9/1996 | Ligman |
| 5,555,596 | A | 9/1996 | Knowlton et al. |
| 5,607,178 | A | 3/1997 | Legatt et al. |
| 5,608,947 | A | 3/1997 | Knowlton et al. |
| 5,611,108 | A | 3/1997 | Knowlton et al. |
| 5,620,309 | A | 4/1997 | Todden et al. |
| 5,628,086 | A | 5/1997 | Knowlton et al. |
| D381,480 | S | 7/1997 | Linville et al. |
| 5,653,261 | A | 8/1997 | Dalhart et al. |
| 5,742,975 | A | 4/1998 | Knowlton et al. |
| 5,768,742 | A | 6/1998 | Kohl et al. |
| 5,785,453 | A | 7/1998 | Marty et al. |
| 5,802,665 | A | 9/1998 | Knowlton et al. |
| 5,813,086 | A | 9/1998 | Ueno et al. |
| 5,890,258 | A | 4/1999 | Lee |
| 5,898,970 | A | 5/1999 | Straiton |
| 5,901,409 | A | 5/1999 | Schick et al. |
| 5,943,733 | A | 8/1999 | Tagliaferri |
| 5,984,031 | A | 11/1999 | Velke et al. |
| 6,023,813 | A | 2/2000 | Thatcher et al. |
| 6,030,465 | A | 2/2000 | Marcussen et al. |
| 6,041,471 | A | 3/2000 | Charky et al. |
| 6,059,055 | A | 5/2000 | Velke et al. |
| 6,088,873 | A | 7/2000 | Pacchini et al. |
| 6,131,240 | A | 10/2000 | Shark et al. |
| 6,145,855 | A | 11/2000 | Bellis, Jr. |
| 6,158,084 | A | 12/2000 | Weber et al. |
| 6,158,673 | A | 12/2000 | Toetschinger |
| 6,206,980 | B1 | 3/2001 | Robinson |
| 6,212,731 | B1 | 4/2001 | Eckerlein |
| 6,227,957 | B1 | 5/2001 | Legatt et al. |
| 6,230,363 | B1 | 5/2001 | Kawai et al. |
| 6,266,892 | B1 | 7/2001 | Haynie |
| 6,267,190 | B1 | 7/2001 | Micheletti |
| 6,283,170 | B1 | 9/2001 | Robinson |
| 6,302,230 | B1 | 10/2001 | Kamen et al. |
| 6,338,013 | B1 | 1/2002 | Ruffner |
| 6,347,681 | B1 | 2/2002 | Patmont et al. |
| 6,367,120 | B2 | 4/2002 | Beauchamp |
| 6,371,228 | B1 | 4/2002 | Husted et al. |
| 6,397,429 | B1 | 6/2002 | Legatt et al. |
| 6,425,958 | B1 | 7/2002 | Giddings et al. |
| 6,427,285 | B1 | 8/2002 | Legatt et al. |
| 6,428,590 | B1 | 8/2002 | Lehman et al. |
| 6,431,217 | B2 | 8/2002 | Robinson |
| 6,431,302 | B2 | 8/2002 | Patmont et al. |
| 6,442,789 | B1 | 9/2002 | Legatt et al. |
| 6,450,867 | B1 | 9/2002 | Legatt |
| 6,453,506 | B1 | 9/2002 | Sumner |
| 6,464,025 | B1 | 10/2002 | Koeper et al. |
| 6,484,353 | B2 | 11/2002 | Rau |
| 6,490,849 | B1 | 12/2002 | Scag et al. |
| 6,497,422 | B1 | 12/2002 | Bellis, Jr. et al. |
| 6,502,017 | B2 | 12/2002 | Ruffner |
| 6,519,808 | B2 | 2/2003 | Legatt et al. |
| 6,530,821 | B2 | 3/2003 | Legatt et al. |
| 6,533,871 | B2 | 3/2003 | Zahuranec et al. |
| 6,535,793 | B2 | 3/2003 | Allard |
| 6,553,609 | B2 | 4/2003 | Tremmel et al. |
| 6,554,207 | B2 | 4/2003 | Ebberts |
| 6,571,805 | B2 | 6/2003 | Hoenisch et al. |
| 6,585,827 | B2 | 7/2003 | Field et al. |
| 6,594,844 | B2 | 7/2003 | Jones |
| 6,600,981 | B2 | 7/2003 | Ruffner |
| 6,625,843 | B2 | 9/2003 | Kim et al. |
| 6,629,333 | B2 | 10/2003 | Bolden et al. |
| 6,647,585 | B1 | 11/2003 | Robinson |
| 6,650,975 | B2 | 11/2003 | Ruffner |
| 6,671,925 | B2 | 1/2004 | Field et al. |
| 6,681,433 | B1 | 1/2004 | Ruuska et al. |
| 6,684,452 | B2 | 2/2004 | Lehman et al. |
| 6,705,332 | B2 | 3/2004 | Field et al. |
| 6,721,990 | B2 | 4/2004 | Zahuranec et al. |
| 6,725,512 | B2 | 4/2004 | Carter et al. |
| 6,735,811 | B2 | 5/2004 | Field et al. |

(56) References Cited

U.S. PATENT DOCUMENTS

| | | | |
|---|---|---|---|
| 6,735,812 | B2 | 5/2004 | Hekman et al. |
| 6,760,947 | B2 | 7/2004 | Stuchlik |
| 6,772,475 | B2 | 8/2004 | Weber et al. |
| 6,789,290 | B2 | 9/2004 | Kent et al. |
| 6,842,940 | B2 | 1/2005 | Christopher et al. |
| 6,845,829 | B2 | 1/2005 | Hafendorfer |
| 6,871,371 | B2 | 3/2005 | Guest |
| 6,880,199 | B1 | 4/2005 | Huffman et al. |
| 6,918,156 | B2 | 7/2005 | Joo et al. |
| 6,918,603 | B2 | 7/2005 | Boyd |
| 6,941,614 | B2 | 9/2005 | Montgomery |
| 6,945,261 | B2 | 9/2005 | Wadsworth et al. |
| 6,948,527 | B2 | 9/2005 | Ragner et al. |
| 6,981,338 | B2 | 1/2006 | Jensen et al. |
| 7,025,835 | B2 | 4/2006 | Pedlar et al. |
| 7,041,029 | B2 | 5/2006 | Fulghum et al. |
| 7,048,805 | B2 | 5/2006 | Kent et al. |
| 7,055,201 | B2 | 6/2006 | Buchegger et al. |
| 7,059,004 | B2 | 6/2006 | Mitchell et al. |
| D533,320 | S | 12/2006 | Pedlar |
| D536,146 | S | 1/2007 | Pedlar |
| D536,842 | S | 2/2007 | Pedlar |
| D536,843 | S | 2/2007 | Pedlar |
| D536,844 | S | 2/2007 | Pedlar |
| D536,845 | S | 2/2007 | Pedlar |
| D536,846 | S | 2/2007 | Pedlar |
| D538,492 | S | 3/2007 | Pedlar |
| D542,988 | S | 5/2007 | Dammkoehler et al. |
| D543,323 | S | 5/2007 | Pedlar |
| D544,659 | S | 6/2007 | Auerswald et al. |
| D549,405 | S | 8/2007 | Dammkoehler |
| 7,287,299 | B2 | 10/2007 | Joynt |
| 7,302,734 | B2 | 12/2007 | Nowak et al. |
| 7,328,758 | B2 | 2/2008 | Ruffo |
| 7,350,264 | B2 | 4/2008 | Bedard et al. |
| D569,057 | S | 5/2008 | Goff |
| 7,370,386 | B2 | 5/2008 | Lehman et al. |
| D571,512 | S | 6/2008 | Dammkoehler et al. |
| 7,430,782 | B2 | 10/2008 | Ruffo |
| 7,533,435 | B2 | 5/2009 | Pedlar et al. |
| 7,555,801 | B2 | 7/2009 | Peters et al. |
| 7,611,555 | B2 | 11/2009 | Wattenberg et al. |
| 7,712,181 | B2 | 5/2010 | Riach |
| 8,002,862 | B2 | 8/2011 | Schultink |
| D654,234 | S | 2/2012 | Hein |
| D659,308 | S | 5/2012 | Dammkoehler |
| D661,853 | S | 6/2012 | Dammkoehler |
| 8,245,345 | B2 | 8/2012 | Pedlar et al. |
| 8,261,759 | B2 | 9/2012 | Kelle et al. |
| 8,302,240 | B2 | 11/2012 | Tucker et al. |
| 8,397,333 | B2 | 3/2013 | Tucker et al. |
| 8,438,685 | B2 | 5/2013 | Pedlar et al. |
| 8,528,142 | B1 | 9/2013 | Pedlar et al. |
| D693,529 | S | 11/2013 | Garner |
| 8,887,340 | B2 | 11/2014 | Pedlar et al. |
| 9,015,887 | B1 | 4/2015 | Pedlar et al. |
| 9,192,276 | B2 | 11/2015 | Pedlar et al. |
| 2001/0002500 | A1 | 6/2001 | Kasen et al. |
| 2003/0159225 | A1 | 8/2003 | Kuo |
| 2003/0192963 | A1 | 10/2003 | Ebberts |
| 2004/0040102 | A1 | 3/2004 | Field et al. |
| 2004/0172769 | A1 | 9/2004 | Giddings et al. |
| 2004/0187895 | A1 | 9/2004 | Field et al. |
| 2004/0221407 | A1 | 11/2004 | Field et al. |
| 2004/0226578 | A1 | 11/2004 | Guest et al. |
| 2004/0226584 | A1 | 11/2004 | Guest et al. |
| 2004/0262871 | A1 | 12/2004 | Schreuder et al. |
| 2005/0081319 | A1 | 4/2005 | Legatt |
| 2005/0251937 | A1 | 11/2005 | Ruffo |
| 2006/0064844 | A1 | 3/2006 | Venard et al. |
| 2006/0124770 | A1 | 6/2006 | Venard et al. |
| 2006/0156498 | A1 | 7/2006 | Venard et al. |
| 2006/0236494 | A1 | 10/2006 | Nelson et al. |
| 2011/0023918 | A1 | 2/2011 | Kelle et al. |
| 2012/0096671 | A1 | 4/2012 | Venard et al. |
| 2013/0005224 | A1 | 1/2013 | Leifheit et al. |
| 2015/0190027 | A1 | 7/2015 | Pedlar et al. |

FOREIGN PATENT DOCUMENTS

| | | |
|---|---|---|
| BR | PI 0511488 | 1/2008 |
| CA | 2242793 | 7/1998 |
| CA | 2268234 | 10/1999 |
| DE | 1023867 | 2/1958 |
| DE | 1270066 | 6/1968 |
| DE | 1658384 | 4/1971 |
| DE | 7703475 | 6/1977 |
| DE | 69011648 | 12/1994 |
| DE | 4440202 | 5/1995 |
| DE | 9421472 | 1/1996 |
| DE | 4429996 | 2/1996 |
| DE | 9421625 | 3/1996 |
| DE | 19539350 | 4/1997 |
| DE | 19745887 | 8/1998 |
| DE | 19851681 | 5/2000 |
| DE | 19851666 | 9/2000 |
| DE | 69608989 | 11/2000 |
| DE | 19927593 | 4/2001 |
| DE | 10029691 | 1/2002 |
| DE | 10030725 | 1/2002 |
| DE | 10062329 | 7/2002 |
| DE | 20204485 | 10/2002 |
| DE | 10142192 | 3/2003 |
| DE | 10204118 | 10/2003 |
| DE | 10218244 | 11/2003 |
| DE | 10221349 | 11/2003 |
| DE | 10221351 | 11/2003 |
| DE | 10221352 | 11/2003 |
| DE | 10307150 | 9/2004 |
| DE | 10324825 | 12/2004 |
| DE | 10324826 | 12/2004 |
| EP | 0017913 | 10/1980 |
| EP | 0176696 | 4/1986 |
| EP | 0176697 | 4/1986 |
| EP | 0189617 | 8/1986 |
| EP | 0281976 | 9/1988 |
| EP | 0282850 | 9/1988 |
| EP | 0283022 | 9/1988 |
| EP | 0421194 | 4/1991 |
| EP | 0569430 | 11/1993 |
| EP | 0621004 | 10/1994 |
| EP | 0792615 | 9/1997 |
| EP | 0867331 | 9/1998 |
| EP | 0948928 | 10/1999 |
| EP | 0951857 | 10/1999 |
| EP | 1023867 | 8/2000 |
| EP | 1108091 | 6/2001 |
| EP | 1108092 | 6/2001 |
| EP | 1164074 | 12/2001 |
| EP | 1260129 | 11/2002 |
| EP | 1335869 | 8/2003 |
| EP | 1265713 | 2/2004 |
| EP | 1604605 | 12/2005 |
| FR | 2224340 | 10/1974 |
| GB | 1112147 | 5/1968 |
| GB | 2338686 | 12/1999 |
| JP | H04-264903 | 9/1992 |
| JP | H07-47039 | 2/1995 |
| JP | H08-182638 | 7/1996 |
| JP | H08-196496 | 8/1996 |
| JP | H09-94201 | 4/1997 |
| JP | 2000-217759 | 8/2000 |
| JP | 2001-258807 | 9/2001 |
| JP | 2002-078650 | 3/2002 |
| JP | 2003-246237 | 9/2003 |
| JP | 2003-504095 | 9/2003 |
| JP | 2005-324020 | 11/2005 |
| WO | WO 86/01240 | 2/1986 |
| WO | WO 86/02394 | 4/1986 |
| WO | WO 89/06624 | 7/1989 |
| WO | WO 90/10416 | 9/1990 |
| WO | WO 92/13480 | 8/1992 |
| WO | WO 97/15730 | 5/1997 |

(56) References Cited

FOREIGN PATENT DOCUMENTS

| | | |
|---|---|---|
| WO | WO 97/15731 | 5/1997 |
| WO | WO 00/28149 | 5/2000 |
| WO | WO 00/74549 | 12/2000 |
| WO | WO 00/79058 | 12/2000 |
| WO | WO 01/05216 | 1/2001 |
| WO | WO 01/41935 | 6/2001 |
| WO | WO 02/42184 | 5/2002 |
| WO | WO 2005/079468 | 9/2005 |
| WO | WO 2006/121783 | 11/2006 |

OTHER PUBLICATIONS

90/0130, Nov. 12, 2014, Reexam Certificate Issued for U.S. Pat. No. 7,533,435.
90/0130, Dec. 19, 2014, Reexam Certificate Issued for U.S. Pat. No. 8,528,142.
"Adgressor™ Scrubber Models BR 850S, 850CS, 950S, 950CS, BR 1050S, 1050CS," Service Manual Nilfisk Advance, 2006, 82 pages in multiple parts.
"Adgressor™ Scrubber Models BR 850S, 850CS, 950S, 950CS, BR 1050S, 1050CS," Instructions for Use, Nilfisk Advance, 2004, 29 pages in multiple parts.
"Adgressor™ Scrubber Models BR 850S, 850CS, 950S, 950CS, BR 1050S, 1050CS," Parts List, Nilfisk Advance, 2004, 69 pages in multiple parts.
Allied Sweepers 400 Series Specs., May 1998, 1 page.
American-Lincoln Encore Scrubber, Operator's Manual & Parts List, American-Lincoln, 1998, 43 pages in multiple parts.
Fantomat Sale Sheet, Buzili-Werk Wagner GmbH & Co., date unknown.
Galopio Cleaning Device, www.schmidt-holding.com, accessed Feb. 23, 2005, 4 pages.
Galopio Operating Instructions, Schmidt Winterdienst-Und Kommunaltechnik, Jan. 17, 2005, Issue 5, pp. 1-84.
Hefter Cleantech, Convert 82, May 19, 2006, 3 pages, accessed Jun. 1, 2007.
Kärcher, MC600 Multicleaner Brochure, date unknown, 2 pages.
Kärcher, MC600 Multicleaner Brochure, date unknown, 4 pages.
Kärcher, Multicleaner MC 600, Mar. 1990, 7 pages.
Kärcher, Multicleaner MC600 Manual, date unknown, 44 pages.
Kärcher, NT301 Brochure, date unknown, 2 pages.
Kärcher, Worldwide Cleaning Expertise Programme 91/92, published more than one year prior to the filing of U.S. Pat. No. 6,425,958, which was filed Feb. 2001, 50 pages.
Madvac PS300 Brochure, Feb. 2004, 4 pages.
"Minny 16," FIMAP, Italian Customized Cleaning, 2007, 8 pages.
Nilfisk-Advance Product Catalog, 2004, 6 pages in multiple parts.
Nobles Typhoon 161OP/1612 Wet/Dry Vacuum Operator and Parts Manual, Jan. 2000, 22 pages Kaivac, Inc.
No-Touch Cleaning Brochure, Kaivac, Inc., dated 2003, 8 pages.
Operating Instructions Manual for the Galopio Sweeping Machine identified as 'Galopio.1, Listen-Nr. 1014691-4', dated Oct. 7, 2002, (Galopio 2002), with certified translation dated Sep. 27, 2013, 179 pages.
Photo and information related to Galopio device sold on Mascus website, available at http://www.mascus.com/product_card.asp?br=Broddway&catn=Groundscare&page=1&location=EN< . . . , indicates that device was registered in 2000, printed on Jan. 29, 2007, p. 1.
Photo of Galopio device, available at http://www.bassewitz.de/fahrzeuge/schmidt.htm, as early as Jan. 26, 2002, printed on Jan. 29, 2007, pp. 1-2.
Photos of Galopio Sweeping Machine, identified as being manufactured in 1999, (provided by 3rd Party Requestor in U.S. Patent Reexamination Control Nos. 90/013,026 and 90/013,028), 7 pages.
Print out of Kaivac No-Touch Clean System, www.Kaivac.com, dated Jan. 23, 2003, 3 pages.
Print out of Nilfisk Aquatron 8 machine, www.mn.nilfisk-advance.com, dated Jan. 30, 2003, 1 page.
"Schmidt Produkte: Kleinkehrfahrzeug Galopio", Photo of Galopio device, available at http://database.schmidtgroup.net/loader.php//en/schmidt/swk/products/00011/picture1.html, as early as Apr. 29, 2003, printed on Jan. 29, 2007, p. 1.
"Schmidt Produkte: Kleinkehrfahrzeug Galopio", Photo of Galopio device, available at http://database.schmidtgroup.net/loader.php/de/schmidt/swk/00011/, as early as May 29, 2003, printed on Jan. 29, 2007, p. 1.
Service Master, Boss 2000B Manual, Oct. 1995, 42 pages.
Service Master, Boss 2000E Manual, Aug. 1997, 32 pages.
Service Master, Boss 2000LE Manual, Mar. 1998, 30 pages.
Street Cleaning device shown on www.onyx-environment.com, accessed May 7, 2004, 1 page.
"Taski Swingo XP Scrubber," Brochure, Johnson Diversey, 2007, 7 pages in multiple parts.
Tennant Model 1465 and 1480 Manual, 1988, pp. 3-18 and 6-34.
"The Science of Floor Care: Profi™ Rubber Floor Cleaner/Degreaser," Taski, http://www.johnsondiversey.com/Cultures/en-US-OpCo/Products+and+Systems/Categori . . . , accessed Nov. 12, 2008, 2 pages.
Warning: Your Competitor has a KaiVac, Sep. 1998, 10 pages.
Complaint With Jury Demand, *Kärcher North America, Inc.*, v. *Nilfisk-Advance, Inc.*, United States District Court for the District of Colorado, Case No. 1:13-cv-01284, filed May 16, 2013, 147 pages.
Answer and Counterclaims of Defendant Nilfisk-Advance, Inc., *Kärcher North America, Inc.*, v. *Nilfisk-Advance, Inc.*, United States District Court for the District of Colorado, Case No. 1:13-cv-01284-CMA-MJW, filed May 31, 2013, 12 pages.
Amended Answer and Counterclaims of Defendant Nilfisk-Advance, Inc., *Kärcher North America, Inc.*, v. *Nilfisk-Advance, Inc.*, United States District Court for the District of Colorado, Case No. 1:13-cv-01284-CMA-MJW, filed Jul. 12, 2013, 13 pages.
Plaintiff Kärcher North America, Inc.'s Motion for Preliminary Injunction and Memorandum in Support Thereof, *Kärcher North America, Inc.*, v. *Nilfisk-Advance, Inc.*, United States District Court for the District of Colorado, Case No. 1:13-cv-01284-CMA-MJW, filed Jul. 26, 2013, 16 pages.
Declaration of David B. Kellis in Support of Kärcher North America, Inc.'s Motion for Preliminary Injunction, (dated Jul. 26, 2013), *Kärcher North America, Inc.*, v. *Nilfisk-Advance, Inc.*, United States District Court for the District of Colorado, Case No. 1:13-cv-01284-CMA-MJW, filed Jul. 26, 2013, 107 pages.
Declaration of Elliot Younessian in Support of Kärcher North America, Inc.'s Motion for Preliminary Injunction, (dated Jul. 17, 2013), *Kärcher North America, Inc.*, v. *Nilfisk-Advance, Inc.*, United States District Court for the District of Colorado, Case No. 1:13-cv-01284-CMA-MJW, filed Jul. 26, 2013, 147 pages.
Nilfisk-Advance, Inc.'s Memorandum in Opposition to Kärcher North America, Inc.'s Motion for Preliminary Injunction, *Kärcher North America, Inc.*, v. *Nilfisk-Advance, Inc.*, United States District Court for the District of Colorado, Case No. 1:13-cv-01284-CMA-MJW, filed Aug. 16, 2013, 16 pages.
Declaration of Christopher R. Smith in Opposition to Kärcher North America, Inc.'s Motion for Preliminary Injunction, (dated Aug. 16, 2013), *Kärcher North America, Inc.*, v. *Nilfisk-Advance, Inc.*, United States District Court for the District of Colorado, Case No. 1:13-cv-01284-CMA-MJW, filed Aug. 16, 2013, 148 pages.
Declaration of Tyler L. Nasiedlak in Opposition to Kärcher North America, Inc.'s Motion for Preliminary Injunction, (dated Aug. 16, 2013), *Kärcher North America, Inc.*, v. *Nilfisk-Advance, Inc.*, United States District Court for the District of Colorado, Case No. 1:13-cv-01284-CMA-MJW, filed Aug. 16, 2013, 517 pages.
Declaration of David Wood in Opposition to Kärcher North America, Inc.'s Motion for Preliminary Injunction, (dated Aug. 16, 2013), *Kärcher North America, Inc.*, v. *Nilfisk-Advance, Inc.*, United States District Court for the District of Colorado, Case No. 1:13-cv-01284-CMA-MJW, filed Aug. 16, 2013, 94 pages.
Declaration of Wade Reitmeier in Support of Defendant Nilfisk-Advance, Inc.'s Reponse to Motion for Preliminary Injunction, (dated Aug. 16, 2013), *Kärcher North America, Inc.*, v. *Nilfisk-Advance, Inc.*, United States District Court for the District of Colorado, Case No. 1:13-cv-01284-CMA-MJW, filed Aug. 16, 2013, 23 pages.

(56) References Cited

OTHER PUBLICATIONS

Plaintiff Kärcher North America, Inc.'s Reply in Further Support of Motion for Preliminary Injuction [Doc. No. 18], *Kärcher North America, Inc.*, v. *Nilfisk-Advance, Inc.*, United States District Court for the District of Colorado, Case No. 1:13-cv-01284-CMA-MJW, filed Sep. 3, 2013, 11 pages.
Sep. 3, 2013 Declaration of Elliot Younessian in Further Support of Motion for Preliminary Injuction, *Kärcher North America, Inc.*, v. *Nilfisk-Advance, Inc.*, United States District Court for the District of Colorado, Case No. 1:13-cv-01284-CMA-MJW, filed Sep. 3, 2013, 235 pages.
Declaration of Craig W. Mueller in Support of Kärcher North America, Inc.'s Motion for Preliminary Injunction, (dated Sep. 3, 2013), *Kärcher North America, Inc.*, v. *Nilfisk-Advance, Inc.*, United States District Court for the District of Colorado, Case No. 1:13-cv-01284-CMA-MJW, filed Sep. 3, 2013, 193 pages.
First Amended Complaint With Jury Demand, *Kärcher North America, Inc.*, v. *Nilfisk-Advance, Inc.*, United States District Court for the District of Colorado, Case No. 1:13-cv-01284-CMA-MJW, filed Sep. 25, 2013, 151 pages.
Second Amended Answer and Counterclaims of Defendant Nilfisk-Advance, Inc., *Kärcher North America, Inc.*, v. *Nilfisk-Advance, Inc.*, United States District Court for the District of Colorado, Case No. 1:13-cv-01284-CMA-MJW, filed Oct. 9, 2013, 13 pages.
Plaintiff Kärcher North America, Inc.'s Second Motion for Preliminary Injunction and Memorandum in Support Thereof, *Kärcher North America, Inc.*, v. *Nilfisk-Advance, Inc.*, United States District Court for the District of Colorado, Case No. 1:13-cv-01284-CMA-MJW, filed Oct. 9, 2013, 14 pages.
Oct. 2, 2013 Declaration of Elliot Younessian in Support of Kärcher North America, Inc.'s Second Motion for Preliminary Injunction, *Kärcher North America, Inc.*, v. *Nilfisk-Advance, Inc.*, United States District Court for the District of Colorado, Case No. 1:13-cv-01284-CMA-MJW, filed Oct 9, 2013, 61 pages.
Defendant Nilfisk-Advance, Inc.'s Motion to Stay Litigation Pending Patent Reexaminations and Memorandum in Support, *Kärcher North America, Inc.*, v. *Nilfisk-Advance, Inc.*, United States District Court for the District of Colorado, Case No. 1:13-cv-01284-CMA-MJW, filed Oct. 22, 2013, 15 pages.
Declaration of Christopher R. Smith in Support of Nilfisk-Advance's Motion to Stay Litigation Pending Patent Reexaminations, (dated Oct. 22, 2013), *Kärcher North America, Inc.*, v. *Nilfisk-Advance, Inc.*, United States District Court for the District of Colorado, Case No. 1:13-cv-01284-CMA-MJW, filed Oct. 22, 2013, 333 pages.
Nilfisk-Advance, Inc.'s Memorandum in Opposition to Kärcher North America, Inc.'s Second Motion for Preliminary Injunction, *Kärcher North America, Inc.*, v. *Nilfisk-Advance, Inc.*, United States District Court for the District of Colorado, Case No. 1:13-cv-01284-CMA-MJW, filed Nov. 4, 2013, 17 pages.
Declaration of Christopher R. Smith in Opposition to Kärcher North America, Inc.'s Second Motion for Preliminary Injunction, (dated Nov. 4, 2013), *Kärcher North America, Inc.*, v. *Nilfisk-Advance, Inc.*, United States District Court for the District of Colorado, Case No. 1:13-cv-01284-CMA-MJW, filed Nov. 4, 2013, 374 pages.
Declaration of Tyler L. Nasiedlak in Opposition to Kärcher North America, Inc.'s Second Motion for Preliminary Injunction, (dated Nov. 4, 2013), *Kärcher North America, Inc.*, v. *Nilfisk-Advance, Inc.*, United States District Court for the District of Colorado, Case No. 1:13-cv-01284-CMA-MJW, filed Nov. 4, 2013, 232 pages.
Declaration of David Wood in Opposition to Kärcher North America, Inc.'s Second Motion for Preliminary Injunction, (dated Nov. 4, 2013), *Kärcher North America, Inc.*, v. *Nilfisk-Advance, Inc.*, United States District Court for the District of Colorado, Case No. 1:13-cv-01284-CMA-MJW, filed Nov. 4, 2013, 70 pages.
Amended Declaration of Tyler L. Nasiedlak in Opposition to Kärcher North America, Inc.'s First Motion for Preliminary Injunction, (dated Nov. 21, 2013), *Kärcher North America, Inc.*, v. *Nilfisk-Advance, Inc.*, United States District Court for the District of Colorado, Case No. 1:13-cv-01284-CMA-MJW, filed Nov. 21, 2013, 637 pages. (Uploaded in 3 parts).
Reply in Further Support of Second Motion for Preliminary Injuction, *Kärcher North America, Inc.*, v. *Nilfisk-Advance, Inc.*, United States District Court for the District of Colorado, Case No. 1:13-cv-01284-CMA-MJW, filed Nov. 21, 2013, 11 pages.
Nov. 15, 2013 Declaration of Elliot Younessian, *Kärcher North America, Inc.*, v. *Nilfisk-Advance, Inc.*, United States District Court for the District of Colorado, Case No. 1:13-cv-012842-CMA-MJW, filed Nov. 21, 2013, 13 pages.
Nov. 21, 2013 Declaration of Craig W. Mueller, *Kärcher North America, Inc.*, v. *Nilfisk-Advance, Inc.*, United States District Court for the District of Colorado, Case No. 1:13-cv-01284-CMA-MJW, filed Nov. 21, 2013, 102 pages.
Nov. 21, 2013 Declaration of Jeffrey J. Rogers, *Kärcher North America, Inc.*, v. *Nilfisk-Advance, Inc.*, United States District Court for the District of Colorado, Case No. 1:13-cv-01284-CMA-MJW, filed Nov. 21, 2013, 117 pages.
Declaration of David B. Kellis in Support of Kärcher North America, Inc.'s Opposition to Stay Pending Patent Reexaminations and Reply in Further Support of Second Motion for Preliminary Injunction, *Kärcher North America, Inc.*, v. *Nilfisk-Advance, Inc.*, United States District Court for the District of Colorado, Case No. 1:13-cv-01284-CMA-MJW, filed Nov. 21, 2013, 12 pages.
Declaration of Gary Ellertson, (dated Nov. 19, 2013), *Kärcher North America, Inc.*, v. *Nilfisk-Advance, Inc.*, United States District Court for the District of Colorado, Case No. 1:13-cv01284-CMA-MJW, filed Nov. 21, 2013, 3 pages.
Defendant's Invalidity Contentions, *Kärcher North America, Inc.*, v. *Nilfisk-Advance, Inc.*, United States District Court for the District of Colorado, Case No. 1:13-cv-01284-CMA-MJW, dated Dec. 2, 2013, 481 pages.
Defendant's Reply Brief in Support of its Motion to Stay Litigation Pending Patent Reexaminations, *Kärcher North America, Inc.*, v. *Nilfisk-Advance, Inc.*, United States District Court for the District of Colorado, Case No. 1:13-cv-01284-CMA-MJW, filed Dec. 9, 2013, 11 pages.
Declaration of David Wood in Support of Nilfisk-Advance, Inc.'s Motion for a Stay, (dated Dec. 9, 2013), *Kärcher North America, Inc.*, v. *Nilfisk-Advance, Inc.*, United States District Court for the District of Colorado, Case No. 1:13-cv-01284-CMA-MJW, filed Dec. 9, 2013, 45 pages.
Second Declaration of Christopher R. Smith in Support of Nilfisk-Advance's Motion to Stay Litigation Pending Patent Reexaminations, (dated Dec. 9, 2013), *Kärcher North America, Inc.*, v. *Nilfisk-Advance, Inc.*, United States District Court for the District of Colorado, Case No. 1:13-cv-01284-CMA-MJW, filed Dec. 9, 2013, 41 pages.
Notice of Defendant Nilfish-Advance, Inc.'s Compliance With D.C.COLO.LPtR 8 and 9 and Invalidity Contentions, (dated Mar. 27, 2015), *Kärcher North America, Inc.*, v. *Nilfisk-Advance, Inc.*, United States District Court for the District of Colorado, Case No. 1:13-cv-01284-CMA-MJW, 2 pages.
Exhibit A of Notice of Defendant Nilfish-Advance, Inc.'s Compliance With D.C.COLO.LPtR 8 and 9 and Invalidity Contentions, (dated Mar. 27, 2015), *Kärcher North America, Inc.*, v. *Nilfisk-Advance, Inc.*, United States District Court for the District of Colorado, Case No. 1:13-cv-01284-CMA-MJW, 120 pages.
Exhibit B of Notice of Defendant Nilfish-Advance, Inc.'s Compliance With D.C.COLO.LPtR 8 and 9 and Invalidity Contentions, (dated Mar. 27, 2015), *Kärcher North America, Inc.*, v. *Nilfisk-Advance, Inc.*, United States District Court for the District of Colorado, Case No. 1:13-cv-01284-CMA-MJW, 73 pp.
Exhibit C of Notice of Defendant Nilfish-Advance, Inc.'s Compliance With D.C.COLO.LPtR 8 and 9 and Invalidity Contentions, (dated Mar. 27, 2015), *Kärcher North America, Inc.*, v. *Nilfisk-Advance, Inc.*, United States District Court for the District of Colorado, Case No. 1:13-cv-01284-CMA-MJW, 11 pages.
International Search Report for International (PCT) Application No. PCT/US05/05094, mailed Jul. 24, 2006.
Written Opinion of the International Searching Authority of related PCT Application PCT/US05/05094, Jul. 24, 2006, 7 pages.

(56) References Cited

OTHER PUBLICATIONS

International Preliminary Report on Patentability for International (PCT) Patent Application No. PCT/US05/05094 mailed Aug. 31, 2006, 9 pages.
International Search Report for International (PCT) Patent Application No. PCT/US06/40095 mailed May 24, 2007, 3 pages.
Written Opinion for International (PCT) Patent Application No. PCT/US06/40095 mailed May 24, 2007, 7 pages.
International Preliminary Report on Patentability for International (PCT) Patent Application No. PCT/US06/40095 mailed May 2, 2008, 6 pages.
Official Action for Australian Patent Application No. 2005214976 dated Feb. 4, 2010, 2 pages.
Notice of Acceptance for Australian Patent Application No. 2005214976 dated Mar. 17, 2010, 3 pages.
Official Action for Canadian Patent Application No. 2,559,485 dated May 19, 2011, 3 pages.
Official Action for Canadian Patent Application No. 2,559,485 dated Jan. 4, 2012, 2 pages.
Notice of Allowance for Canadian Patent Application No. 2,559,485 dated Apr. 4, 2012, 1 page.
First Office Action (including translation) for Chinese Application No. 200580011019.5, date mailed by foreign associate Nov. 21, 2008.
Second Office Action (including translation) for Chinese Application No. 200580011019.5, dated May 22, 2009.
Third Office Action (including translation) for Chinese Application No. 200580011019.5 dated Aug. 14, 2009, 7 pages.
Fourth Office Action (translation only) for Chinese Patent Application No. 200580011019.5, issued Oct. 13, 2010.
Notification of Grant Patent Right (including translation) for Chinese Patent Application No. 200580011019.5, dated Mar. 2, 2011.
Supplementary European Search Report for European Application No. 05713744, dated Aug. 4, 2008, 3 pages.
Official Action for European Application No. 05713744, dated Feb. 12, 2009.
Official Action for European Application No. 05713744, dated Nov. 3, 2010.
Official Action for European Patent Application No. 05713744.0, dated Jul. 24, 2014, 8 pages.
Extended European Search Report for European Patent Application No. 10178165.6, dated Oct. 29, 2010.
Official Action for European Patent Application No. 10178165.6, dated Jul. 24, 2014, 6 pages.
Extended European Search Report for European Patent Application No. 14003208.7, dated Dec. 5, 2014, 8 pages.
Extended European Search Report for European Patent Application No. 14003209.5, dated Dec. 5, 2014, 8 pages.
European Written Opinion and Search Report, Nov. 10, 2004 relating to European Application No. EP 04012451.
Official Action for Japanese Patent Application No. 2006-553367, issued Apr. 6, 2010.
Official Action for Japanese Patent Application No. 2006-553367, issued Apr. 5, 2011.
Official Action (English Summary) for Japanese Patent Application No. 2011-165315 dated Nov. 13, 2012, 2 pages.
Notice of Allowance (no English translation available) for Japanese Patent Application No. 2011-165315 dated Jul. 9, 2013, 3 pages.
Written Opinion by the Australian Patent Office for Singapore Application No. SG 200605344-1, mailed Jan. 9, 2008.
Examination Report issued by the Australian Patent Office for Singapore Application No. SG 200605344-1, mailed Jan. 25, 2010.
International Search Report for International (PCT) Patent Application No. PCT/US10/42116, mailed Sep. 14, 2010.
Written Opinion for International (PCT) Patent Application No. PCT/US10/42116, mailed Sep. 14, 2010.
International Preliminary Report on Patentability for International (PCT) Patent Application No. PCT/US2010/042116, mailed Feb. 9, 2012, 7 pages.
Official Action (with English translation) for Chinese Patent Application No. 201080043176.5 dated Jul. 3, 2013, 8 pages.
Official Action (with English translation) for Chinese Patent Application No. 201080043176.5 dated Feb. 18, 2014, 8 pages.
Official Action for European Patent Application No. 10804885.1, dated Mar. 7, 2012, 1 page.
Extended European Search Report for European Patent Application No. 10804885.1 dated Sep. 25, 2013, 7 pages.
Notice of Allowance (with English translation) for Russian Patent Application No. 2012107550/12(011366) dated Aug. 11, 2014, 14 pages.
Official Action (with English translation) for Korean Patent Application No. 30-2013-0011878 dated Feb. 24, 2014, 4 pages.
Notice of Allowance (with English translation) for Korean Patent Application No. 30-2013-0011878 dated Jul. 7, 2014, 3 pages.
Notice of Allowance for U.S. Appl. No. 11/059,663, mailed Feb. 6, 2009.
Office Action for U.S. Appl. No. 11/059,663, mailed Nov. 10, 2008.
Office Action for U.S. Appl. No. 11/059,663, mailed May 14, 2008.
Office Action for U.S. Appl. No. 11/059,663, mailed Apr. 19, 2007.
Office Action for U.S. Appl. No. 11/059,663, mailed Dec. 15, 2006.
Office Action for U.S. Appl. No. 11/059,663, mailed Jun. 26, 2006.
Office Action for U.S. Appl. No. 11/253,100, mailed Sep. 8, 2008.
Office Action for U.S. Appl. No. 11/253,100, mailed May 6, 2009.
Official Action for U.S. Appl. No. 11/253,100, mailed Aug. 14, 2009.
Official Action for U.S. Appl. No. 11/868,353, mailed Oct. 13, 2009.
Official Action for U.S. Appl. No. 11/868,353, mailed Feb. 16, 2010.
Official Action for U.S. Appl. No. 11/868,353, mailed Jun. 11, 2010.
Official Action for U.S. Appl. No. 11/868,353, mailed Jan. 27, 2011.
Official Action for U.S. Appl. No. 11/868,353, mailed May 9, 2011.
Official Action for U.S. Appl. No. 11/868,353, mailed Sep. 7, 2011, 17 pages.
Official Action for U.S. Appl. No. 11/868,353, mailed Feb. 3, 2012, 4 pages.
Notice of Allowance for U.S. Appl. No. 11/868,353, mailed May 17, 2012, 7 pages.
Official Action for U.S. Appl. No. 13/554,593 mailed Oct. 15, 2012, 5 pages.
Official Action for U.S. Appl. No. 13/554,593 mailed Dec. 11, 2012, 11 pages.
Notice of Allowance for U.S. Appl. No. 13/554,593 mailed Feb. 27, 2013, 8 pages.
Official Action for U.S. Appl. No. 13/888,140 mailed Jul. 15, 2013, 7 pages.
Notice of Allowance for U.S. Appl. No. 13/888,140 mailed Aug. 7, 2013, 9 pages.
Official Action for U.S. Appl. No. 13/964,046 mailed Dec. 2, 2013, 7 pages.
Official Action for U.S. Appl. No. 13/964,046 mailed Feb. 27, 2014, 24 pages.
Official Action for U.S. Appl. No. 13/964,046 mailed Aug. 4, 2014, 21 pages.
Notice of Allowance for U.S. Appl. No. 13/964,046 mailed Oct. 24, 2014, 8 pages.
Official Action for U.S. Appl. No. 14/643,768 mailed Jun. 1, 2015, 10 pages.
Final Action for U.S. Appl. No. 14/643,768 mailed Nov. 24, 2015, 8 pages.
Request for Ex Parte Reexamination of U.S. Pat. No. 7,533,435 filed Oct. 15, 2013, 170 pages.
Official Action for U.S. Patent Reexamination Control No. 90/013,028 mailed Nov. 27, 2013, 11 pages.
Official Action for U.S. Patent Reexamination Control No. 90/013,028 mailed Apr. 10, 2014, 17 pages.
Official Action for U.S. Patent Reexamination Control No. 90/013,028 mailed Jul. 15, 2014, 11 pages.
Notice of Intent to Issue Ex Parte Reexamination Certificate for U.S. Patent Reexamination Control No. 90/013,028 mailed Aug. 28, 2014, 5 pages.
Request for Ex Parte Reexamination of U.S. Pat. No. 8,528,142 filed Oct. 15, 2013, 133 pages.

(56) References Cited

OTHER PUBLICATIONS

Official Action for U.S. Patent Reexamination Control No. 90/013,026 mailed Nov. 27, 2013, 8 pages.
Official Action for U.S. Patent Reexamination Control No. 90/013,026 mailed Mar. 14, 2014, 10 pages.
Official Action for U.S. Patent Reexamination Control No. 90/013,026 mailed Jul. 30, 2014, 11 pages.
Notice of Intent to Issue Ex Parte Reexamination Certificate for U.S. Patent Reexamination Control No. 90/013,026 mailed Sep. 16, 2014, 5 pages.
Official Action for U.S. Appl. No. 12/511,704, mailed Mar. 12, 2012, 13 pages.
Notice of Allowance for U.S. Appl. No. 12/511,704, mailed Jul. 10, 2012, 10 pages.
Official Action for U.S. Appl. No. 13/589,321 mailed Sep. 14, 2012, 7 pages.
Notice of Allowance for U.S. Appl. No. 13/589,321 mailed Nov. 23, 2012, 8 pages.
Official Action for U.S. Appl. No. 14/133,248 mailed Feb. 27, 2014, 18 pages.
Official Action for U.S. Appl. No. 14/133,248 mailed Jul. 10, 2014, 19 pages.
Notice of Allowance for U.S. Appl. No. 14/133,248 mailed Oct. 8, 2014, 5 pages.
Official Action for U.S. Appl. No. 14/504,263, mailed Apr. 6, 2015, 9 pages.
Notice of Allowance for U.S. Appl. No. 14/504,263, mailed Aug. 24, 2015, 7 pages.
Official Action for U.S. Appl. No. 12/912,554 mailed Mar. 1, 2013, 11 pages.
Official Action for U.S. Appl. No. 12/912,554 mailed Jul. 19, 2013, 12 pages.
Notice of Allowance for U.S. Appl. No. 29/380,623 mailed Dec. 19, 2011, 6 pages.
Official Action for U.S. Appl. No. 29/431,705 mailed Mar. 19, 2013, 10 pages.
Notice of Allowance for U.S. Appl. No. 29/431,705 mailed Jun. 26, 2013, 7 pages.
Notice of Acceptance for European Patent Application No. 14003208.7, dated Apr. 20, 2016, 7 pages.
Notice of Acceptance for European Patent Application No. 14003209.5, dated Apr. 20, 2016, 7 pages.

(LEFT POSITION)

(NEUTRAL POSITION)

(RIGHT POSITION)

FLOOR CLEANING APPARATUS

This application is a continuation of U.S. patent Ser. No. 14/504,263, filed Oct. 1, 2014, now U.S. Pat. No. 9,192,276, which is a continuation of U.S. patent application Ser. No. 14/133,248, filed Dec. 18, 2013, now U.S. Pat. No. 8,887,340, which is a continuation of abandoned U.S. patent application Ser. No. 12/912,554, filed Oct. 26, 2010, which is a continuation-in-part of U.S. patent application Ser. No. 11/868,353, filed Oct. 5, 2007, now U.S. Pat. No. 8,245,345, which is a continuation of U.S. patent application Ser. No. 11/059,663, filed Feb. 15, 2005, now U.S. Pat. No. 7,533,435, which is a continuation-in-part of abandoned U.S. patent application Ser. No. 10/737,027, filed Dec. 15, 2003, which is a continuation-in-part of abandoned U.S. patent application Ser. No. 10/438,485, filed May 14, 2003, and which claims the benefit of U.S. Provisional Patent Application Nos. 60/545,153 and 60/627,606, filed Feb. 11, 2004 and Nov. 12, 2004, respectively, the entire disclosures of which are incorporated by reference herein.

U.S. patent application Ser. No. 12/912,554 also being a continuation-in-part of abandoned U.S. patent application Ser. No. 11/253,100, filed Oct. 17, 2005, the entire disclosure of which is incorporated by reference herein.

U.S. patent application Ser. No. 12/912,554 also being a continuation-in-part of abandoned U.S. patent application Ser. No. 11/352,191, filed Feb. 9, 2006, the entire disclosure of which is incorporated by reference herein.

U.S. patent application Ser. No. 12/912,554 also being a continuation-in-part of abandoned U.S. patent application Ser. No. 11/351,653, filed Feb. 9, 2006, the entire disclosure of which is incorporated by reference herein.

U.S. patent application Ser. No. 12/912,554 also being a continuation-in-part of U.S. patent application Ser. No. 12/511,704, filed Jul. 29, 2009, now U.S. Pat. No. 8,302,240, the entire disclosure of which is incorporated by reference herein.

U.S. patent application Ser. No. 14/133,248 is also a continuation-in-part of U.S. patent application Ser. No. 13/964,046, filed Aug. 10, 2013, now U.S. Pat. No. 9,015,887, which is a continuation of U.S. patent application Ser. No. 13/888,140, filed May 6, 2013, now U.S. Pat. No. 8,528,142, the entire disclosure of which is incorporated by reference herein.

This application is related to U.S. Pat. No. 5,555,596, entitled "Floor cleaning apparatus"; U.S. Pat. No. 5,485,653, entitled "Floor cleaning apparatus"; U.S. Pat. No. 5,628,086, entitled "Floor cleaning apparatus with Squeegee Mounting System"; and U.S. Pat. No. 5,608,947, entitled "Floor cleaning apparatus with Pre-Filter"; the entire disclosures of which are incorporated by reference herein.

FIELD OF THE INVENTION

Embodiments of the present invention are generally related to a surface treatment apparatus, such as for cleaning a floor. More specifically, one embodiment of the present invention is a floor treatment apparatus that provides a standing or sitting location for the operator and can operate in tight spaces.

Embodiments of the present invention also generally relate to floor cleaning apparatus that employ a sweeper or scrubber assembly that possess a vacuum's ability to capture small particles and/or debris and/or fluid that produces a lower noise output than typical commercially available apparatus.

Embodiments of the present invention are also generally related to floor cleaning machines. More specifically, one embodiment of the present invention is a floor cleaning machine that includes a steering mechanism with a flexible portion. The flexible portion accommodates movement of a housing to which it is associated to allow easy access to interior portions of the device.

BACKGROUND OF THE INVENTION

Cleaning machines are used extensively for cleaning flooring surfaces comprised of tile, stone, brick, wood, concrete, carpets and other common surfaces. Maintaining the cleanliness of these surfaces, especially in high volume areas in commercial, industrial, institutional and public buildings is an ongoing and time consuming process. The present invention relates to a highly maneuverable floor cleaning or treatment apparatus ("treatment apparatus") that supports an operator during use. More specifically, some embodiments of the present invention are adapted to clean, sweep, vacuum, burnish, wax, etc. ("treat") a floored surface, wherein the operator is supported by the cleaning device increasing efficiency and productivity of the cleaning operation. As used, "floored surface", or more generally "surface", encompasses areas covered by concrete, tile, carpet, wood, plastic, stone, turf or any other substance known in the art. The prior devices address many issues that arise with cleaning such floored surfaces. Before the present invention, no one device could address many, if not all, of the issues that arise in cleaning various surfaces in various environments at any point in time.

Mop & Bucket Cleaning Devices

In the past, building maintenance staff and others often treat surfaces, such as tiled hallways or restroom floors, using traditional mop and bucket techniques. The bucket may include a detachable mop ringer and may be positioned on caster wheels to facilitate easy movement. Depending on the cleanliness of the equipment, a worker may make a good start in treating a floor using the mop and bucket approach. However, soon the mop and fluid in the bucket becomes soiled or otherwise contaminated by germs and/or bacteria. From that point on, each time the worker plunges the mop into the bucket and rings the mop, both the mop and cleaning fluid become more dirty/contaminated.

Manually Propelled Cleaning Devices

The basic cleaning problems associated with the prior art mop & bucket approach to cleaning surfaces have generally been addressed in the art, as shown in U.S. Pat. No. 6,206,980 to Robinson, entitled "Multi-functional Cleaning Machine," which is fully incorporated herein by reference. This type of cleaning machine includes a manually propelled wheeled body with two tanks, one concentrated chemical receptacle, a vacuum and blower motor and a fluid pumping system. Typically, such equipment includes only a single motor used for both vacuuming soiled fluid and blowing air that can dry a cleaned surface. While such equipment is maneuverable and is an improvement over the earlier mop and bucket technology, the system is still labor intensive and slow. Productivity of cleaning professionals, when using these types of systems is decreased over what it might be with other types of systems that are available.

Self Propelled Walk Behind Device

Productivity concerns have been addressed in the art by the creation of certain walk behind floor treatment apparatus. These apparatus typically have a scrub deck at the machine's front and a squeegee at its rear. The squeegee has the ability to "swing" or follow the path of the scrub deck as the machine changes direction. This type of equipment is more efficient in cleaning large surface areas than either the mop and bucket or the manually propelled devices. However, the distance between the scrub deck and squeegee is relatively great. Also, walk behinds typically have relatively wide squeegees. These characteristics limit such machine's maneuverability and limit the doorways they can easily pass through. Typical 3' doorway allows a machine with no more than a 33" squeegee to fit through without removal.

Small walk behind floor cleaning apparatus typically include a scrub deck in the middle of the machine and squeegees at the machine's rear. In this configuration the squeegee has little or no ability to swing or follow the path of the scrub deck as the machine changes direction. Small rider scrubbers typically have relatively narrow squeegees, and rely on "side squeegees" (unvacuumized squeegee blades) adjacent to the scrub deck to direct the water into the path of the main (vacuumized) squeegee. The problem with these side squeegees is they do not perform well for long and leave a film of water in turns because the vacuumized squeegee does not follow the true path of the scrub deck, only the path of the side squeegees (which leave the film of water). Finally, side squeegee are typically heavy rubber blades and have significant down pressure applied to them to direct the water this makes them expensive and causes significant "drag" which increases the work for the propel unit and limits battery run time. While more maneuverable than larger walk behind floor treatment machines, the small machines rarely clean as well as the larger machines.

Storage Issues in Prior Art Devices

Further, known cleaning machines do not provide adequate onboard storage for cleaning supplies, tools, etc. Likewise, prior art machines rarely provide a flexible approach to adding storage facilities for trash and the like when the need for such arises. Machinery that addresses these issues is therefore needed.

Self-Propelled Ride-on Devices

Self-propelled cleaning devices are generally also well known in the field and are employed to treat large floored surfaces, such as tiled, concrete or carpeted floors found in hospitals, department stores, schools, gyms, etc. These devices provide the operator with seating from which he/she can control operation of the device. These devices are ideal for cleaning large, open areas because they can contain large amounts of waste fluids and/or debris without having to repeatedly perform time consuming fluid replacement or debris removal. Because these devices provide the user with seating, the user does not become prematurely fatigued, increasing overall worker productivity. These large ride-on machines are not particularly well-suited for cleaning smaller, more confined floor surfaces, which are often found in hallways, small rooms, or even large rooms which have many obstacles.

As is known in the art, smaller self-propelled cleaning devices are also in existence that are ideal for cleaning the smaller rooms and hallways. However, smaller devices are usually pushed or pulled by an operator. Hence, the major drawback of these devices is they often rely on operator strength to maneuver the device. Even if the device is self-propelled, it often employs manual steering. After a long shift of walking behind a treatment device, the operator is bound to become fatigued, wherein his or her attention will deviate from the task at hand, possibly resulting in uneven treatment to the floored area. Thus, a subsequent crew may have to return and retouch certain areas not accurately treated during the first operation. Human errors related to the time a surface is exposed to a brush, may occur when the operator lingers over a single area for extended period of time. This situation is never good for a floor surface. The devices in the art are also difficult to maneuver and often are not adapted to operate around tight corners, wherein pre or post cleaning operations must be performed, thus increasing the time and expense of the entire task.

As known in the art, floor cleaning apparatus are comprised of a chassis supported by a plurality of wheels, one of which is steerable to control the path of the machine. The chassis also accommodates a cleaning assembly, such as a brush, a sweeper, a squeegee, a burnisher, etc. The chassis also supports tanks used to hold water, cleaning fluids, and spent cleaning fluids suctioned from the surface being cleaned. Floor cleaning apparatus also often possess a receptacle or bag for holding collected dust and debris. The majority of the components associated with the cleaning machine are surrounded by at least one housing that protects the internal components from the environment and prevents individuals working around the machine from touching the often hot internal components. As floor cleaning apparatus are sometimes used in tight spaces, such as bathrooms and hallways, it is often desirable to make floor cleaning apparatus as compact as possible.

It is also desirable to provide floor cleaning machines that allow for easy access to internal componentry for maintenance and repair. The desire for easy access is often at odds with the desire to provide a compact apparatus. Prior art machines are constructed so the internal volume is minimized, providing a compact machine, but leaving virtually no easy access to internal componentry. To address this disadvantage, some prior art machines utilize removable segments to the housing that cover internal components. Often, however, external components, such as steering wheels, control panels, external storage tanks, etc., must be removed prior to removal of these housing segments. Removal of the external componentry and the housing segments technology is time consuming, costly, and increases the chance that the machine will be damaged or a component of the machine will be lost.

Some known floor cleaning apparatus also employ a rotating sweeper broom ("sweeper") to lift debris from a floor. Generally, a cylindrical sweeper rotates about an axis parallel to the floor and which may be located between front and rear wheels of the apparatus. Floor cleaning apparatus also typically include a vacuum system that establishes a directional airstream adjacent to the broom to direct debris into a hopper where heavier debris is precipitated from the airstream. Lighter debris, especially dust, is then typically directed to a vacuum bag.

To enhance the suctioning effect provided by the vacuum, the sweeper may be in a housing situated between the front and rear wheels. The housing typically includes one or more flaps or seals that surround the sweeper that defines a skirt with a lower edge that contacts the floor. The flaps or seals are flexible or hinged to the chassis to allow debris to enter the assembly and be swept up by the sweeper. The flaps or seals also prevent the sweeper from throwing debris and dust as it rotates.

Some other floor cleaning apparatus treat the floor with a cleaning solution with at least one scrubber brush. In some apparatus, the cleaning solution is deposited onto the floor and a pair of rotating disk brushes are used to scrub the floor. Wastewater, which includes entrained debris, is then typically suctioned by a vacuum squeegee located behind or adjacent to the brushes.

One example of a floor cleaning apparatus is disclosed in U.S. Pat. No. 5,093,955 to Blehert et al. ("Blehert I")

entitled "Combined Sweeper and Scrubber." Blehert I discloses a floor cleaning apparatus that can be set either to a sweeper mode or a scrubbing mode. Blehert I provides a single cylindrical rotary brush, a brush housing mounted on a frame, a solution tank and a removable debris hopper. When in the sweeping mode, a vacuum operating with an air circuit draws air from around the brush and through a filter. When in a scrubbing mode, the vacuum operates to recover dirty scrubbing solution from the rear of the apparatus through a squeegee located aft of the brush.

U.S. Pat. No. 6,041,471 to Charky et al. ("Charky") entitled "Mobile Walk-Behind Sweeper" discloses a mobile sweeper for cleaning dust and collecting garbage from surfaces. Charky employs a plurality of brushes that direct dust to a collection point where a vacuum blower suctions the debris into a collection container.

U.S. Pat. No. 4,819,676 to Blehert et al. ("Blehert II") entitled "Combination Sweeping and Scrubbing System and Method," discloses an apparatus that comprises a sweeping assembly that can be converted into a scrubbing unit and vice versa. The sweeping assembly includes a removable hopper. Cylindrical brushes are also provided that operate in either the sweeping or scrubbing mode.

U.S. Pat. No. 4,580,313 to Blehert ("Blehert III") entitled "Walk Behind Floor Maintenance Machine" discloses a floor treatment apparatus that has a plurality of wheels, a removal hopper, and a rotatable brush. A removable filter housing is also contemplated and has a prismatic shape. The design of the filter housing is such that a means for vibrating the filter is needed to dislodge particles. The cylindrical brushes of Blehert III are not enclosed within the housing.

Thus it is a long felt need to provide a floor treatment apparatus that employs one or more of the inventions set forth herein.

SUMMARY OF THE INVENTION

It is one aspect of the present invention to provide a floor treatment apparatus that is easy to maneuver. More specifically, one embodiment of the present invention is constructed of a chassis section that includes an enclosure that houses at least a portion of the internal components of the treatment device and a location for installation of devices used during cleaning operations. One embodiment of the present invention provides a standing, leaning or sitting location for the operator. Another embodiment of the present invention is equipped with a powered steering device that allows for greater maneuverability in areas with tight corners, ensuring that more flooring surface is treated without having to perform pre- or post-treatment operations. More specifically, one embodiment of the present invention is equipped with a self-propelled wheel and an easy to use steering device to provide increased maneuverability around obstacles. One embodiment of the present invention employs at least one wheel that provides thrust and/or steering capability. Yet another embodiment of the present invention employs wheels that are substantially centered under the chassis such that the entire apparatus is generally capable of 360° rotation without substantially traversing in any other direction, thus allowing it to treat tight corners of a surface. It is another aspect of the present invention to provide a cleaning apparatus that is cost effective to manufacture. Various aspects of the invention shall now be described in more detail.

Chassis/Housing

The floor treatment apparatus includes a housing that protects and houses the internal workings of the apparatus. The housing is supported by a chassis that also provides a location for interconnection of auxiliary treatment devices used to treat a floor. One embodiment of the present invention employs a housing constructed of rigid plastic, metal, or other common materials used in the art. The chassis of this embodiment also supports an operator platform. Alternative embodiments of the present invention employ a foldable, removable or stationary operator seat supported by the chassis. Other safety features such as pads or safety belts may be employed, which makes the working environment safer and more comfortable.

It is yet another aspect of the present invention is a floor treatment apparatus that provides a housing and chassis with a small envelope. More specifically, one embodiment of the present invention is small enough to fit into and through tight spaces. Often facilities that employ the apparatus of the present invention include narrow doorways, aisles, and elevators. Further, some older buildings retrofitted to comply with the Americans with Disabilities Act have elevators of minimal volume and lifting capability. To fit into small elevators, the housing and chassis is designed to have the smallest practical envelope, a distinct advantage over the prior art. Also, the apparatus of one embodiment of the present invention includes components that are easily removable or adjustable to reduce the profile of the apparatus. The embodiments of the present invention may be used in various structures.

The housing of one embodiment houses a fluid pump assembly and a vacuum assembly. The housing also may conceal at least two tanks, one for retaining a base cleaning fluid, such as water, and a second for retaining spent cleaning solution, dry debris, etc. The apparatus may also include one or more concentrated cleaning chemical receptacles designed to hold concentrated cleaning chemicals. The receptacles are preferably stored within a lockable housing, adding safety to the overall apparatus. These agents can be added to a base cleaning fluid just prior to application to a surface and as desired to facilitate cleaning of various surfaces.

Indeed, the internal components of the floor cleaning machine, such as pumps, vacuums, storage tanks, tubes, electrical hardware, batteries, etc. can all be stored within a housing of some embodiments, which generally defines the outer envelope of the floor cleaning device. The housing can direct cooling air around certain components of the floor cleaning device, protects individuals from gaining accidental access to hazardous areas of the floor cleaning device and protects internal components of the floor cleaning device from environmental damage. In one embodiment of the present invention, the housing may be comprised of a primary housing directly interconnected to the chassis. The primary housing may have a plurality of removable segments that allow selective access to the interior of the floor cleaning device or may be of one piece construction that surrounds all internal components of the floor cleaning machine. The primary housing may be removable from the chassis in many ways known in the art. A front housing may be rotatably interconnected to at least one of the primary housing or the chassis and is capable of transitioning away from the primary housing or chassis to allow access to internal components covered thereby, both from above and from the front of the floor cleaning machine. Finally, a rear housing may be provided that may also be rotatably interconnected to the chassis and/or primary housing. The housing segment may also be selectively rotatable from the primary housing to allow access to internal components covered thereby, both from the rear and top of the floor cleaning machine. The front housing of one embodiment of the present invention accommodates various controls associated with the floor cleaning machine. These controls may indicate the cleaning and spent fluid in the tanks, control power, battery life, etc.

The rear housing of one embodiment of the present invention may accommodate a tank that stores at least one of clean water or waste water. In one embodiment, the tank is capped prior to rotating it away from the primary housing to avoid spillage of the tank contents. One advantage of some embodiments of the present invention described, is that a compact floor cleaning machine is provided that allows for easy and selective access to internal components of the machine without having to remove the machine housing, a timely and costly process.

Steering Mechanism

Another aspect of the present invention is to provide a floor treatment apparatus that is easy to operate and maneuver. More specifically, one embodiment of the present invention is equipped with a steering mechanism that allows for inputs from the operator to be efficiently communicated to the steering wheels of the floor treatment apparatus. Alternatively, other steering means may facilitate maneuverability of the treatment apparatus, such as joy sticks, touch screens, buttons, remote control elements, etc.

It is still yet another aspect of the present invention to provide a floor treatment apparatus adapted to efficiently clean areas with tight corners. More specifically, one embodiment of the present invention is adapted to generally perform 360° turns without appreciable lateral motion. This embodiment of the present invention is equipped with a turning mechanism generally under the center of the chassis with two powered exterior wheels adjacent thereto that provide power to the chassis to pivot around the centered wheel. The powered exterior wheels may be independently controlled by joy sticks, wherein movement thereof sends directional inputs to each wheel. One embodiment of the invention is equipped with at least one joy stick wherein forward deflection will impart forward motion, rearward deflection will impart rearward motion, and a side-to-side deflection will cause the apparatus to turn. Alternatively, two joy sticks may be used in a similar manner, wherein rearward deflection of the left joy stick and forward deflection of the right joy stick will cause a left turn, and depending on the placement of the powered wheels, perhaps a 360° left hand turn.

Another embodiment of the present invention utilizes a steering wheel, handle bars, a yoke, or similar apparatus for steering. Embodiments may also include a power-assisted steering mechanism.

The steering shaft of one embodiment of the present invention can also move as the housing rotates without requiring disconnection from the steering mechanism or removal of the steering wheel. The shaft of one embodiment includes a stationary rigid portion that is slidably interconnected to a flexible portion that selectively slides over the rigid portion and flexes when the front housing is rotated away from the primary housing. In other embodiments, the shaft flexibility alone is enough to provide for needed housing rotation. More specifically, in order to also accommodate the movement of the shaft, a slip fitting is preferably interconnected to the flexible portion to allow the steering shaft to separate from the chassis, by sliding over the rigid portion, while remaining interconnected to the steering mechanism.

Power Plant

It is another aspect of the present invention to provide a floor treatment apparatus powered by commonly used power plants. More specifically, one embodiment of the present invention employs an electric motor to power the apparatus. The electric motor may be powered by batteries, solar energy or an electrical cord attached to a permanent power source. Alternatively, the present invention may be powered by an internal combustion engine. Other propulsion means may also be employed by the present invention without departing from its scope, as appreciated by one skilled in the art.

Tanks

As briefly mentioned above, preferably at least one tank is provided that provides a solution directed towards the flooring surface to be cleaned to facilitate treatment. The tank may be constructed with multiple compartments wherein waste water from the surface is contained prior to disposal. More specifically, one embodiment of the present invention employs a tank that includes a movable membrane. In this configuration, the clean water and/or cleaning solution is deposited on a surface and agitated. Dirty water is next suctioned up and deposited back into a portion of the tank, thereby moving a membrane accordingly to accept the dirty water. Such a configuration is disclosed in U.S. Pat. No. 4,759,094, which is incorporated in its entirety herein by this reference. A similar selectively expandable fluid storage area can be created by utilizing a collapsible structure, which is placed inside of the primary fluid tank. This type of arrangement is disclosed in U.S. Pat. No. 4,196,492, which is also incorporated herein in its entirety by this reference.

Clean water can come from an outside source such as a hose, rather than be stored on board the device. However, to facilitate maneuverability and usability of the present invention, it is envisioned that the chassis will house or hold at least one fluid tank and perhaps a plurality thereof.

Cleaning Solutions

In one type of floor treatment apparatus, fluid from a chemical receptacles flows through a tube to a chemical selector, which may include a metering valve. The selector preferably has a positive shut-off position, wherein fluid is prevented from flowing through the selector regardless of the fluid pressure in a fluid line. The selector responds to input from an operator selection of one of the several cleaning chemicals. Once a chemical is selected, it may flow through the chemical selector and appropriate amounts thereof may be provided to one of many inlets to a mixing tee. The chemical allowed to flow may be adjusted by a metering valve built into the selector or separate from the selector, in a known fashion. A base cleaning fluid, such as water, may flow from a fluid tank and through a separate tube to a second leg of a mixing tee. The cleaning fluid and concentrated cleaning chemical are then mixed within the mixing tee to create a cleaning solution. That solution may then be passed through the selector outlet to a pressure pump, wherein the cleaning solution may be pressurized and communicated via appropriate tubing to a dispensing device. The pump, which draws fluid to and through the selector, also preferably includes a bypass system to facilitate regulation of pump pressure. Use of the pump to draw fluid is preferred as it does not create unwanted pressures in the fluid lines and the system, in general, is not subject to gravity feeding of fluid.

A solution may be applied to a surface using any type of dispensing device. In a preferred embodiment, the dispensing device or associated solution lines or tubes include an adjustable valve, which may adjust the pressure and flow of solution allowed to exit the dispensing device. Because of the adjustability, the apparatus may be utilized as a pre-cleaner for various carpet treatments, including spotting or other treatments.

By use of the chemical selector, two or more receptacles of floor treatment chemicals may be fluidly connected to a mixing tee. In operation, a user can create many cleaning solutions without the need for adding receptacles or switching chemical feed lines from one receptacle to another or without changing metering tips that are easily misplaced, incorrectly interconnected, or damaged. The treatment process is safer because there is less chemical handling. Similarly, use of a metering valve will allow the operator to create a very precise floor treatment solution.

It is preferred that one-way check valves be used throughout the apparatus. For instance, check valves may be included in: delivery lines that supply cleaning chemicals to the metering tee; lines that supply water to the metering tee; lines that supply cleaning solution to the pump; lines that supply cleaning solution to the spray gun; or in the metering tee, itself. The check valves prevent reversal of fluid and prevent contamination of one fluid with another.

Blower

The floor treatment apparatus also may include a modular blower assembly. The blower assembly may be hand-held and operate completely apart from the overall floor cleaning machine. The blower assembly may dry areas physically separate from where the apparatus is stored. Because the blower assembly possibly is separate from the apparatus, it may also be used for other blowing functions, such as blowing leaves, grass, dirt or other debris. The blower assembly may be used with a detachable hand nozzle, a flexible nozzle, an extension wand, etc., thereby increasing the overall flexibility of the blower assembly. The blower assembly may utilize an integrated on/off switch and be powered by electricity supplied by any typical extension cord, including the power source of the apparatus. The blower may be configured to be stored on the apparatus in one of many convenient ways. It will be appreciated by one skilled in the art that having a modular blower assembly is very beneficial to the overall functionality of a multifunctional floor treatment apparatus.

Storage

Another aspect of one embodiment of the present invention is that the chassis includes bins, trays, bays and other storage devices preferably within easy reach of the operator. The storage devices provide the operator with substantial flexibility when cleaning a large building or area that has many types of surfaces that may need treatment. Also, the apparatus provides for modular trash/supply bins that may be added to or removed from the apparatus quickly and easily so the machine can be configured for one of many floor treatment activities.

Primary Pump

It is yet another aspect of the present invention to provide a floor treatment apparatus equipped with a secondary fluid pump that supplies fluid to the main fluid pump prior to ignition. More specifically, one embodiment of the present invention includes a secondary, or priming pump, which is activated prior to the activation of the main fluid pump. Often it is desirable to introduce fluid into a main fluid pump prior to that pump's activation, expelling trapped air that may cause damage to the main fluid pump motor from vapor lock or cavitation, for example. This priming process may be conducted manually, but that is time consuming, wherein the user manually adds fluid to the pump or bleeds the air therefrom. Alternatively, and preferably, one embodiment of the present invention is equipped with a secondary pump activated for a brief moment when the fluid discharge apparatus is initially activated ensuring the main fluid pump will be substantially free of trapped air upon activation.

Squeegee

It is another aspect of the present invention to provide a floor treatment apparatus that includes a squeegee adjacent to the floor cleaning machine, both generally in the middle of the machine. The squeegee swings, or follows the path of the floor and does not rely on unvacuumized side squeegees to channel water to the main vacuumized squeegee. Thus, it offers as good or better fluid pick-up when the apparatus is turning than is capable with a walk behind scrubber, and far superior than typical small riders since it does not rely on smearing side squeegees. One embodiment of the present invention, employs a squeegee that pivots about the steering axis with a linkage supported by a roller and track mechanism. The absence of side squeegees mean less drag and better use of available energy. In addition, some embodiments of the present invention include an adjustable squeegee, a skirt or a shroud that minimally contacts the floor, thus reducing drag and sparing battery charge. Alternatively, some embodiments of the present invention include stops that contact the floor, without marring the same.

Various aspects of the inventions discussed briefly above combine to provide an effective and efficient tool, useful in the treatment of numerous areas in and around commercial, industrial, institutional and public buildings. Moreover, due to the aspects of the present invention, a sanitation maintenance worker may clean a room or facility more efficiently than previously possible. The present invention may be used in various cleaning operations such as burnishing, vacuuming, scrubbing, sanding, waxing, sweeping, sealing, painting, polishing, etc. To accomplish these tasks, embodiments of the floor treatment apparatus of the present invention may be equipped with various combinations of floor treatment devices or apparatus. More specifically, one embodiment of the present invention is equipped with a plurality of brushes and squeegees to agitate and collect debris from a flooring surface. Suction mechanisms may be employed such that fluids and/or dry particulate matter are transferred into a container. It is also envisioned that one embodiment of the present invention includes at least one solution applicator positioned adjacent to the scrub brushes, wherein solution is injected onto the surface after, or prior to, agitation by the brushes. The debris-entrained solution is then collected by the squeegee and subsequently vacuumed into the holding tank or expelled out of the chassis to an outside reservoir. The brushes and/or solution used in this embodiment may be adapted to clean, sweep, paint, burnish, sand, strip, varnish or wax a floor. It will be appreciated by one skilled in the art that any type of solution adapted to treat any flooring surface may be employed without departing from the scope of the present invention.

It is yet another aspect of the present invention to provide a floor treatment apparatus that can be used in various floor maintenance operations. More specifically, one embodiment of the present invention is adapted for interconnection to a plurality of devices to perform a variety of floor treatment operations. It is envisioned that one embodiment of the present invention be capable of quick removal of certain treatment devices such that different devices may be then added to quickly change the scope of the apparatus, providing a device adapted to scrub, clean carpets, wax floors, burnish floors, remove wax or varnish from floors, vacuum, etc. Thus, it is contemplated, that this system may be used for a plurality of cleaning or floor treatment operations.

Remote Control

It is yet another aspect of the present invention to provide a highly mobile floor treatment apparatus that can include a car washer assembly. As appreciated by those skilled in the art, if so configured, the device could include a car washer wand connected to appropriate pumps and could be utilized to pre-clean heavily soiled areas before final cleaning with the device.

It is still another aspect of the present invention to provide a floor treatment apparatus that does not require direct contact with an operator to perform its tasks. More specifically, one embodiment of the present invention is adapted to be remote controlled. This embodiment of the present invention is equipped with remote control mechanisms and software known in the art, such as taught by U.S. Pat. No. 6,625,843 to Kim et al., which is incorporated in its entirety herein. In addition, this embodiment of the present invention may be equipped with the plurality of cameras such that offsite monitoring and control may be performed. In a related embodiment of the present invention, software is installed in the floor treatment apparatus such that human contact or monitoring is not required. More specifically, one embodiment of the present invention is adapted to learn its environment as it operates in an area such that remote controlling is not required. Alternatively, it is well within the scope of this invention to preprogram the dimension of floored surfaces into the smart treatment device, wherein the device is parameterized with the surface dimensions before the task is initiated. Apparatus are known in the art, such as the Roomba™ device by iRobot Corporation, aspects of which are described in U.S. Pat. Nos. 6,594,844 and 6,535,793, which are both incorporated in their entirety herein.

Safety

It is another aspect of the present invention to provide a floor treatment apparatus that is safe and comfortable to use. More specifically, one embodiment of the present invention includes an operator platform. This platform allows the operator to stand on the machine during the treatment operation, thus increasing productivity and lowering the chances of injury or fatigue to the operator. In another embodiment of the present invention, a seat is provided wherein the operator may comfortably sit while completing his or her task. Other safety and comfort features such as rails, pads, and belts, may be provided depending on the needs of the operator.

Scrubber/Sweeper Assembly

It is another aspect of the present invention to provide a floor treatment apparatus that employs a scrubber and sweeper assembly ("cleaning assembly"). The cleaning assembly includes a front brush and a rear brush partially enclosed by a housing that, with the aid of a vacuum motor, directs air between the front brush and the second brush and into a hopper. The suction provided by the vacuum motor directs particle- and debris-laden air into the hopper wherein smaller particles are suctioned directly into a vacuum bag. The vacuum pressure provided by the vacuum motor is maintained by a seal or flap associated with the undercarriage of the apparatus. The hopper of one embodiment of the present invention also includes a screen that captures larger particles while allowing dust and smaller particles to pass therethrough to be suctioned into the vacuum bag. The hopper is removable, which allows the user to clear the larger particles from the apparatus.

It is, thus, another aspect of the present invention to provide an apparatus capable of cleaning small particles and large particles. More specifically, the front brush and the rear brush are located under the brush housing. The rear brush is also located near a curved rear wall of the hopper. This configuration allows air and debris to enter the front portion of the cleaning assembly, flow between the rotating brushes, flow behind the curved wall, and flow into the hopper. As one skilled in the art will appreciate, this configuration allows for the capture of particles of various sizes, from the small, i.e., dust, to larger particles of about 0.75 inches. Larger particles of 8 to 10 inches of length may be captured by some embodiments of the present invention. In one embodiment of the present invention, the brushes are cylindrical and rotate about a longitudinal axis parallel to the floor. As mentioned above, a flap or seals may be positioned about the brushes to seal the housing, which enhances suction pressure and facilitates the airflow described above. The flaps may be made of any material, but are preferably made of a compliant material, such as rubber. In one embodiment of the present invention, the rearward flap also functions as a squeegee.

Removable Debris Tray

It is another aspect of the present invention to provide a debris tray that also employs a screen that captures larger items. More specifically, the removable debris tray of the hopper of one embodiment of the present invention is tapered wherein a lowermost portion is associated with a vacuum hose associated with the vacuum bag. The hopper also includes a screen that is positioned above the debris tray such that debris-laden air passes through the screen and into the tray, where larger debris will be trapped by the screen and prevented from entering the vacuum hose. As is well known in the art, the smaller debris will be deposited into the vacuum bag. The debris tray is removable, which allows the larger particles to be cleared from the cleaning assembly periodically. The screen prevents jamming of the vacuum hose, which is an advantage over prior art apparatus that did not capture larger debris or that captured larger debris only to inadvertently suck them into the vacuum system, which could damage the vacuum hose, vacuum motor or other components of the system.

Receptacle Hose

It is yet another aspect of the present invention to provide an apparatus that has a retractable attachment hose. More specifically, one embodiment of the present invention includes an auxiliary vacuum hose interconnected to the vacuum bag by way of a valve. In normal operations, vacuum pressure provided by the vacuum motor suctions debris pulled by the cleaning apparatus. Alternatively, when the attachment hose is employed, the valve closes the vacuum hose associated with the cleaning apparatus and provides vacuum pressure to the attachment hose. The attachment hose may be associated with a hose roller that maintains the curvature of the hose to prevent kinking and the associated airflow reduction. Furthermore, some embodiments of the present invention provide a hose with bellows or other elongation mechanisms. In one embodiment of the present invention, the hose roller is actuated when the operator switches the apparatus to the primary floor cleaning mode.

It is thus another aspect of embodiments of the present invention to provide a floor treatment apparatus comprising: a chassis having a front surface, a rear surface, a left surface, a right surface and a lower surface, the chassis supporting a clean fluid tank, a spent fluid tank, an electric drive motor associated with a drive wheel and a plurality of batteries associated with the electric drive motor, and a vacuum motor; wherein the vacuum motor is operably connected to the one or more of the batteries and is part of a vacuum assembly comprising at least one hose running from the vacuum assembly to a member associated with a squeegee, and a second hose running from the vacuum assembly to the spent fluid tank; a first wheel operably interconnected to the lower surface adjacent to the left surface and located closer to the rear surface than the front surface; a second wheel operably interconnected to the lower surface adjacent the right surface and located closer to the rear surface than the front surface; wherein the first wheel and the second wheel are not interconnected; wherein the drive wheel is operably interconnected to the lower surface and located closer to the front surface than the rear surface; a multi-part housing comprising a primary housing, a front housing portion, and a rear housing portion, the multi-part housing having a plurality of hand holds are formed integral with the multi-part housing; wherein at least the primary housing portion is associated with the chassis; a steering wheel operably interconnected by a shaft to an assembly associated with the drive wheel wherein the steering wheel is associated with the front housing portion that hingedly rotates relative to the primary housing, the front housing portion includes a control panel, and the steering wheel maintaining a static position relative to the control panel when the front housing portion is rotated away from the primary housing; wherein the rear housing portion is located adjacent the chassis rear surface and is substantially connected to at least one of the primary housing and the chassis by one or more hinge members such that the rear housing portion hingedly rotates relative to the primary housing about an axis parallel to an axis extending between a center of the first wheel and a center of the second wheel, and one or more of the hinge members are connected closer to the chassis lower surface than to a top portion of the primary housing portion; wherein the spent fluid tank is fixedly connected to the rear housing portion and rotates with the rear housing portion; a platform which is substantially associated with the rear housing portion and located substantially between at least a portion of the right surface of one of the chassis or the multi-part housing and at least a portion of the left surface of one of the chassis or the multi-part housing and extending from at least a portion of the rear surface of one of the chassis or the multi-part housing, wherein a portion of the platform is positioned substantially adjacent to the axis extending between the center of the first wheel and the center of the second wheel and at least a portion of the platform penetrates a three-dimensional cylindrical volume that is defined by an outer surface of the first wheel and the second wheel, and the platform includes at least one of a left sidewall, a right sidewall, and a back wall that extend above a surface that receives an operator's feet; wherein the platform includes a switch in operable communication with a hand operated speed range switch and the electric drive motor, the switch operable to control locomotion of the apparatus within a selected speed range, and an operator presence device which is operatively connected to and which selectively interrupts operation of the switch; a brake which is operative to perform a braking function when the switch is disengaged; a scrub brush, wherein the scrub brush and the squeegee are operably connected to and located substantially adjacent to the lower surface of the chassis; and wherein the apparatus rotates 360 degrees without substantially moving in other directions.

It is another aspect of embodiments of the present invention to provide a floor treatment apparatus comprising: a multi-part enclosure comprising a primary enclosure, a front enclosure portion, and a rear enclosure portion, the multi-part enclosure having front surface, a rear surface, an upper surface, a lower surface, a left surface, and a right surface; a first wheel operably interconnected to the lower surface adjacent to the left surface and located closer to the rear surface than the front surface; a second wheel operably interconnected to the lower surface adjacent the right surface and located closer to the rear surface than the front surface; a platform located closer to the lower surface than the upper surface and substantially between at least a portion of the right surface and at least a portion of the left surface, and extending from a portion of the rear surface, wherein a portion of the platform is positioned substantially adjacent to an axis extending between a center of the first wheel and a center of the second wheel; a floor treatment assembly operably connected to the lower surface of the enclosure; a power source positioned substantially within the enclosure; an electric monowheel drive motor associated with the power source; a third wheel associated with the electric monowheel drive motor and operably connected adjacent the lower surface of the enclosure; a steering mechanism associated with the third wheel; a steering wheel operably interconnected by a shaft to the steering mechanism wherein the steering wheel is associated with the front enclosure portion that hingedly rotates relative to the primary enclosure, the front enclosure portion includes a control panel, and the steering wheel maintaining a static position relative to the control panel when the front enclosure portion is rotated away from the primary enclosure; and wherein the rear enclosure portion is capable of selective rotation about an axis parallel to the axis extending between the center of the first wheel and the center of the second wheel.

It is yet another aspect of embodiments of the present invention to provide a floor treatment apparatus comprising: a multi-part housing comprising a primary housing, a front housing portion, and a rear housing portion, the multi-part housing having front surface, a rear surface, an upper surface, a lower surface, a left surface, and a right surface; a first wheel operably interconnected to the lower surface adjacent to the left surface and located closer to the rear surface than the front surface; a second wheel operably interconnected to the lower surface adjacent the right surface and located closer to the rear surface than the front surface; a platform located closer to the lower surface than the upper surface and substantially between at least a portion of the right surface and at least a portion of the left surface, and extending from a portion of the rear surface, wherein a portion of the platform is positioned substantially proximate to an axis extending between the first wheel and the second wheel; a steering wheel operably interconnected by a shaft to an assembly associated with a drive wheel wherein the steering wheel is associated with the front housing portion that hingedly rotates relative to the primary housing, the front housing portion includes a control panel, and the steering wheel maintaining a static position relative to the control panel when the front housing portion is rotated away from the primary housing; a floor treatment assembly operably connected to a chassis that is associated with the multi-part housing; and wherein the rear housing portion is capable of selective rotation.

It is still yet another aspect of embodiments of the present invention to provide a floor treatment apparatus comprising: a multi-part housing comprising a primary housing, a front housing portion, and a rear housing portion, the multi-part housing having front surface, a rear surface, an upper surface, a lower surface, a left surface, and a right surface; a platform that extends substantially between at least a portion of the right surface, at least a portion of the left surface and at least a portion of the rear surface, the platform having a throttle and an operator presence device operatively connected to and which selectively interrupts operation of the throttle; a third wheel operably connected adjacent the lower surface of the multi-part housing; a steering wheel operably interconnected by a shaft to the steering mechanism wherein the steering wheel is associated with the front housing portion that hingedly rotates relative to the primary housing, the front housing portion includes a control panel, and the steering wheel maintaining a static position relative to the control panel when the front housing portion is rotated away from the primary housing; a floor treating device connected adjacent to the lower surface of the multi-part housing; a debris collection device connected adjacent to the lower surface of the multi-part housing; and wherein the rear housing portion is capable of selective rotation about an axis parallel to the axis extending between the center of the first wheel and the center of the second wheel.

The Summary of the Invention is neither intended nor should it be construed as representing the full extent and scope of the present invention. Moreover, references made to "the present invention" or aspects thereof should be understood to mean certain embodiments of the present invention and should not be construed as limiting all embodiments to a particular description. The present invention is set forth in various levels of detail in the Summary of the Invention, and in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken with the drawings.

BRIEF DESCRIPTION OF THE DRAWINGS

The accompanying drawings, which are incorporated in and constitute a part of the specification, illustrate embodiments of the invention, and together with the general description of the invention given above and the detailed description of the drawings given below, serve to explain the principles of these inventions.

Figure 1:
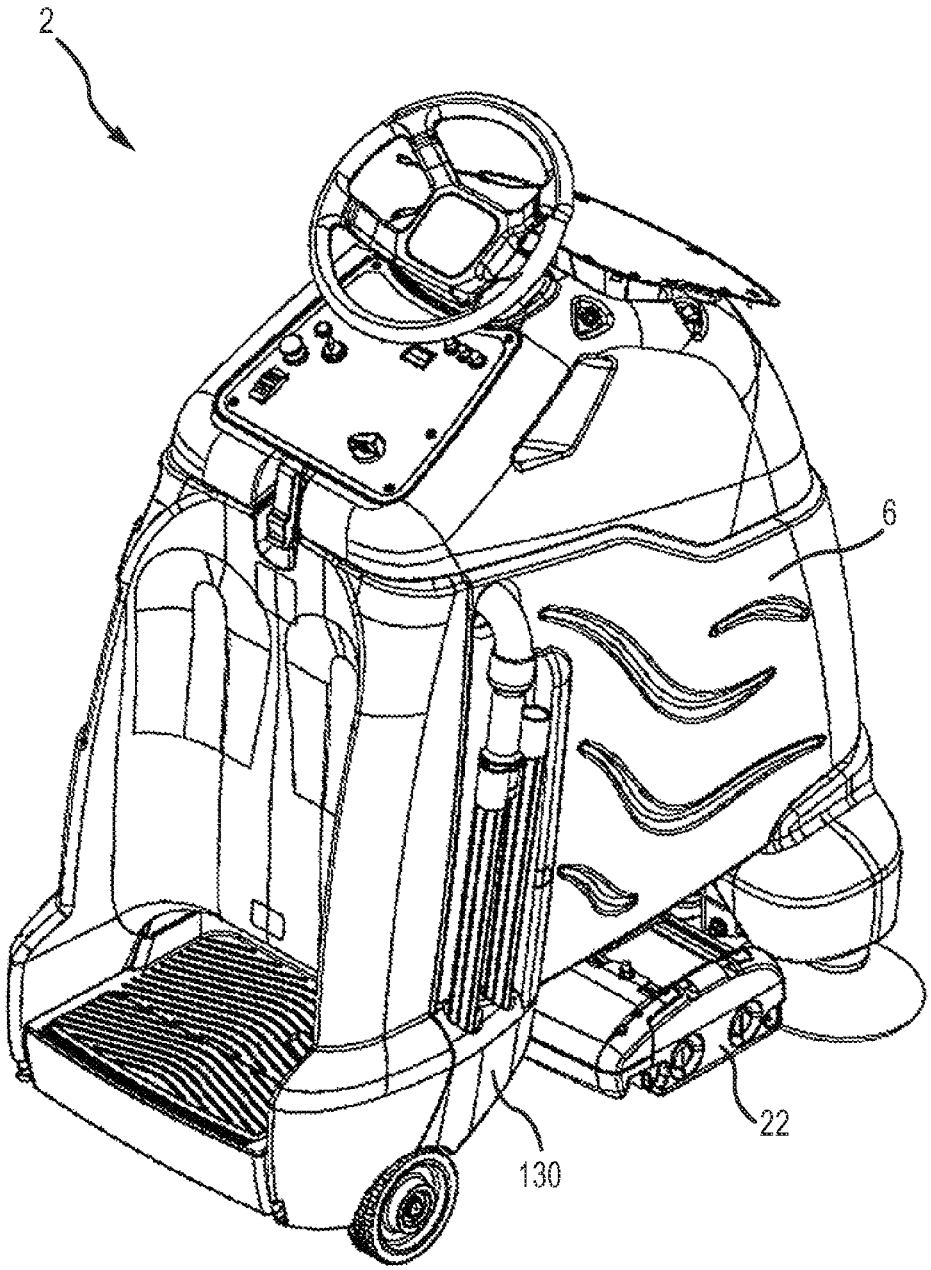
FIG. 1 is a rear perspective view of a floor cleaning apparatus of one embodiment of the present invention.

To assist in the understanding of one embodiment of the present invention the following list of components and associated numbering found in the drawings is provided herein:

| # | Component | FIGS. |
|---|---|---|
| 2 | Floor treatment apparatus | 1-14 |
| 6 | Housing | 1-14 |
| 10 | Vacuum bag | 1-14 |
| 14 | Vacuum motor | 1-14 |
| 18 | Valve | 1-14 |
| 22 | Cleaning assembly | 1-14 |
| 26 | Armature | 1-14 |
| 30 | Accessory hose | 1-14 |
| 34 | Front brush | 1-14 |
| 38 | Rear brush | 1-14 |
| 40 | Motor | 1-14 |
| 42 | Longitudinal axis | 1-14 |
| 46 | Floor | 1-14 |
| 50 | Air path | 1-14 |
| 54 | Opening | 1-14 |
| 58 | Front end | 1-14 |
| 62 | Curved wall | 1-14 |
| 63 | Curved wall | 1-14 |
| 66 | Hopper assembly | 1-14 |
| 70 | Rear wall | 1-14 |
| 74 | Bottom wall | 1-14 |
| 78 | Screen | 1-14 |
| 82 | Fins | 1-14 |
| 86 | Opening | 1-14 |
| 90 | Vacuum hose | 1-14 |
| 94 | Flap | 1-14 |
| 98 | Debris tray | 1-14 |
| 102 | Housing | 1-14 |
| 106 | Brush housing | 1-14 |
| 110 | Opening | 1-14 |
| 114 | Bag hose | 1-14 |
| 118 | Exhaust | 1-14 |
| 119 | Post Filter | 1-14 |
| 122 | Flapper | 1-14 |
| 126 | Hose roller | 1-14 |
| 130 | Capping device | 1-14 |
| 134 | Sealing member | 1-14 |
| 138 | Tab | 1-14 |
| 142 | Spring | 1-14 |
| 202 | Floor cleaning machine | 15-18 |
| 206 | Chassis | 15-18 |
| 210 | Rear wheel | 15-18 |
| 214 | Front wheel | 15-18 |
| 218 | Steering mechanism | 15-18 |
| 222 | Steering shaft | 15-18 |
| 226 | Steering wheel | 15-18 |
| 230 | Cleaning assembly | 15-18 |
| 234 | Front housing | 15-18 |
| 238 | Rear housing | 15-18 |
| 242 | Primary housing | 15-18 |
| 246 | Vacuum motor | 15-18 |
| 250 | Control panel | 15-18 |
| 254 | Front hinge | 15-18 |
| 258 | Rear hinge | 15-18 |
| 262 | Tank | 15-18 |
| 266 | Rigid portion | 15-18 |
| 270 | Slip fitting | 15-18 |
| 274 | Flexible portion | 15-18 |
| 278 | Shaft | 15-18 |
| 302 | Floor treatment apparatus | 19-38 |
| 304 | Platform | 19-38 |
| 306 | Operator | 19-38 |
| 308 | Housing | 19-38 |
| 310 | Bottom surface of housing | 19-38 |
| 312 | Brush | 19-38 |
| 313 | Rotating brush | 19-38 |
| 314 | Scrubber | 19-38 |

-continued

| # | Component | FIGS. |
|---|---|---|
| 316 | Squeegee | 19-38 |
| 318 | Wheel | 19-38 |
| 320 | Steering wheel | 19-38 |
| 322 | Joy stick | 19-38 |
| 324 | Handle Grip | 19-38 |
| 326 | Powered wheel | 19-38 |
| 328 | Burnishing pad | 19-38 |
| 330 | Swinging brush | 19-38 |
| 332 | Wand | 19-38 |
| 334 | Hose | 19-38 |
| 336 | Swing arm | 19-38 |
| 338 | Bearing | 19-38 |
| 340 | Track | 19-38 |
| 342 | Pivot point | 19-38 |
| 344 | Handle | 19-38 |
| 346 | Cam | 19-38 |
| 348 | Strainer basket | 19-38 |
| 349 | Waste storage tank cover | 19-38 |
| 350 | Waste fluid intake | 19-38 |
| 351 | Main waste Storage Tank | 19-38 |
| 352 | Clean fluid intake | 19-38 |
| 354 | Fitting | 19-38 |
| 356 | Flange | 19-38 |
| 358 | Waste fluid bag | 19-38 |
| 360 | Mandrel | 19-38 |
| 362 | Drain hose | 19-38 |
| 364 | Band Clamp | 19-38 |
| 366 | Rear housing | 19-38 |
| 368 | Battery | 19-38 |
| 370 | Tray | 19-38 |
| 372 | Drink holder | 19-38 |
| 374 | Pad | 19-38 |
| 376 | Control panel | 19-38 |
| 377 | Fastener | 19-38 |
| 380 | Operator presence switch | 19-38 |
| 382 | Throttle | 19-38 |
| 384 | Seat | 19-38 |
| 385 | Adjustment Mechanism | 19-38 |
| 386 | Hook | 19-38 |
| 388 | Front cowling | 19-38 |
| 389 | Light | 19-38 |
| 392 | Vacuum fan | 19-38 |
| 394 | Vacuum exhaust channels | 19-38 |
| 396 | Waste H2O return hose | 19-38 |
| 398 | Hose channel | 19-38 |
| 400 | Tip over stops | 19-38 |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
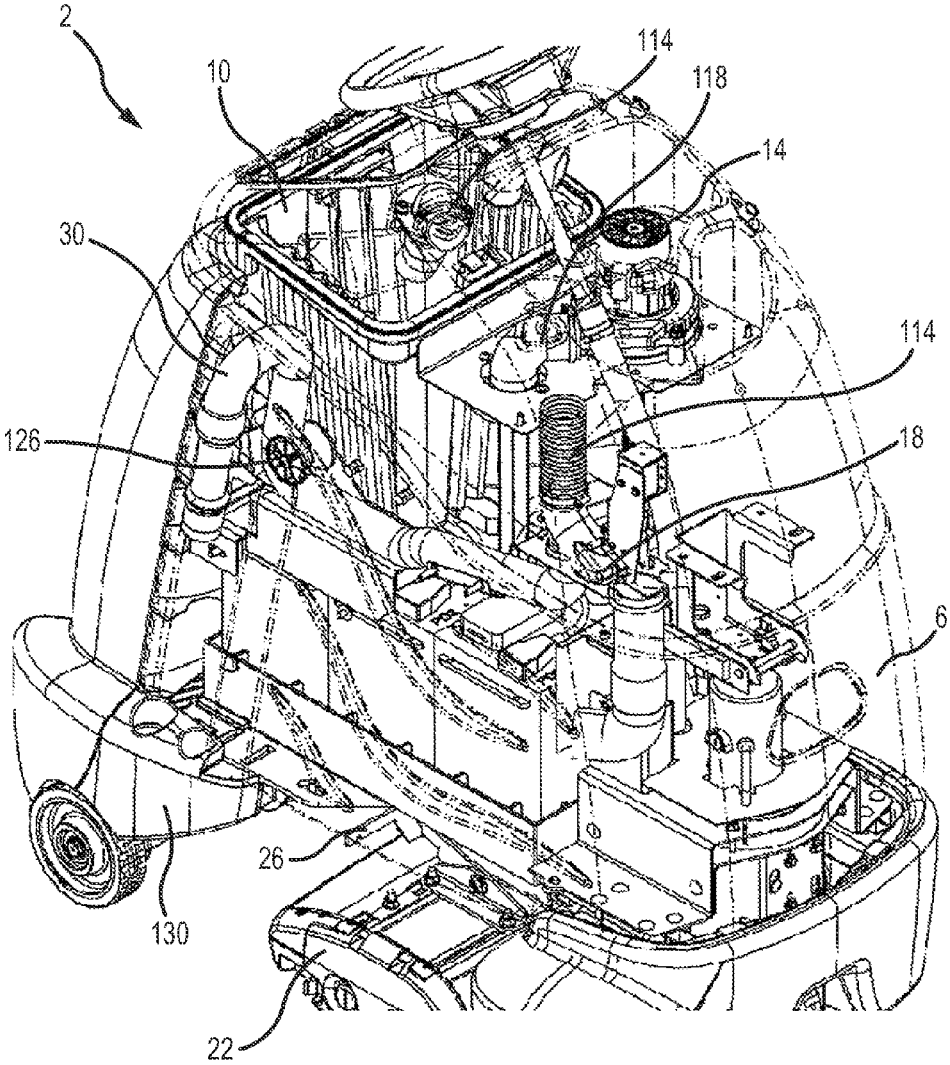
FIG. 2 is a front perspective view of the apparatus of one embodiment of the present invention wherein some components have been removed for clarity.
Figure 3:
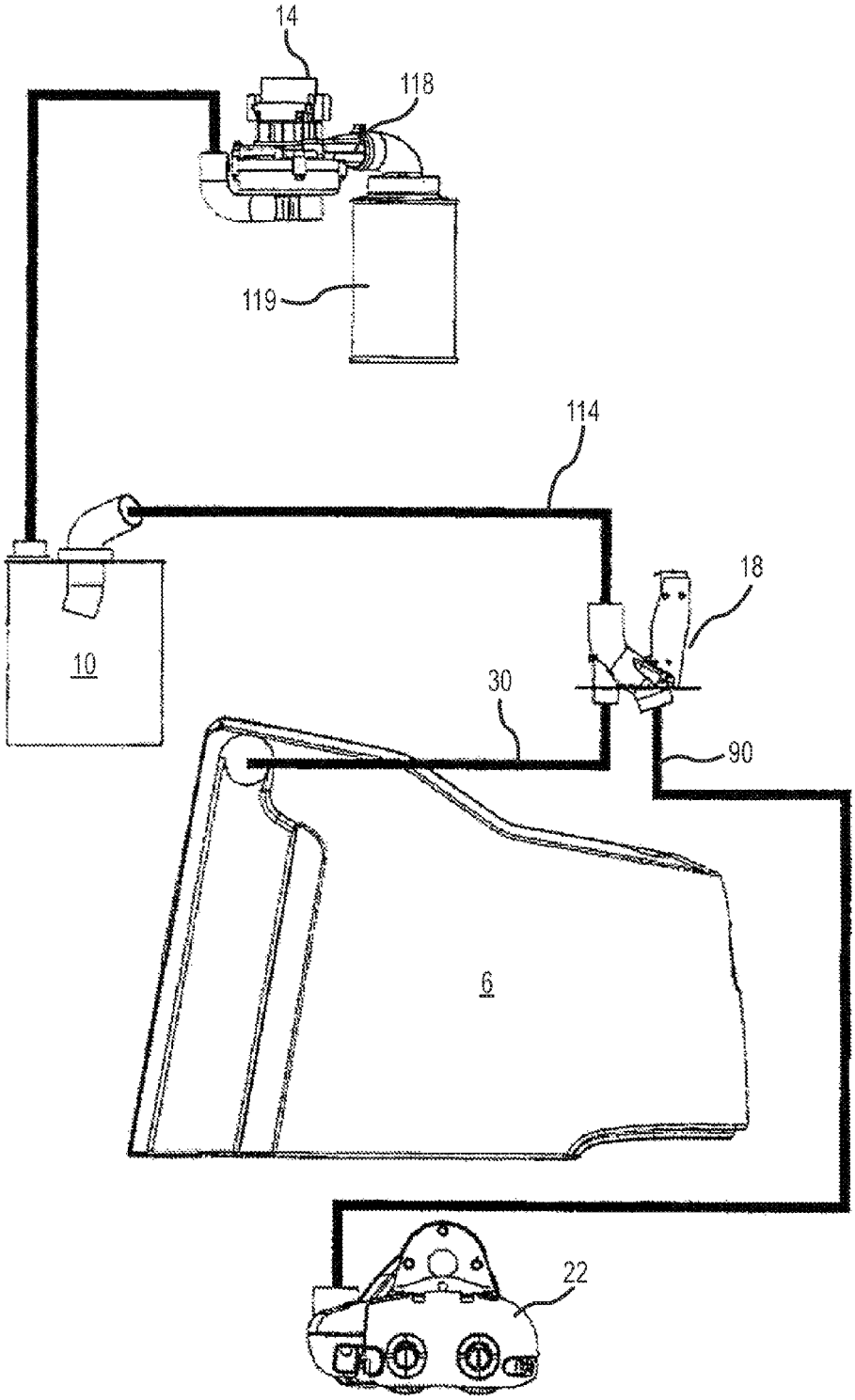
FIG. 3 is a schematic showing some of the major apparatus components of one embodiment of the present invention and their respective interconnections.

FIGS. 1-3 show a floor treatment apparatus 2 ("apparatus") of one embodiment of the present invention that employs a housing 6 that covers a vacuum bag 10, a vacuum motor 14, a valve 18, and other components generally found in floor treatment apparatus. The apparatus 2 employs a cleaning assembly 22 attached to the housing 6 via a spring to an armature 26, which will be further described below. In operation, dirt, debris, and residue are agitated by the cleaning assembly 22 and suctioned into the vacuum bag 10. In a second mode of operation, a hand-held accessory hose 30 is used to suction debris in hard-to-reach places. The debris suctioned through the accessory hose 30 is also directed to the vacuum bag 10 by the vacuum motor 14.

Figure 4:
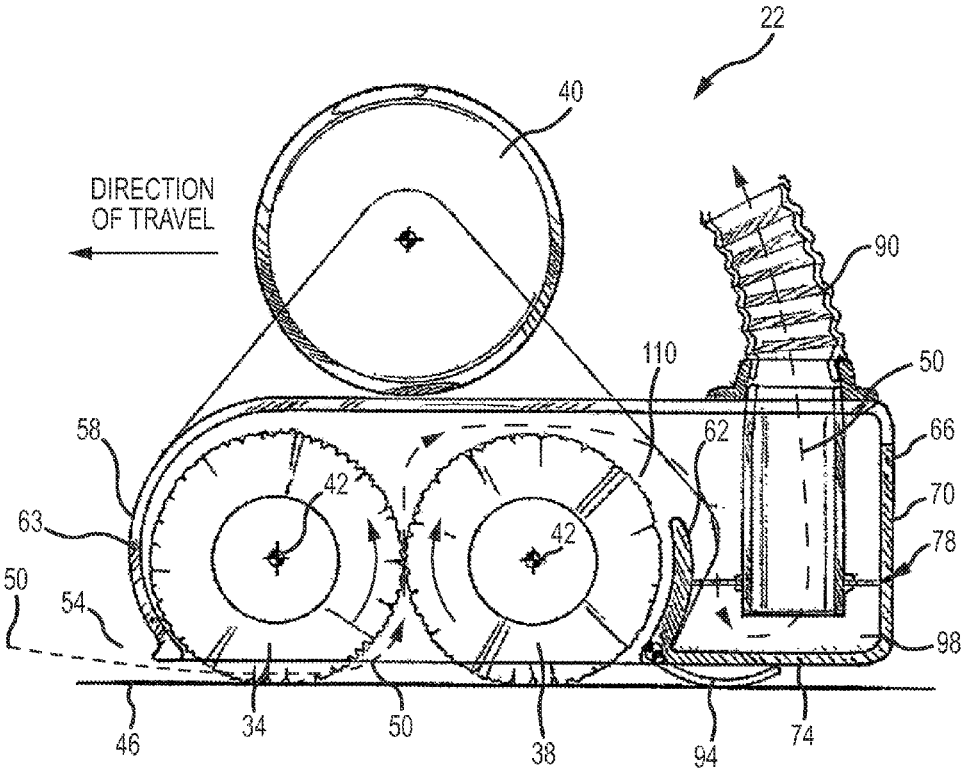
FIG. 4 is a cross-sectional view depicting the general structure of a cleaning assembly employed by some embodiments of the present invention.
Figure 5:
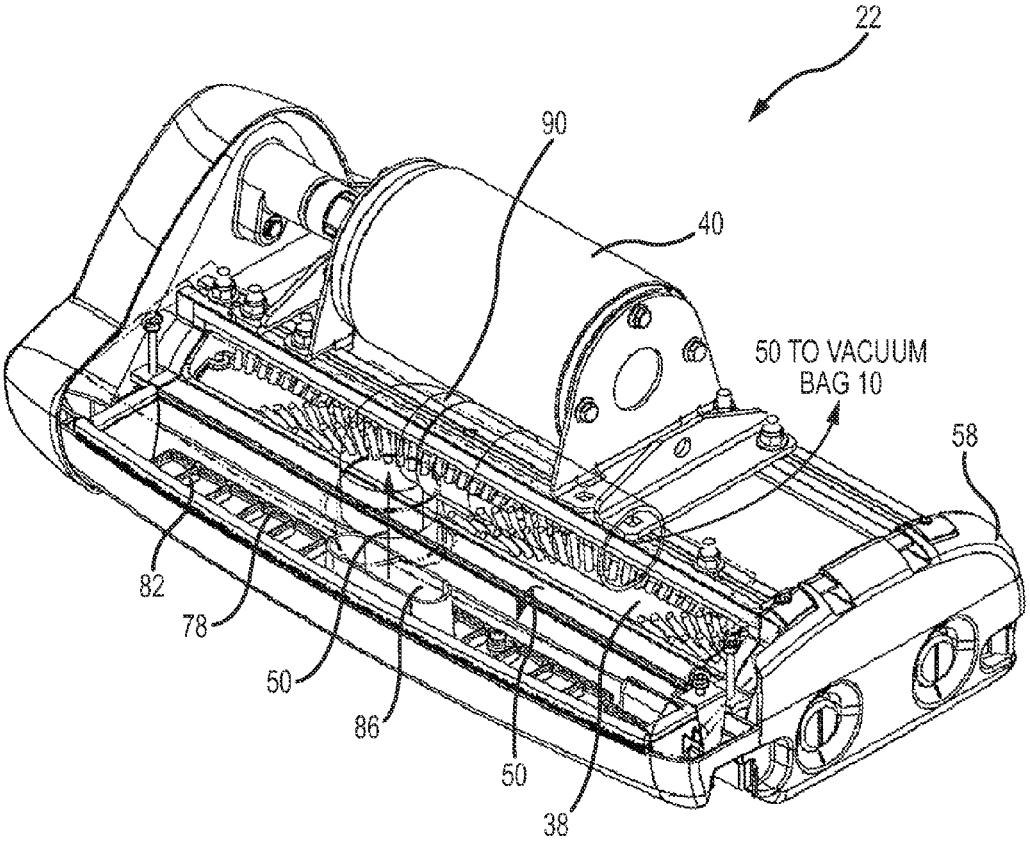
FIG. 5 is a rear perspective view of a cleaning assembly wherein portions have been removed for clarity.

Referring now to FIGS. 4-7, the cleaning assembly 22 employed by some embodiments of the present invention is shown that includes a front brush 34 and a rear brush 38. The front brush 34 and rear brush 38 may comprise a single, cylindrical brush or stacked cylindrical brushes that are rotated by a motor 40 around a longitudinal axes 42 generally parallel to the floor 46 being cleaned. In operation, the front brush 34 preferably rotates counterclockwise (as shown in FIG. 4) and the rear brush 38 preferably rotates clockwise (as shown in FIG. 4). The rotation of the brushes work with suction provided by the vacuum motor to define an air path 50 that moves debris from an opening 54 positioned adjacent to the front end 58 of the cleaning assembly 22, under the front brush 34, between the front brush 34 and the rear brush 38, and behind the rear brush 38. A curved rear wall 62 spaced from the rear brush 38 further defines the air path 50. The rear wall 62 has a larger radius of curvature than the rear brush 38. In one embodiment, the space between the brush and wall increases wherein the space between the rear wall 62 and the rear brush 38 is greatest at the top of the rear wall 62. The top of the rear wall creates an opening 110 into the hopper and is positioned at about the same height as the top of the brush so the brush does not capture debris from the hopper 66. The spacing to the top of the housing (opening size) is about 1 inch. A curved front wall 63 spaced from the front brush 34 also helps to define the air path 50. Similar to the arrangement of the rear brush 38 and the rear wall 62, the front wall 63 has a slightly larger radius than the front brush 34. The front wall 63 is positioned so the space between the front brush 34 and front wall 63 is greatest near the top of the front brush 34, which helps the movement of debris that may become trapped between the brushes and housing 102.

The cleaning assembly 22 also includes a hopper 66 partially comprising a rear wall 70 and a bottom wall 74. Airflow is directed by the brushes around the curved wall 62 into the hopper assembly 66. The hopper assembly 66 includes a screen 78 that allows smaller particles and debris to pass to a center opening 86, but prevents passing larger debris from reaching the opening 86. In one embodiment of the present invention, the screen 78 comprises a plurality of fins 82 angled such that the airflow and carried debris is directed to a center opening 86 of the screen assembly 78 and which is in fluid communication with the vacuum hose 90. To increase vacuum, and in some embodiments to help to provide the air path 50 shown, a flap 94 may be provided around at least three sides of the cleaning assembly 22. FIG. 4 only shows a rear flap 94, one skilled in the art will appreciate that additional side flaps may ensure a sufficient vacuum is created to enhance the contemplated air path 50. The flap 94 is selectively rotatable and able to deflect with respect to the cleaning assembly 22 as the apparatus moves over the floor 46.

Figure 6:
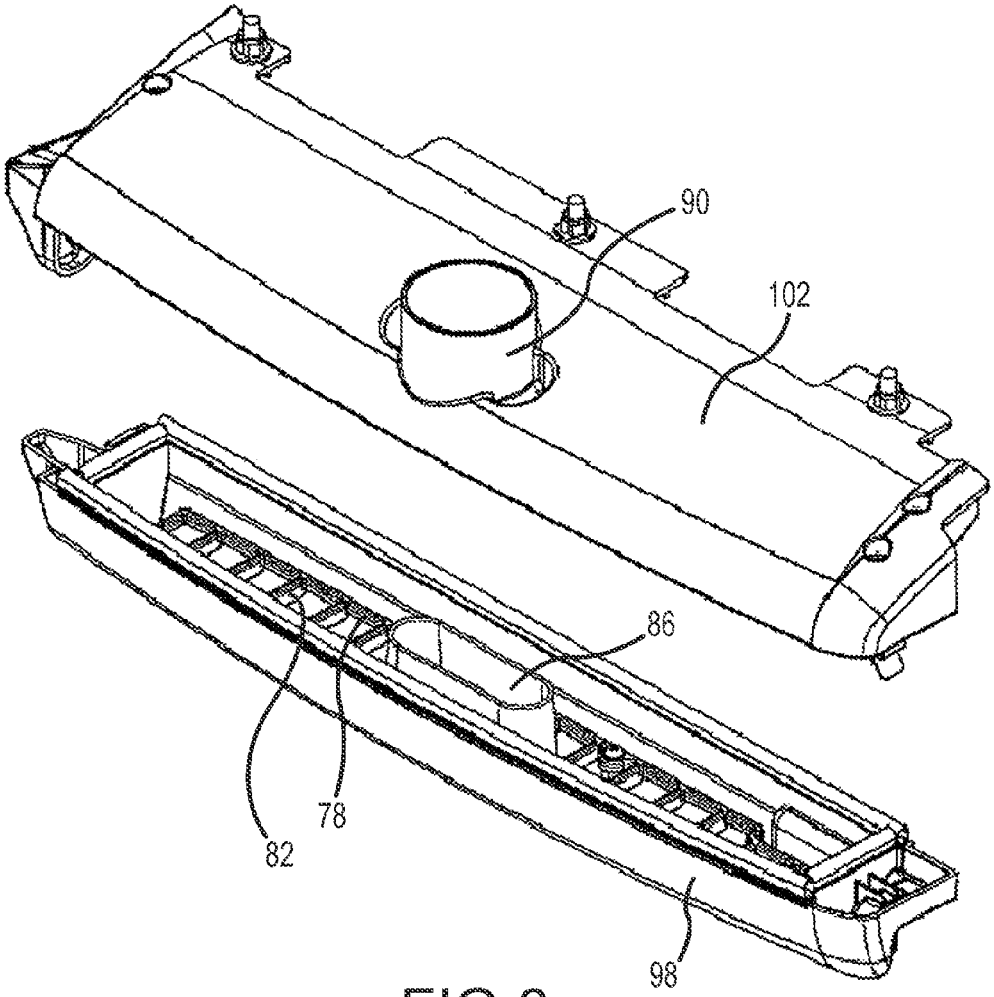
FIG. 6 is an exploded perspective view of the hopper of one embodiment of the cleaning assembly.

FIG. 6 shows the debris tray 98 integrated into the cleaning assembly 22. The debris tray 98 is selectively interconnected to a brush housing 106 of the cleaning assembly. The debris tray 98 is also concave or angled so the lowest point is adjacent to the opening 86 in the screen. The concave nature ensures that debris will move towards the opening 86 as the cleaning assembly vibrates to be suctioned by the vacuum hose 90.

Figure 7:
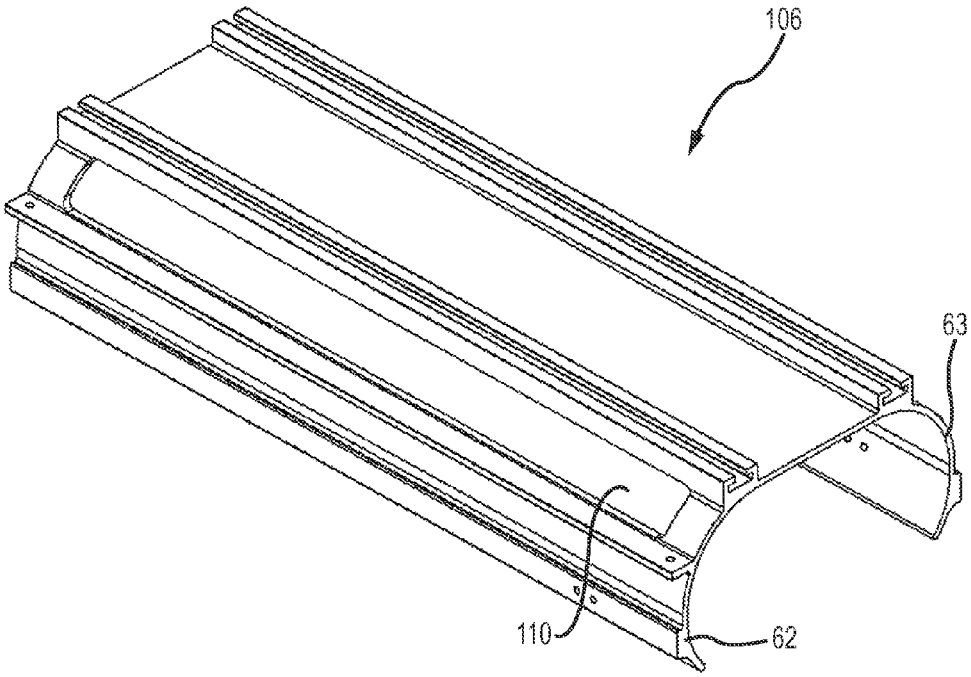
FIG. 7 is a rear perspective view of a brush housing.
Figure 8:
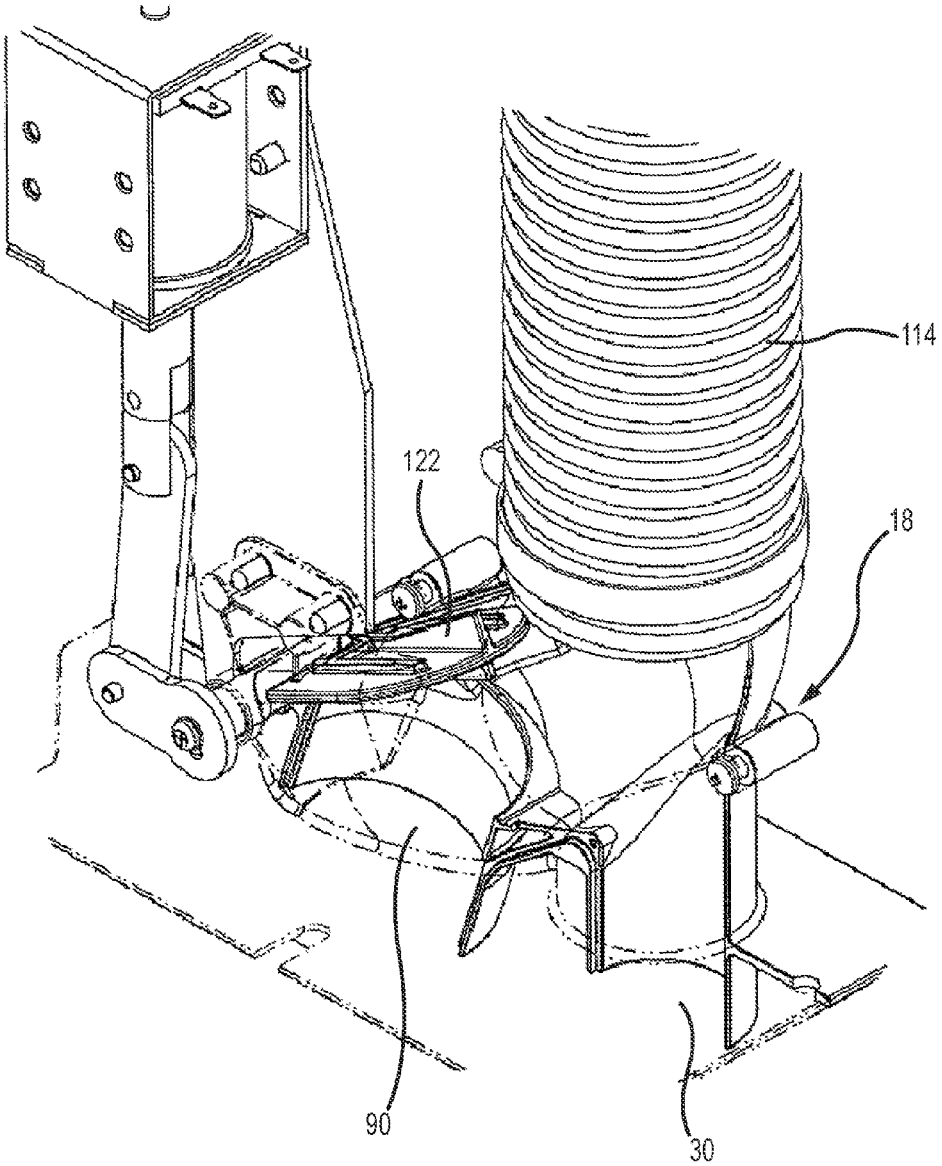
FIG. 8 is a detailed perspective view of the apparatus showing a valve in a primary, open position.
Figure 9:
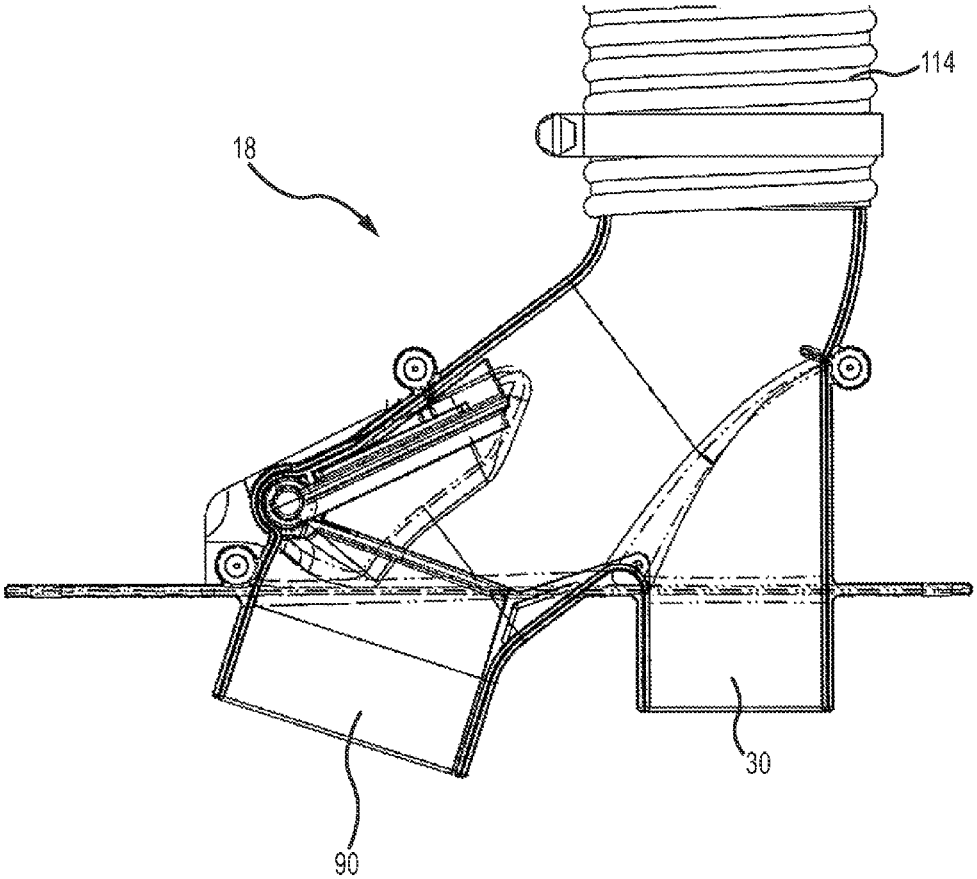
FIG. 9 is a cross-sectional view of FIG. 8.
Figure 10:
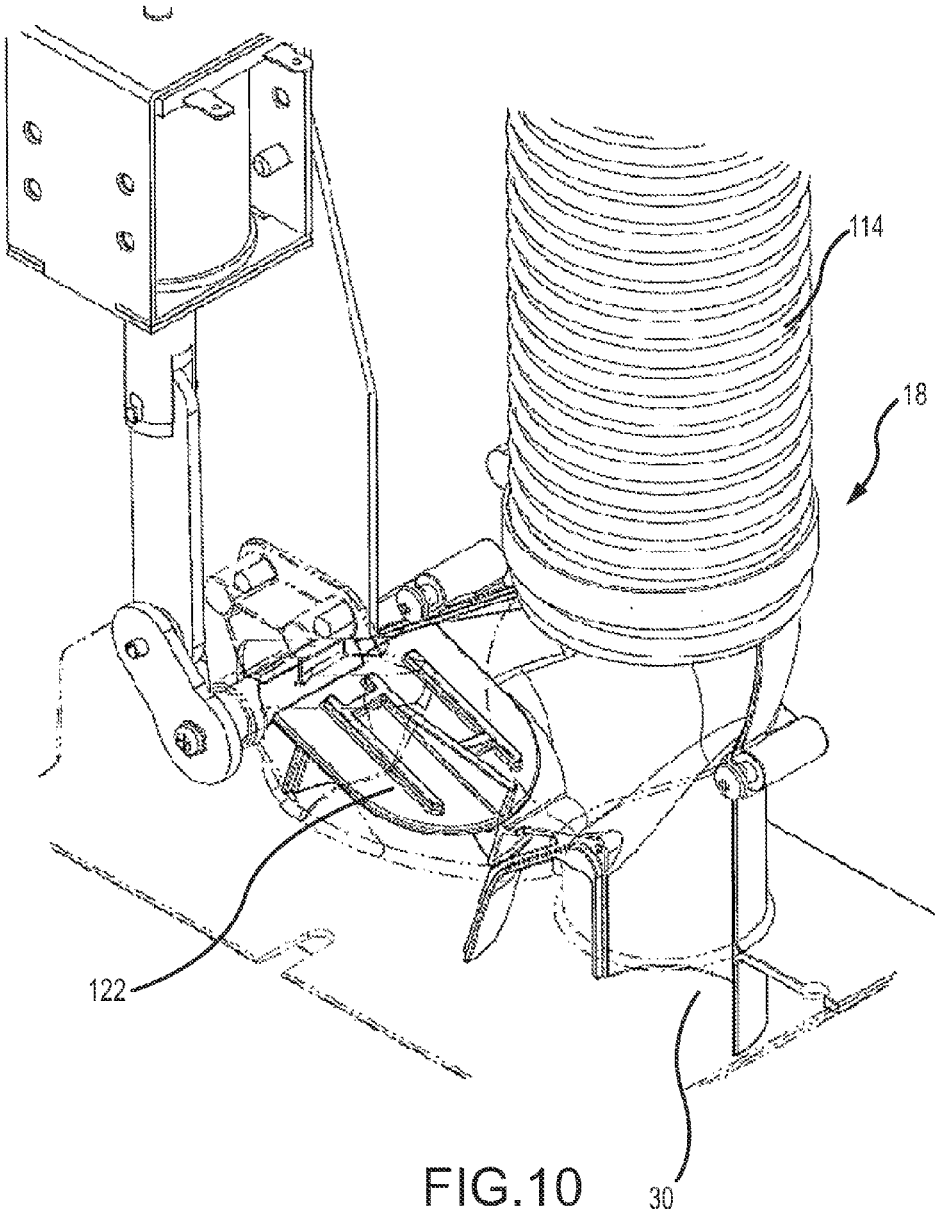
FIG. 10 is a detailed perspective view of the valve in a secondary, closed position.
Figure 11:
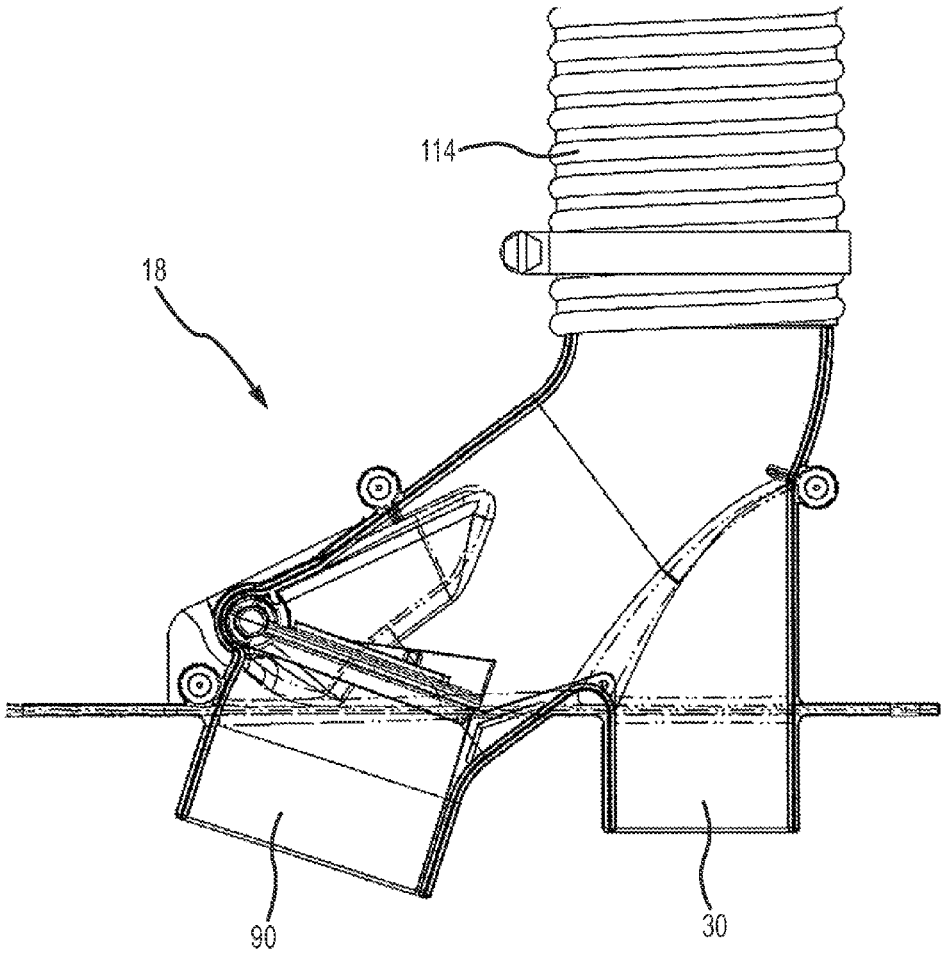
FIG. 11 is a cross sectional view of FIG. 10.
Figure 12:
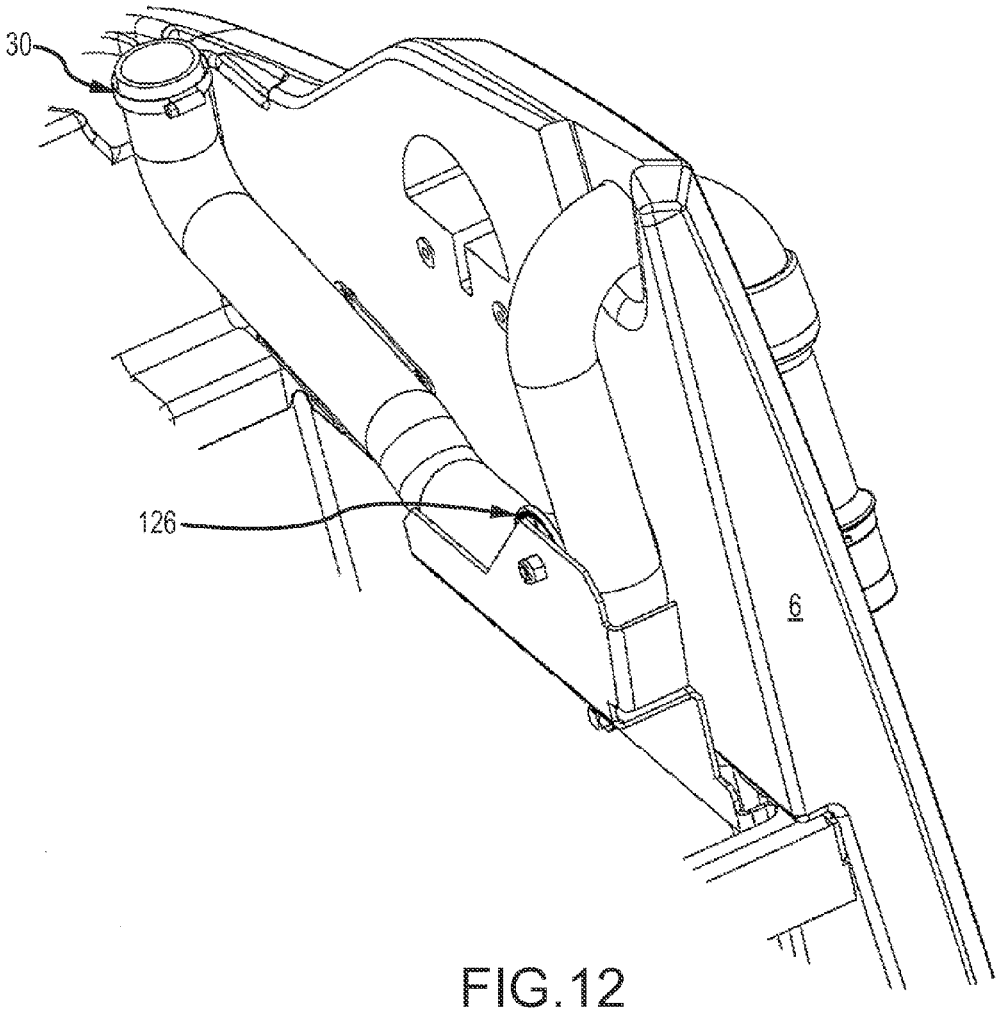
FIG. 12 is a partial perspective view of the cleaning apparatus showing an attachment hose.

FIG. 7 shows the brush housing 106 that contains the front brush and rear brush. The brush housing 106 is contoured to match the diameter of the brushes, which will enhance the ability of the cleaning assembly to create the contemplated air path. The brush housing 106 provides the elongated opening 110 above the curved walls 62 and 63 that allow air and debris to enter into the hopper. In one embodiment, the opening is about 1 inch wide.

Referring again to FIGS. 1-7, in operation, dirt, dust and debris is pulled from the floor 46 through an opening 54 in the cleaning assembly 22. The debris-laden air and other particulate matter are directed between counter rotating brushes (34 and 38), over the rear brush 38, and into the hopper 66. Large particulates are maintained by the screen 78, while smaller particulates and dust-laden air are suctioned through the vacuum hose 90. As one skilled in the art will appreciate, other items such as fluid dispensing devices and scrub brushes may be employed with this concept to further clean the floor. The air and/or fluid may be suctioned through the vacuum hose 90 to a valve 18. The vacuum motor 14 draws air through the vacuum bag 10 that includes a filter (not shown) to catch small particles. Air exits the vacuum bag 10 through the vacuum motor exhaust 118. The exhaust may include a "post filter" 119 to remove additional fine particles and a carbon element to remove odors. To the extent liquid is the fluid being collected, it will be deposited in known fashion into a receiving receptacle.

Referring now to FIGS. 1-3 and 8-12, a valve 18 and accessory hose 30 of embodiments of the present invention is further described. As mentioned above, the vacuum pressure provided by the vacuum motor 14 suctions air through the vacuum hose 90. The suctioned air enters into the valve 18 that includes a flapper 122. When open, (FIGS. 8 and 9), the flapper 122 only allows the debris-laden air from the hopper to be deposited into the vacuum bag 10 via a bag hose 114. When closed (FIGS. 10 and 11), the flapper 122 allows air from the accessory hose 30 to be deposited in the vacuum bag 10. The accessory hose 30 may be flexible or otherwise stretchable and is associated with a hose roller 126 interconnected to the housing 6 of the apparatus 2. In operation, when the end of the accessory hose 30 is closed with a capping device 130, the accessory hose 30 is retracted within the housing 6 as shown in FIG. 2. When in use, the capping device 130 is removed and an accessory is interconnected to the end of the accessory hose 30. The accessory hose's flexibility and elongation capabilities allow the user to access debris in hard-to-reach places.

Figure 13:
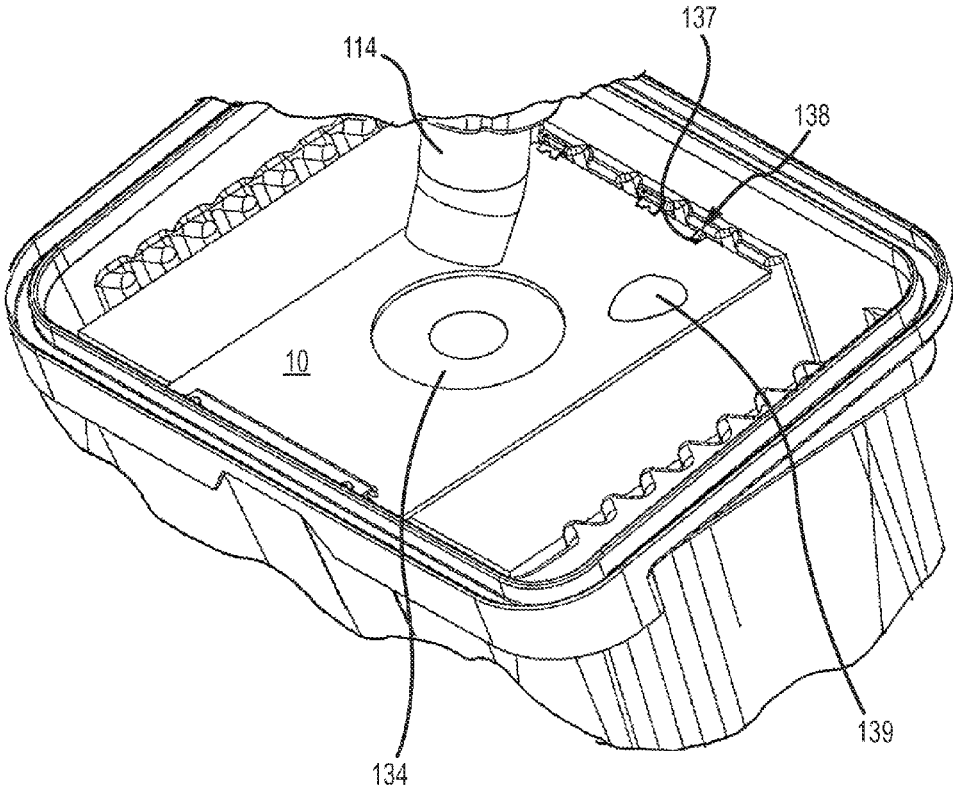
FIG. 13 is a partial perspective view showing a vacuum bag employed by some embodiments of the present invention.

As in FIG. 13, the bag hose 114 is interconnected to the vacuum bag 10 that employs a sealing member 134. The sealing member 134 ensures that when the bag hose 114 is installed, a tight seal is created between the hose and seal. The bag includes a tab 137, which is designed to mate with protrusion 138 found in the bag holding chamber. The tab 137 and protrusion 138 ensure the bag is always installed correctly. Also, the bag comes with a seal 139 removably installed thereon. The seal is used to cover the hole in the sealing mechanism when the bag is being replaced or emptied to ensure no debris will spill from the vacuum bag 10.

Figure 14:
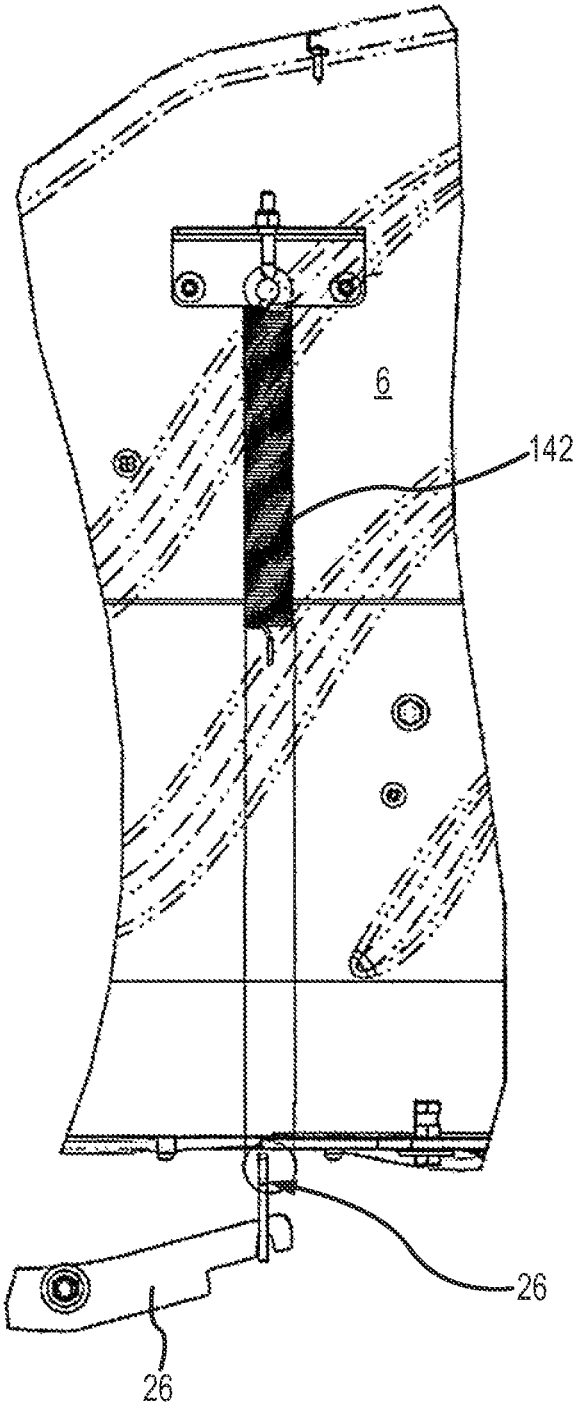
FIG. 14 is a partial front elevation view showing a spring suspension system employed by some embodiments of the present invention.

FIG. 14 shows a spring 142 interconnected to the armature 26 of some embodiments of the cleaning assembly. The spring 142 provides suspension of the cleaning apparatus. Selectively altering the spring stiffness allows the designer to adjust the force applied to the floor by the brushes. More specifically, the spring stiffness is preferably preselected and is a function of design and cleaning assembly configuration and weight so the operator can use the machine on many surfaces without adjustment. A long spring, for example, is less sensitive to changes in length and allows for variations in the floor surfaces without significant change to the amount of cleaning assembly weight felt by the floor.

Figure 15:
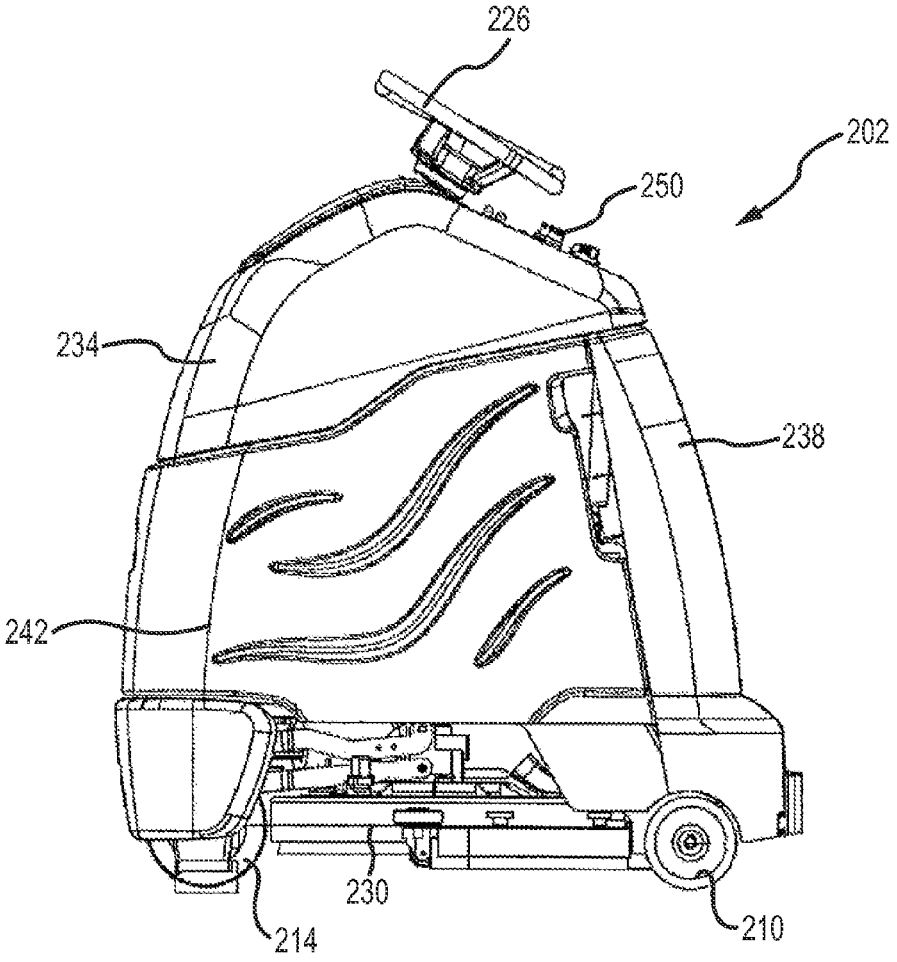
FIG. 15 is a front elevation view of the floor cleaning machine of another embodiment of the present invention.
Figure 16:
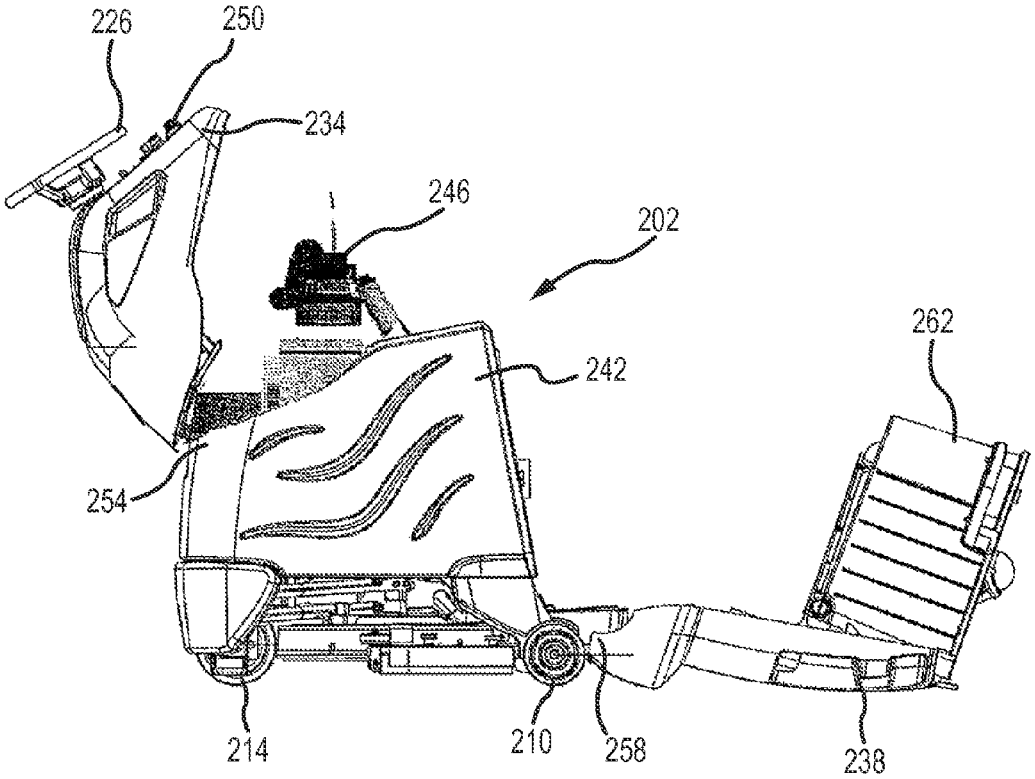
FIG. 16 is a front elevation view of FIG. 15 wherein a front housing and a rear housing have been rotated away from a primary housing of the floor cleaning machine.

Referring now to FIGS. 15-18, a floor cleaning machine 202 of another embodiment of the present invention is shown and it is generally comprised of a chassis 206 supported by two rear wheels 210 and a steerable front wheel 214. The front wheel 214 is associated with a steering mechanism 218 also interconnected to the chassis 206. A steering shaft 222 (FIGS. 17 and 18 only) is interconnected to the steering mechanism 218 and terminates at a steering wheel 226. The chassis 206 also supports at least one cleaning device or assembly 230 (FIG. 15) and a plurality of housings. Two of the housings, a front housing 234 and a rear housing 238, can rotate away from a primary housing 242 to provide access to interior components of the floor cleaning machine 202, such as a vacuum motor 246 (FIG. 16). The steering wheel 226 is also associated with the front housing 234 and remains interconnected thereto when the front housing 234 is rotated away from the primary housing 242 (FIG. 16). The steering shaft 222 of one embodiment of the present invention is flexible and can move away from the chassis 206 while remaining interconnected to the steering mechanism 218.

Referring now to FIG. 15, the floor cleaning machine 202 of one embodiment of the present invention is shown. Here, the front housing 234 is connected to a front portion of the primary housing 242 and accommodates a control panel 250 and the steering wheel 226. The rear housing 238 is also interconnected to the primary housing 242 and may enclose hoses, mechanical and electrical components of the machine. The front wheel 214, which is steerable, and the rear wheel 210 (a second rear wheel is not shown but positioned on the opposite side of the machine) which generally is not steerable, is associated with the chassis. The cleaning assembly 230, such as a cleaning brush and a squeegee, is also associated with the chassis 206. One skilled in the art will appreciate that the cleaning assembly 230 may be a brush, a scrubber, a burnisher, a squeegee, a spray nozzle, spent fluid pick-up mechanism etc., or combination of such devices.

Referring now to FIG. 16, the floor cleaning machine 202 of one embodiment of the present invention is shown in a second configuration. Here, the front housing 234 and rear housing 238 have been rotated away from the primary housing 242 to expose internal components of the floor cleaning machine 202. Here, the steering wheel 226 and control panel 250 are moved with the front housing 234. The connections associated with the control panel 250 and the steering wheel 226, i.e. the steering shaft 222, remain associated with the chassis 206, which will be described in further detail regarding FIGS. 17 and 18. The internal components, such as a vacuum motor 246 are exposed to be maintained or repaired. The front housing 234 of the embodiment shown, is hingedly interconnected to the primary housing 242 by way of a front hinge 254. One skilled in the art will appreciate, however, that the front housing 234 may rotatably interconnect directly to the chassis 206 and/or by devices other than a hinge. The rear housing 238 is rotatably interconnected to the chassis 206 by way of a rear hinge 258 and accommodates in one embodiment a storage tank 262. Those in the art will also appreciate that the rotatable housings could be rotated in virtually any direction desired which would best facilitate the objects of the benefits of the disclosed inventive features and through any appropriate device.

Figure 17:
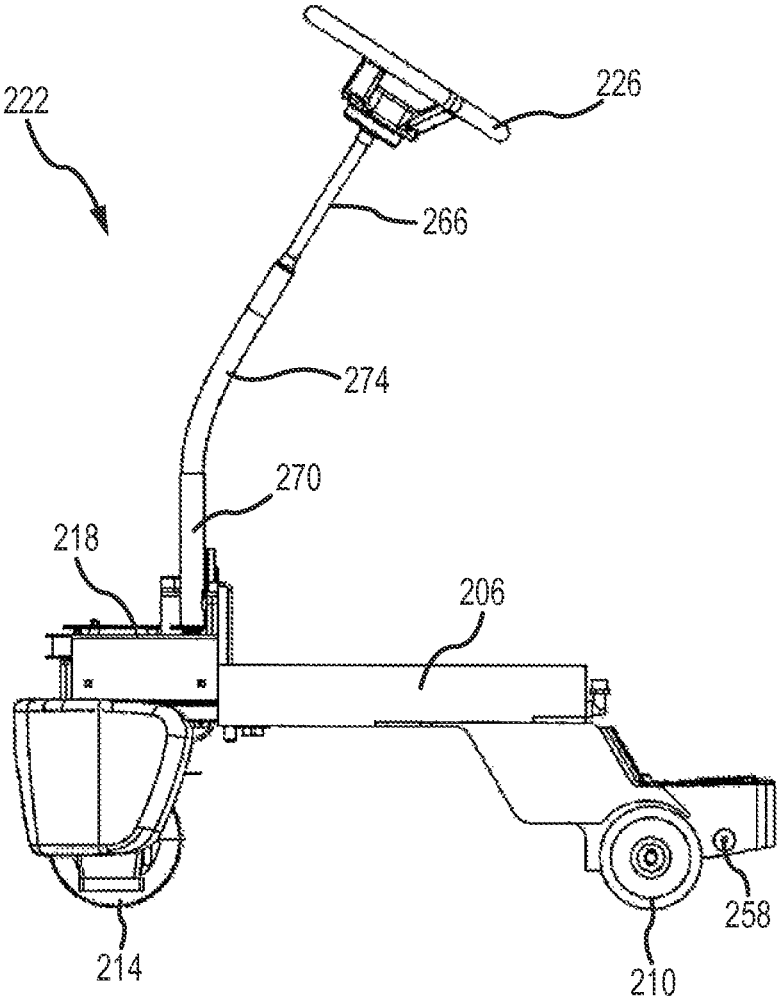
FIG. 17 is a front elevation view of the floor treatment apparatus showing a chassis, a flexible steering shaft and steering wheel.
Figure 18:
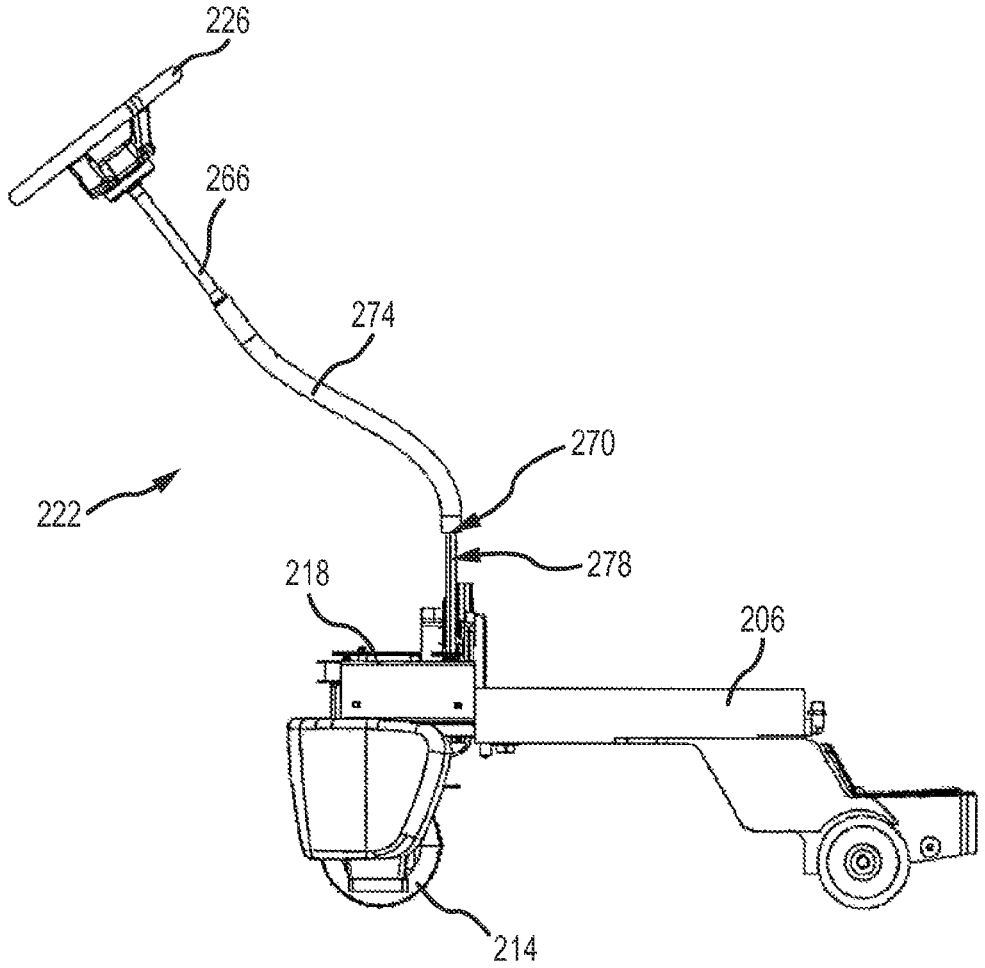
FIG. 18 is a front perspective view similar to that of FIG. 17 wherein the steering wheel has been moved to a second position by use of a flexible steering shaft.

Referring now to FIGS. 17 and 18, the nature of a preferred embodiment of the steering shaft 222 is shown, with the remainder of the components shown in FIGS. 15 and 16 having been removed for clarity. The steering shaft 222 may comprise a rigid portion 266, that is interconnected to the steering wheel 226 and a slip fitting 270, with a flexible portion 274 therebetween. Rotation of the steering wheel 226 will rotate the rigid portion 266, which will rotate the flexible portion 274 and the slip fitting 270, which will ultimately rotate the front wheel 214 to allow steering of the floor cleaning machines.

Referring specifically to FIG. 18, the steering wheel 226 is shown in a second position of use, where the front housing has been rotated away from the primary housing (see FIG. 16). Here, one can quickly appreciate that when rotated, the flexible portion 274 will flex to allow the steering wheel to be maintained with the front housing. In addition, the slip fitting 270 will preferably move upwardly away from the chassis 206. The slip fitting 270 is slidingly interconnected to a shaft 278 interconnected to at least one mechanism, such as a gear or belt, that rotates the steerable front wheel 214. As those in the art will appreciate the shaft 278 could also be directly connected to the steering wheel assembly.

In one embodiment, the shaft 278 is hexagonal and cooperates with a hexagonal opening in the slip fitting 270 to allow rotation of the steering wheel 226 to be translated to the steerable shaft 222 to allow the rotation of the steerable front wheel 214. One skilled in the art will appreciate, however, that any configuration that provides rotational locking between the slip fitting 270 and the shaft 278 that would allow for rotation of the shaft 278 upon rotation of the slip fitting 270 is within the scope of the disclosure.

The flexible portion 274 may be constructed of nylon impregnated rubber or any other compliant or flexible material. Alternatively, a wire overwrapped flexible bellows member may be used instead of a composite rubber member. Further, to facilitate rotational translation of the steering wheel 226 to the steering mechanism 218, the flexible portion 274 may comprise a rubber tube wrapped by a flexible metal coil. Additionally, one of skill in the art will appreciate that a bellows system may be used wherein the slip fitting 270 is omitted and the bellows would be directly interconnected to the steering mechanism 218 and would allow for bending of the steering shaft 222 and selective elongation thereof only if needed. One skilled in the art will appreciate the systems that may achieve the goal of providing at least one of flexibility in the steering assembly and/or elongation to accommodate the moving of the front housing.

In one embodiment of the present invention the flexible portion 274 is made of steel reinforced rubber and is about 22 inches long. In some embodiments, the steering shaft 278 is 9 inches long and has a hexagonal exterior configuration that fits into a hexagonal opening of the slip fitting 270. One skilled in the art will also appreciate that the shaft 278 may be hollow such that the slip fitting 270 fits within the shaft 278, for example.

Referring now to FIGS. 19-38 a floor treating apparatus 302 for cleaning or otherwise treating a floor surface is shown. More specifically, one embodiment of the present invention includes a housing 308 with a platform 304 adapted to support the weight of an operator 306, thus increasing the efficiency of the entire floor treatment operation. The housing and platform are interconnected to or associated with a chassis. Various cleaning or floor treatment components may be interconnected to, or associated with, the bottom surface 310 of the housing or the chassis, such as brushes 312, scrubbers 314, squeegees 316, vacuum shoes (not shown), etc.

The housing 308 also includes a plurality of wheels 318 operably interconnected to the bottom surface 310 to enable steering and provide stability. It is contemplated that the operator 306 will stand on the platform 304 and steer the apparatus 302 with either a steering wheel 320 or other type of steering mechanism, such as a joy stick 322. Such an embodiment of the present invention enables the floor surface to be cleaned or otherwise treated more efficiently, since the operator 6 does not have to push or pull an often heavy apparatus. In addition, because the human component of powering or otherwise moving the apparatus 302 is omitted, more consistent flooring treatment is achieved, saving materials and reducing costs of the entire cleaning operation.

Figure 19:
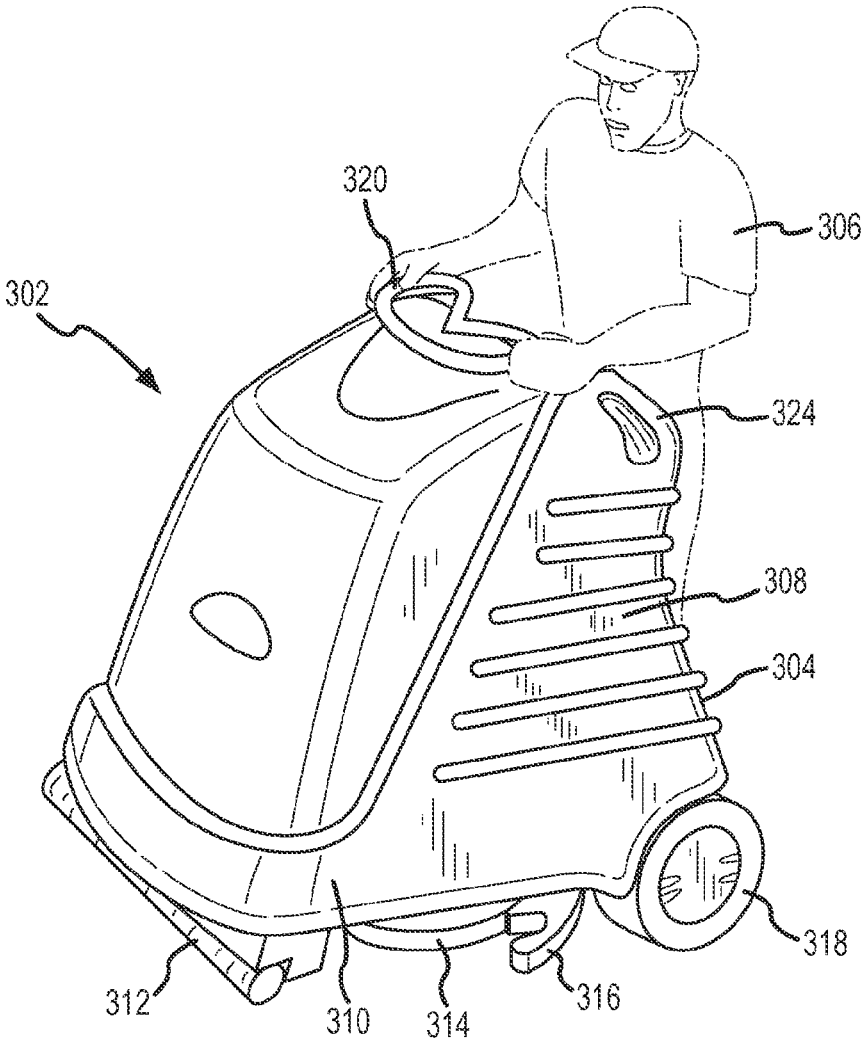
FIG. 19 is a perspective view of one embodiment of the present invention showing an operator standing on the platform thereon.

Referring now to FIG. 19, one embodiment of the present invention is shown. More specifically, the housing 308, which is associated with the platform 304 adapted to support the feet of an operator 306 during the floor treatment operation, is shown. The operator 6 preferably stands on the platform 304 that is generally parallel to the flooring surface. Preferably, the platform 304 is tilted, rear edge higher than the front edge, between about 3 to 8 degrees to increase ergonomics. However, as it will be appreciated by one skilled in the art, other support devices, such as seats, which may be operably folded into the housing 308, may be provided to increase the comfort level of the operator 306. In addition, the embodiment of the present invention shown in FIG. 19 is equipped with a steering mechanism, such as a wheel 320, that allows the operator 306 to easily maneuver the apparatus 2 around the flooring surface.

The housing 308 is constructed of any material, but preferably hard plastic will be used to reduce the weight of the apparatus 302. A plurality of wheels 318 are operably interconnected to the rear of the apparatus 302 to provide stability and perhaps power for locomotion. In addition, a squeegee 316 is often included and it is adapted to extract or funnel water or debris to a location where it is extracted via vacuum into a container generally, but not always, located at least partially inside the housing 308 (which as explained can be connected to a rear housing). Further, this embodiment of the present invention (FIG. 19) includes a brush 312 used to agitate the flooring surface to loosen dirt, wherein spray nozzles may be employed situated behind the brush 312 to treat the flooring and capture the dirt so it can be gathered by the squeegee 316 and suction system of the apparatus 302.

Figure 20:
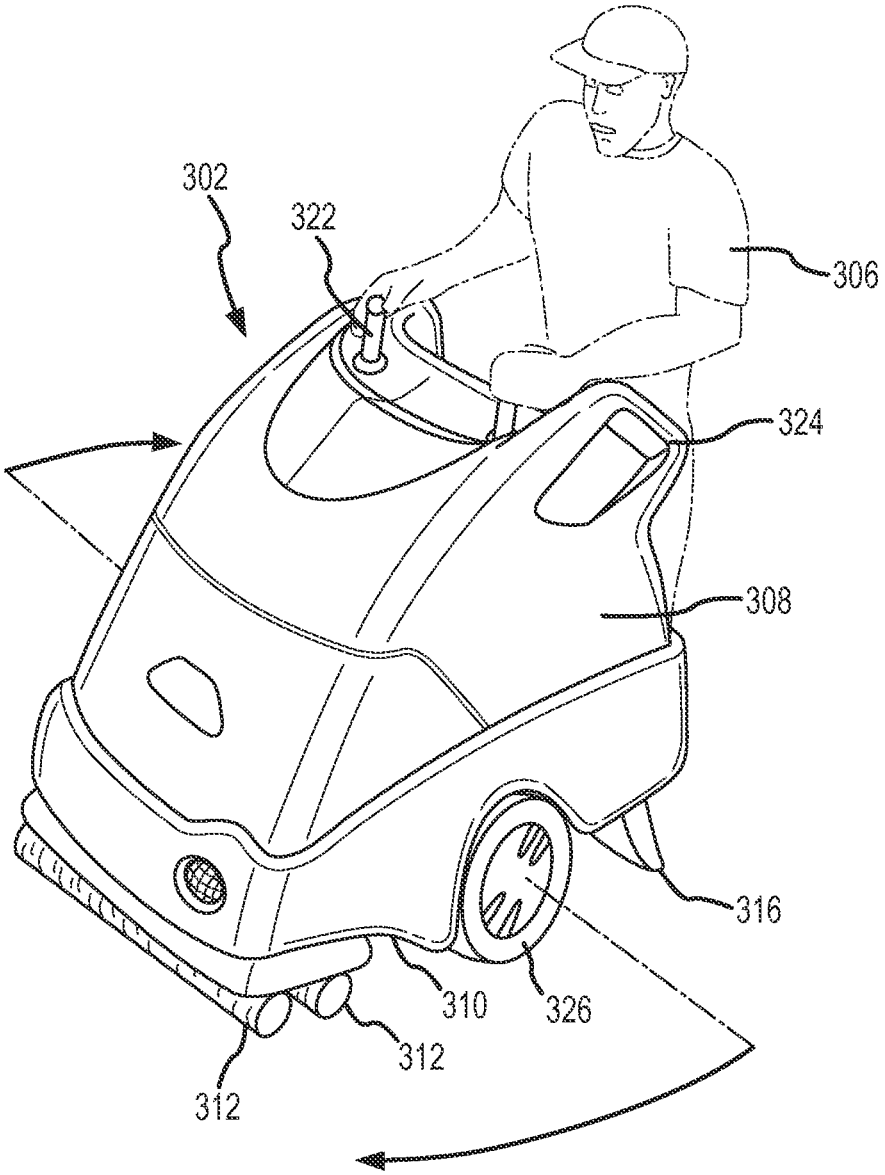
FIG. 20 is a perspective of an alternate embodiment of the present invention that is configured for fluid extraction, and which is controlled by at least one joy stick.

FIG. 20 shows an alternate embodiment of the present invention used mainly for fluid extraction. This embodiment of the present invention is similar to the apparatus described above, however alternate components are interconnected to the bottom surface 310 of the housing 308, or associated with the chassis, such that the apparatus is adapted to efficiently capture fluids or debris deposited on a floor surface. More specifically, this embodiment of the present invention is equipped with at least one brush 312 adapted to agitate water and/or debris and a squeegee 316 that is positioned adjacent to the rear surface of the housing 308 that contains fluid and debris as the apparatus 302 moves forward. In one embodiment of the present invention, a suction device, such as a vacuum shoe (not shown), is positioned near the squeegee 316 such that dirty cleaning fluid is vacuumed from the surface and transferred into a tank situated inside or adjacent to the housing 308. In one embodiment, the tank is interconnected to a rear housing (see, for example, FIG. 16). Alternatively, another embodiment of the present invention is provided with a squeegee 316 with a plurality of suction holes that are the terminus of conduits that transport waste water to the storage tank.

In the illustrated embodiment, the operator 306 can control the apparatus 302 with a plurality of joy sticks 322. Hand grips 324 are provided on the sides of the operator 306 to increase safety. Further, this embodiment of the present invention employs powered wheels 326 that allow the entire system to rotate on a single vertical axis without substantially transitioning in other directions. More specifically, this embodiment of the present invention can perform a 360° turn, which aids cleaning of tight spaces. Other disclosed embodiments of the invention also can rotate 360° without moving substantially in other directions.

Figure 21:
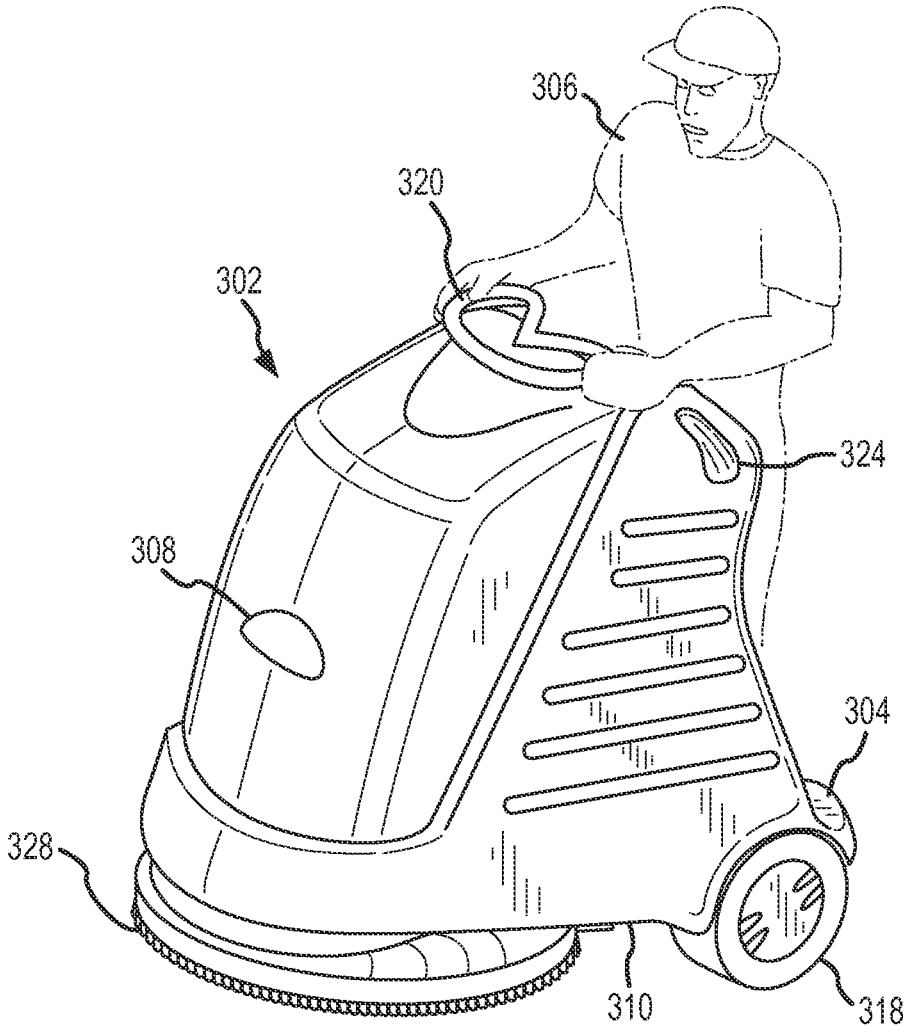
FIG. 21 is a perspective view of an alternative embodiment of the present invention that is configured for burnishing operations.

An alternate embodiment of the present invention that is used for burnishing is shown in FIG. 21. This embodiment of the present invention includes a burnishing pad 328 operably interconnected to the bottom surface 310 of the housing 308 or otherwise associated with the chassis. As before, the operator 306 stands on a platform 304 associated with the housing 308 and supported by the chassis. One skilled in the art will appreciate that this embodiment of the present invention may also include a device for suctioning debris left over from the burnishing process, such as dust or wax particulates, for example.

Figure 22:
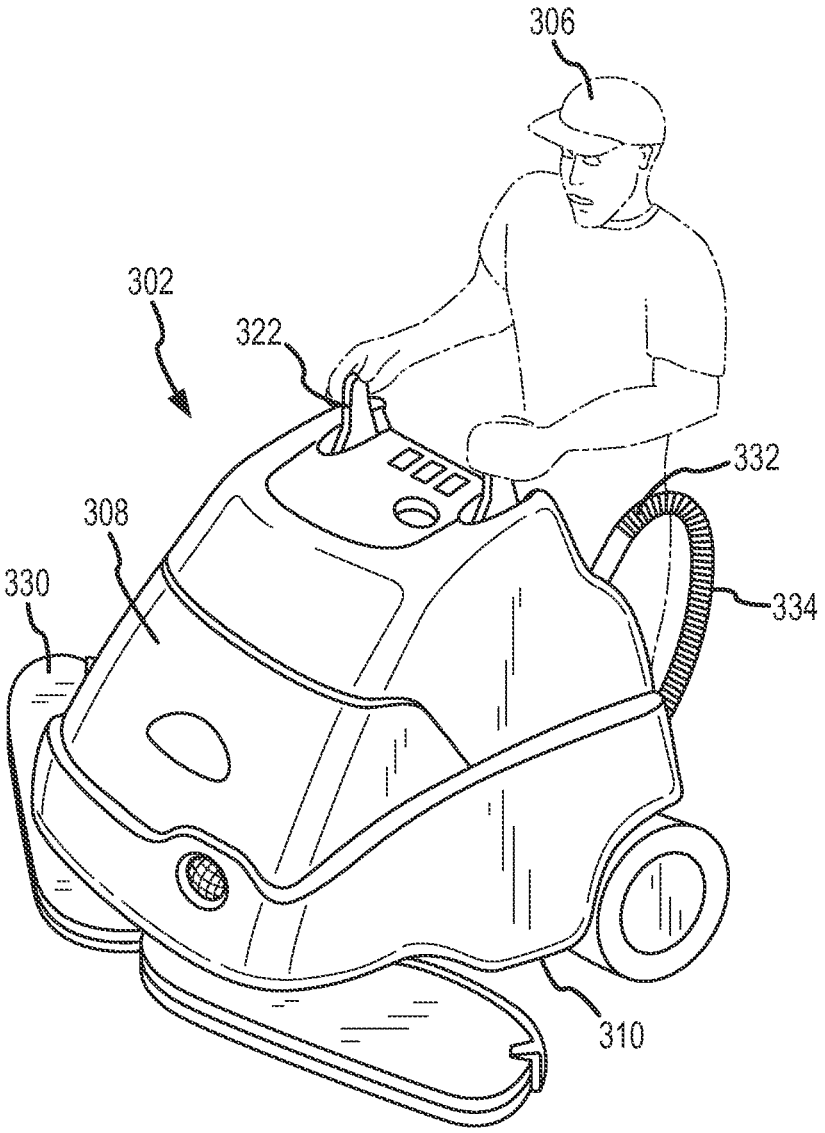
FIG. 22 is a perspective view of an alternative embodiment of the present invention that is equipped with moveable brushes that are adapted to swing out from the device to more efficiently treat a floor surface, and which also includes a wand for selectively cleaning difficult to reach areas.

Referring now to FIG. 22, an alternate embodiment of the present invention that employs swinging brushes 330 is shown. This embodiment of the present invention is very similar to those described above, however the brushes 330 used to agitate, scrub, or burnish are rotatably interconnected to the bottom surface 310 of the housing 308, or associated with the chassis. More specifically, the brushes 330 of this embodiment can independently fold inwardly, efficiently cleaning the interior portion of a floor when the apparatus is operating near a vertical surface such as a wall. The brushes 330 are independently movable and preferably spring loaded outward such that contact with a vertical surface causes the brush 330 to fold under the housing 308. Alternatively, as one in the art will appreciate, the orientation of the brushes may be controlled by the operator. In addition, a wand 332 interconnected to a hose 334 may also be employed with this embodiment of the present invention to allow for selective application of cleaning solution or suction.

Figure 23:
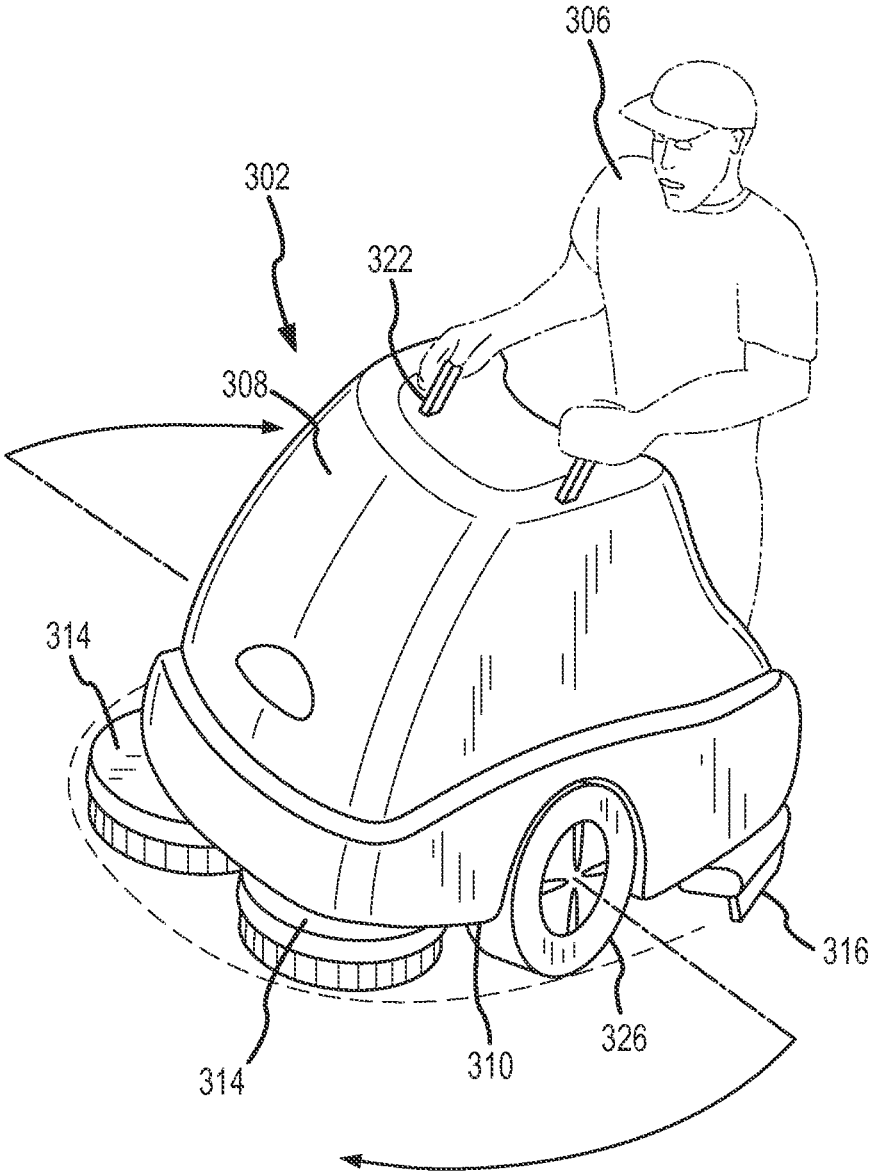
FIG. 23 is a perspective view of an alternative embodiment of the present invention that is designed to rotate about a 360° axis without significantly traversing in other directions.

Referring now to FIG. 23, another embodiment of the present invention that utilizes centered powered wheels 326 is shown. More specifically, this embodiment of the invention is similar to those described above, however it is equipped with a plurality of wheels 326 that allow a 360° turning capability. This embodiment of the present invention is also similarly adapted for cleaning the surface of a floor with a brush (not shown) or a plurality thereof that is used to agitate the dirt wherein a squeegee contains and suctions debris into a container.

Figure 24:
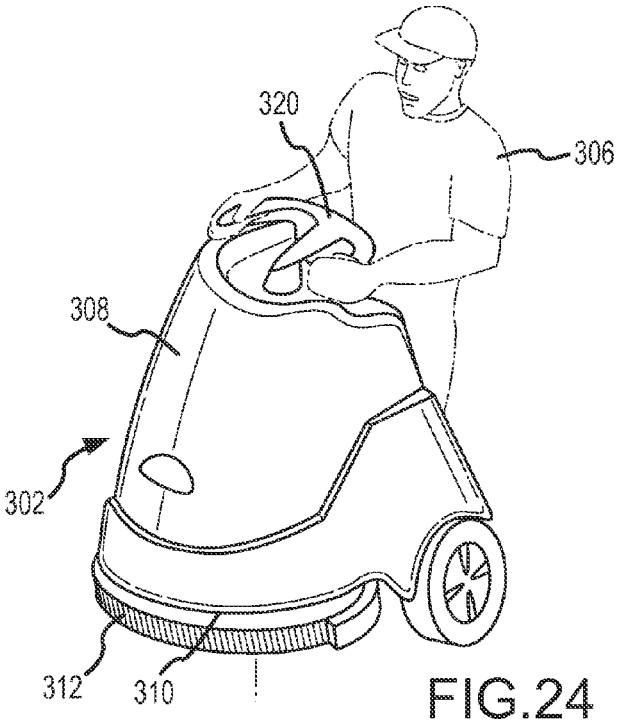
FIG. 24 is a perspective view of an alternative embodiment of the present invention that is designed to reach tight areas of floor surface.
Figure 25:
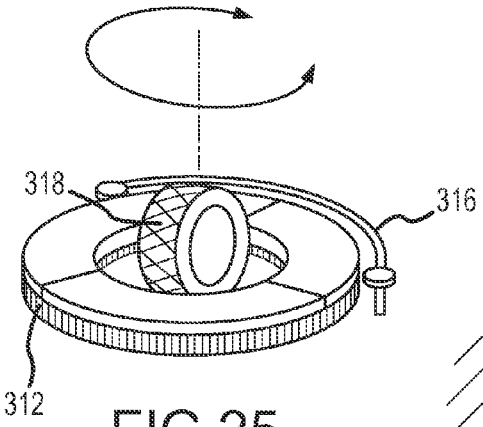
FIG. 25 is a detailed perspective view of the embodiment shown in FIG. 24, showing the steering wheel, brush, and squeegee assembly used therewith.
Figure 26:
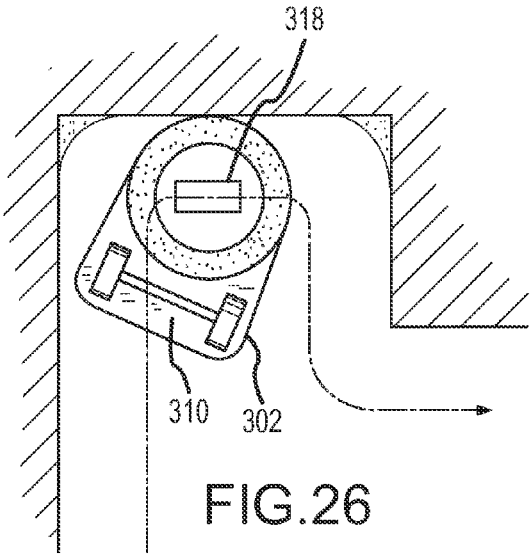
FIG. 26 is a top plan view of a flooring surface and an embodiment of cleaning machine superimposed therein.

Referring now to FIGS. 24-26, an alternate embodiment of the present invention is shown that is equipped with a wheel 318 with brushes 312 therearound for cleaning in all directions. This embodiment of the present invention is equipped with brushes 312 that allow for cleaning or agitation of the flooring surface in any direction the apparatus 302 is moving, thus efficiently cleaning flooring without having to make multiple passes over the surface.

Figure 27A:
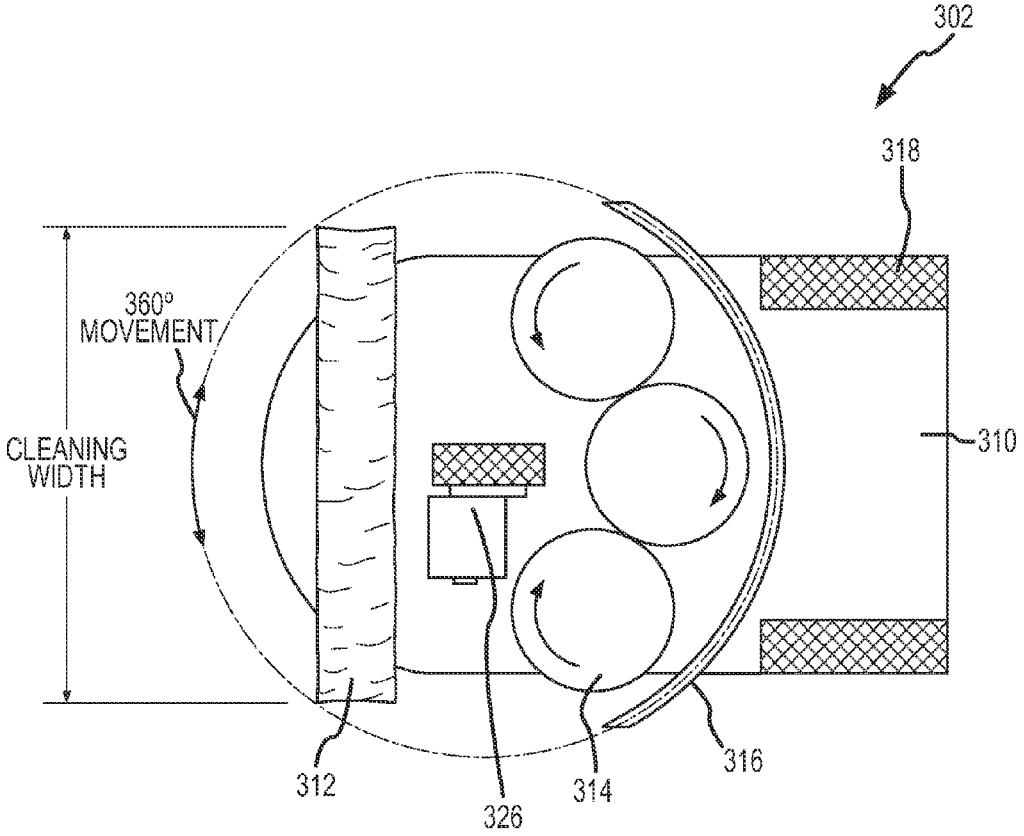
FIGS. 27A-B are bottom plan views showing configurations of steering, cleaning, and power mechanisms.
Figure 27B:
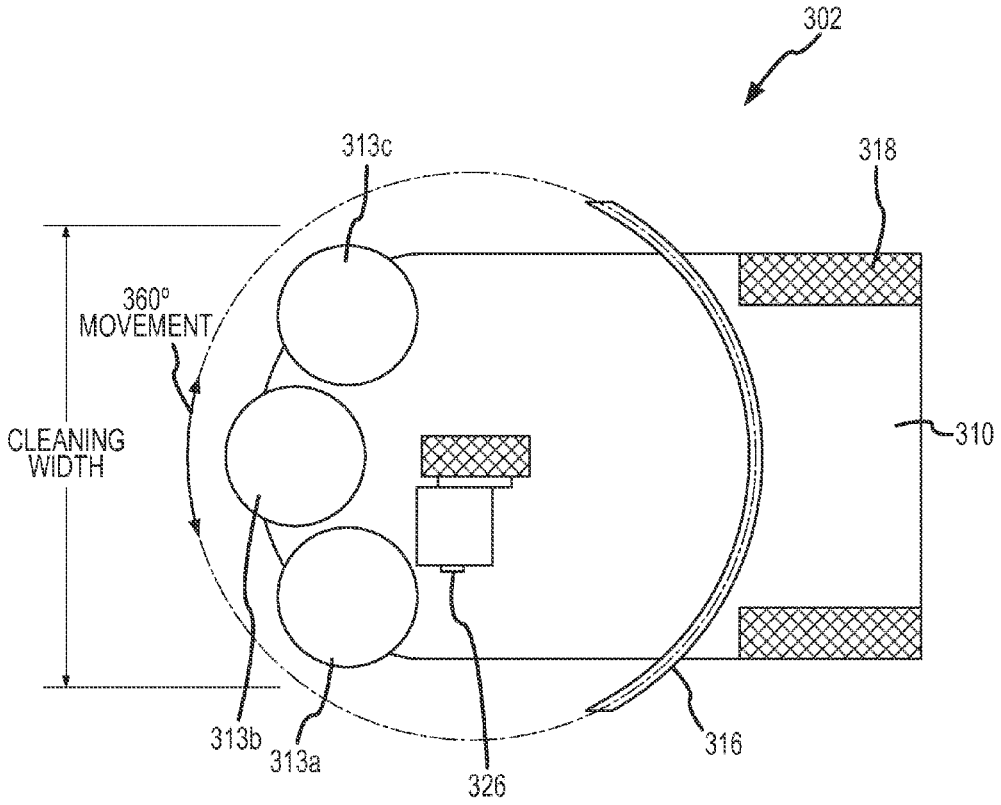

Referring now to FIG. 27A-B, one configuration of cleaning components interconnected to the bottom of the apparatus is shown. More specifically, one embodiment of the present invention is adapted to either sweep or clean a floor. In the illustrated embodiment, a pre-sweeping brush 312 agitates the carpet or hardwood floor to loosen debris. Next, rotating scrubbing brushes 314 further agitate the surface and perhaps add fluid and cleaning solution thereto to help loosen and contain any loose debris. Finally, a squeegee 316 and preferably a suction system is provided that captures the dirty water and as the apparatus is moved forward. The drive unit is the center wheel 326, which is also adapted to selectively rotate upon steering commands from the operator.

FIG. 27B shows a configuration of cleaning components associated with the bottom surface of the apparatus similar to what was shown in FIG. 27A. The difference, however, is that the pre-sweeping brush 312 has been replaced by three scrub brushes or three rotating brushes, 313A, 313B, and 313C that may be used to either sweep, burnish or combinations thereof a floor surface. The brushes can rotate at speeds desired by the operator or at preselected speeds and in directions selected by the operator or in preselected directions.

Figure 28:
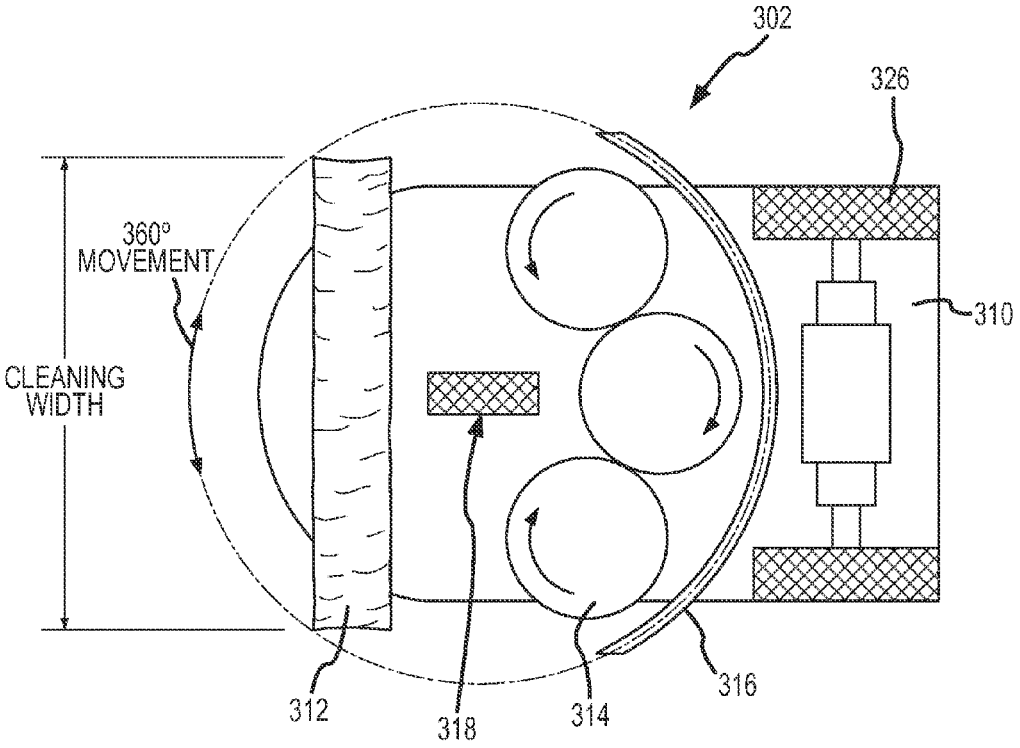
FIG. 28 is a bottom plan view of an alternate embodiment of the present invention showing an alternate configuration of steering, cleaning, and power mechanisms.

Referring now to FIG. 28, an alternate configuration of the cleaning components associated with the bottom surface of the apparatus is shown. More specifically, this configuration is substantially similar to that shown above in FIGS. 27A and 27B, however, the drive mechanism of the apparatus is a transaxled power plant that provides power to the rear wheels 326, wherein the steering is performed by a front wheel 318. In one embodiment of the present invention the drive mechanism is an electric monowheel drive. In another embodiment, the drive mechanism comprises rear wheels that are independently driven by drive motors.

Figure 29:
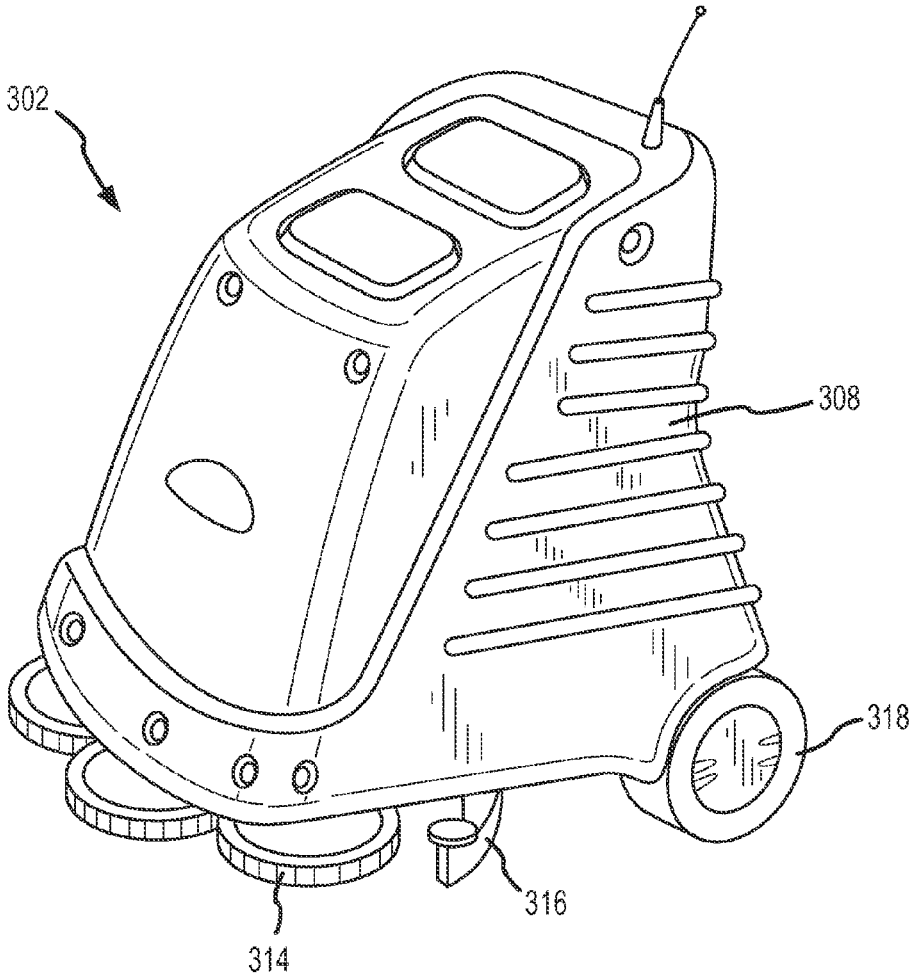
FIG. 29 is a perspective view of an alternative embodiment of the present invention that is adapted to be remotely controlled.

Referring now to FIG. 29, yet another embodiment of the present invention performs a floor treatment operation without the need of physical human contact is shown. More specifically, this embodiment of the present invention is remote controlled or otherwise intelligent such that it cleans a floored surface without the direct contact of an operator. This embodiment of the present invention may be configured for any task, such as scrubbing, sweeping, vacuuming, burnishing, carpet cleaning, waxing, surfacing, cleaning, etc. It is envisioned that the operator be in a separate location, perhaps offsite from the actual cleaning operation, and aided by remote viewing devices. Alternatively, one embodiment of the present invention is programmed with the ability to automatically treat a floor surface, wherein the dimensions of the surface are programmed into or learned as the apparatus is in use, alleviating any need for human contact with the apparatus. This embodiment of the present invention may be deployed from a storage location automatically wherein quick disconnects to fluid sources or waste receptacles are remotely joined to it such that filling and emptying tanks or waste containers inside the chassis 8 is done without the need of a human operator as well. This embodiment of the present invention may be used in areas where it is dangerous for humans to operate, such as nuclear power plants, areas where asbestos exposure is likely, etc.

Figure 30A:
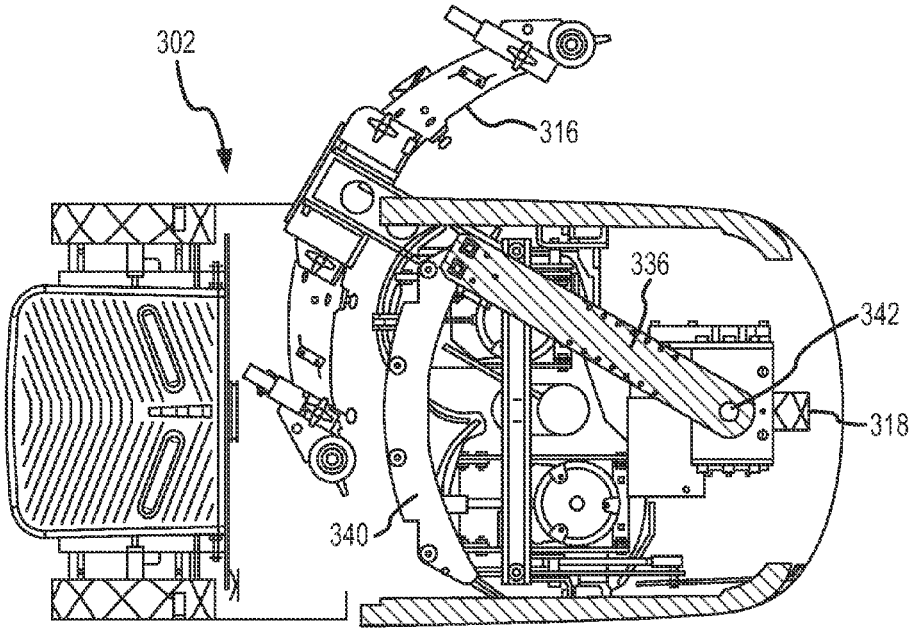
FIGS. 30A-H are views of a rotatable squeegee and other device components for use in one embodiment of the present invention.
Figure 30B:
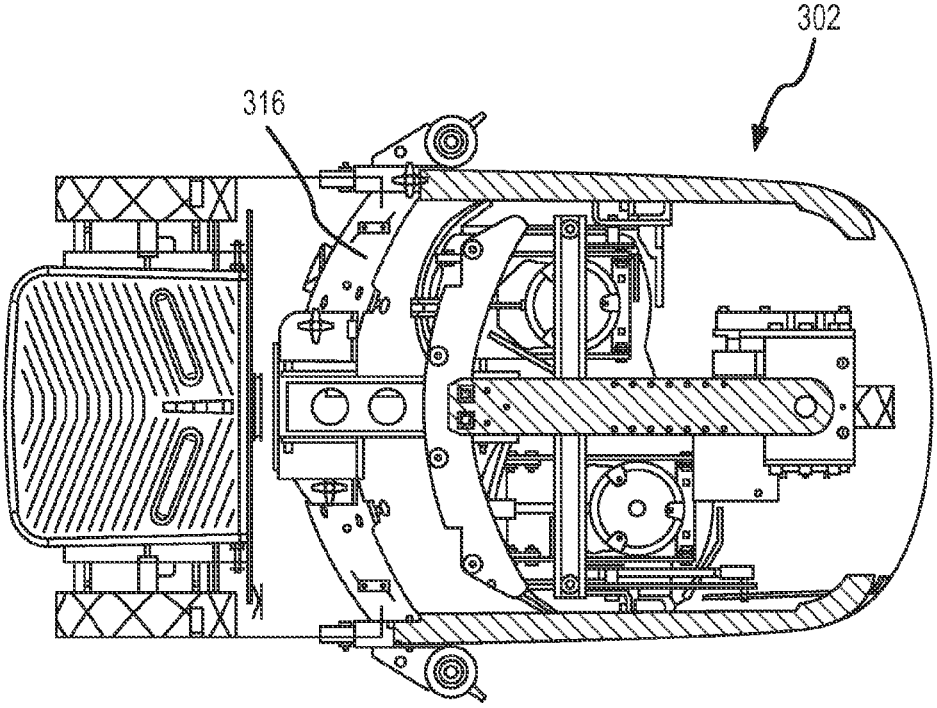
Figure 30C:
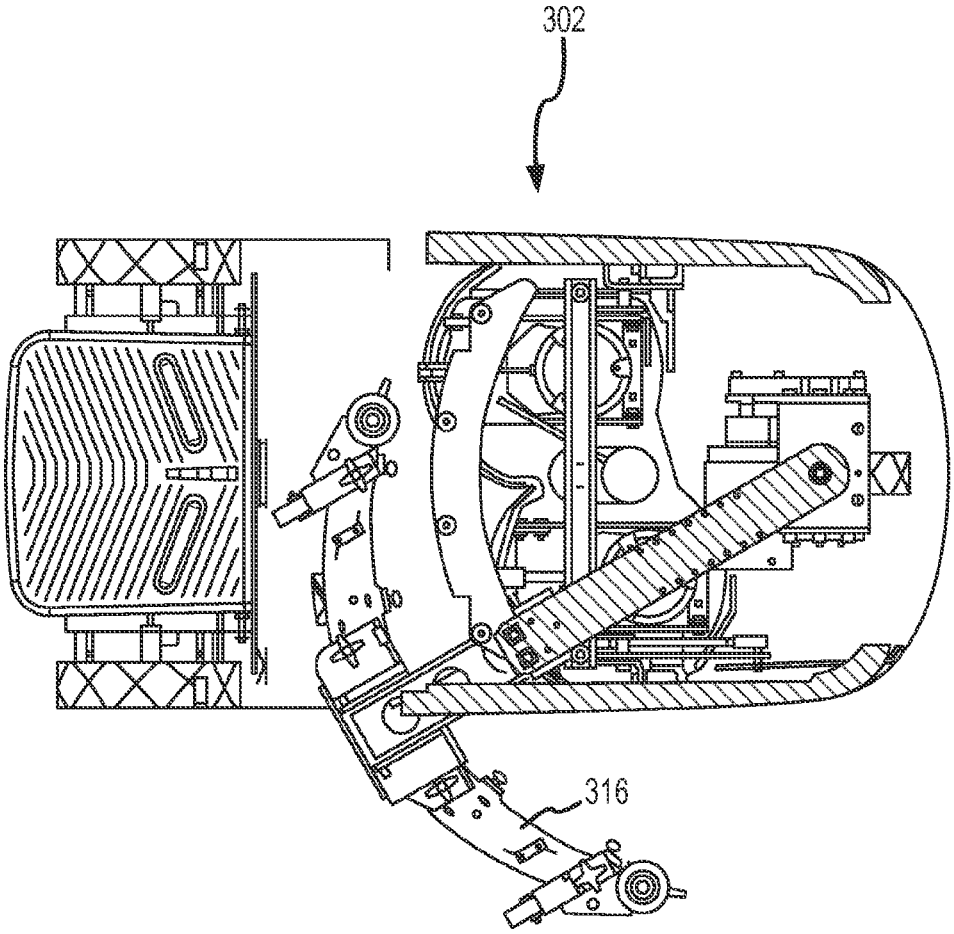
Figures 30D, 30H:
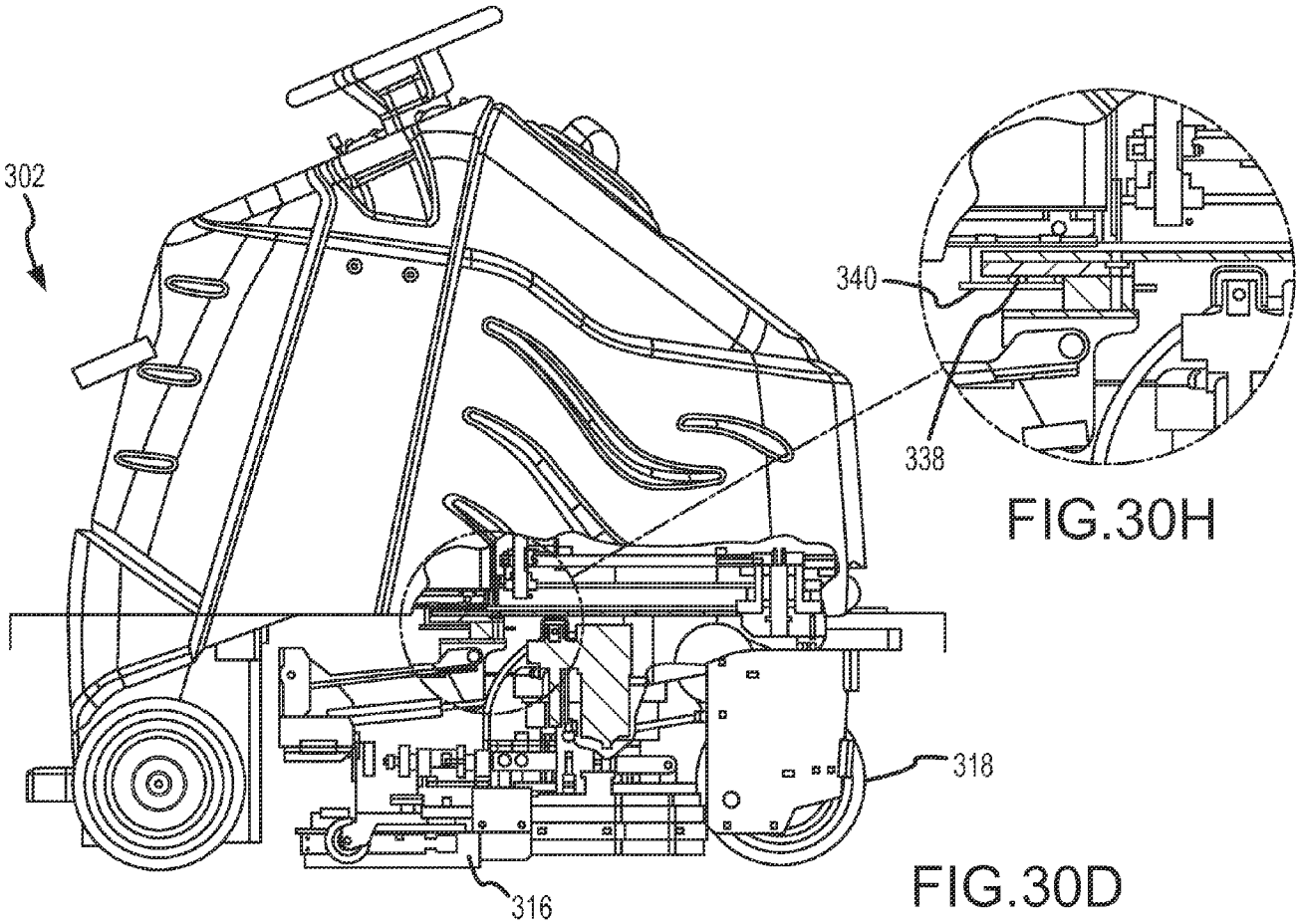

Referring now to FIG. 30A-G, a squeegee 316 for use in one embodiments of the present invention is shown. More specifically, some embodiments of the present invention include a pivot mechanism that allows the squeegee 316 to remain in place when the floor treating apparatus 302 is turning. Thus, the amount of fluid extracted when the apparatus 302 is making a tight turn is increased. In the illustrated embodiment, the squeegee 316 is connected to a swing arm 336 that pivots about a point adjacent to the front wheel 318 of the apparatus. The swing arm 336 is supported via rollers or bearings 338 on a track 340 that maintain the squeegee's 316 vertical position relative to the floor. Upon making a right or left hand turn, friction will keep the squeegee 316 in a straight line, following the original path of the vehicle. Once a new line of travel is established, the squeegee 316 will fall back in place substantially under the apparatus 302. FIG. 30A shows the squeegee 316 in its upmost left position, while FIG. 30C shows the squeegee in its upmost right position. FIG. 30B shows the squeegee in a neutral position while FIG. 30D shows the squeegee in a neutral position but from a side view.

The squeegee 316 of one embodiment of the present invention is provided with a plurality of wheels 318 that interface with the floor to maintain the vertical clearance of the squeegee assembly. Side rollers may be provided that prevent the squeegee 306 from contacting a vertical surface, such as a wall. These wheels and various portions of the squeegee assembly may be selectively adjustable such that the width of the squeegee 316 and the placement of the wheels 318 (squeegee height) may be altered at will.

The swing arm 336 connects to a pivot 342 that utilizes the momentum of the squeegee 316 to swing it from the apparatus 302. However, one skilled in the art will appreciate other methods of transitioning the squeegee 316 from the floor treatment apparatus 302 may be utilized without departing from the scope of the invention. More specifically, a motorized system may be employed that is in communication with the steering system of the vehicle such that rotation of the steering wheel will swing the squeegee 316 away from the apparatus 302 in a predetermined manner.

Figure 30E:
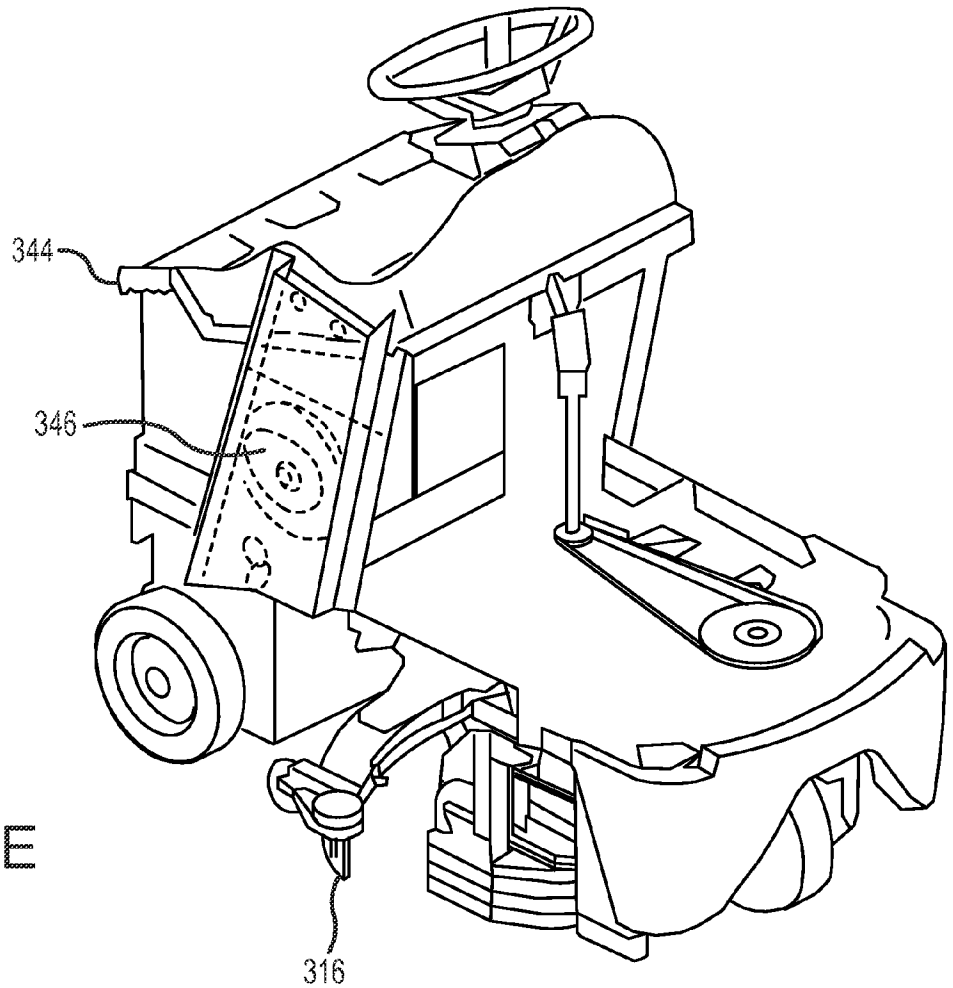
Figure 30G:
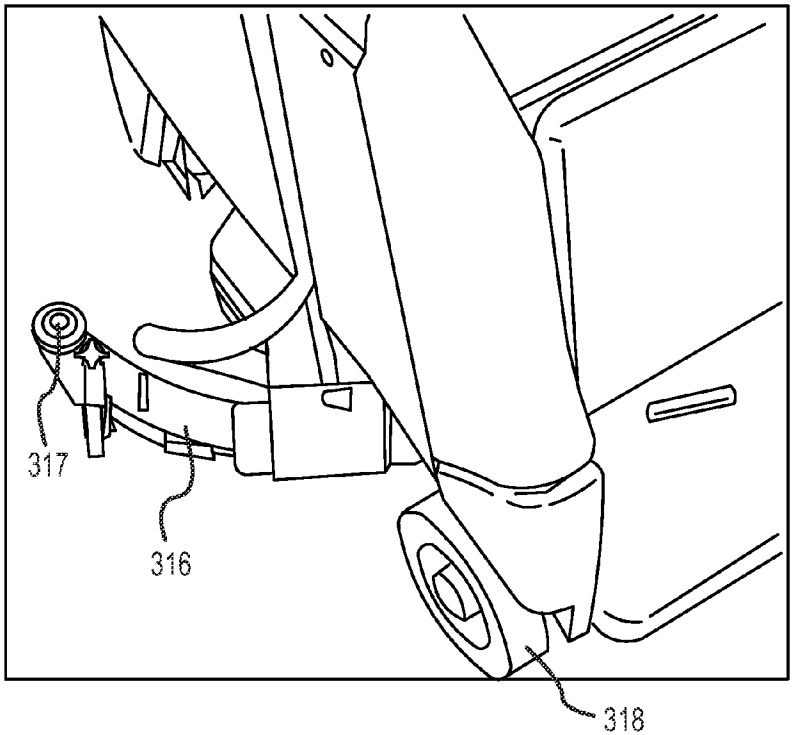
Figure 30F:
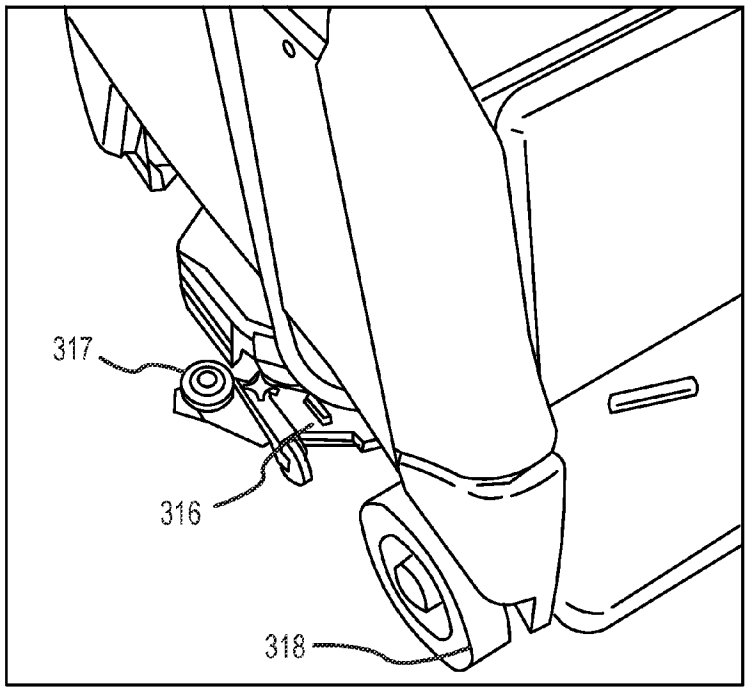

An actuation system that selectively raises the squeegee 316 from the floor may also be included as shown in FIG. 30E. Under some embodiments of the present invention, a handle actuated leverage system 344 is used and is in mechanical communication with a cam 346. The cam allows the user to apply minimal force to the handle 344 adjacent to the control panel to raise and lower the squeegee 316. One skilled in the art will also appreciate this function may be performed alternatively with a motor.

FIG. 30H is a blow-up of a section of FIG. 30D showing positioning of the track 340 in relation to bearing 338.

Referring now to FIG. 31A-D, a recovery tank strainer basket 348 of one embodiment of the present invention is shown. Waste storage tanks of some embodiments of the present invention are constructed out of resiliently deflectable material, such as a plastic bag. The bag is inserted into the main waste storage tank 351 of the apparatus. Once the clean fluid is transferred to the floor treatment tool of the apparatus, waste water may be suctioned into the main waste storage tank 351, thus expanding the waste fluid bag 358 and occupying the space once occupied by now dispensed clean fluid. Often, small metal shavings, wood splinters, glass, etc., may be suctioned with the waste fluid and deposited into the main waste storage tank 351, which may produce rips or tears in the waste fluid bag 358 and ultimately lead to leakage and contamination of the cleaning fluid. Thus, it is desirable to have a system that captures any dangerous debris such that it does not come in contact with the waste fluid tank. One embodiment of the present invention includes a strainer basket 348 connected to the waste storage tank cover 349 of the main waste storage tank 351. In the illustrated embodiment, a generally rectangular straining device constructed of a rigid material with a plurality of apertures therethrough is provided. As the waste water is deposited into the main waste storage tank 351 through the waste storage tank cover 349, any large debris is captured by the strainer basket 348. One skilled in the art will appreciate that any sized aperture may be employed to dictate the size of captured debris. Also, it should be specifically understood that any shape of strainer basket 348 may be used without departing from the scope of the invention.

Figure 31A:
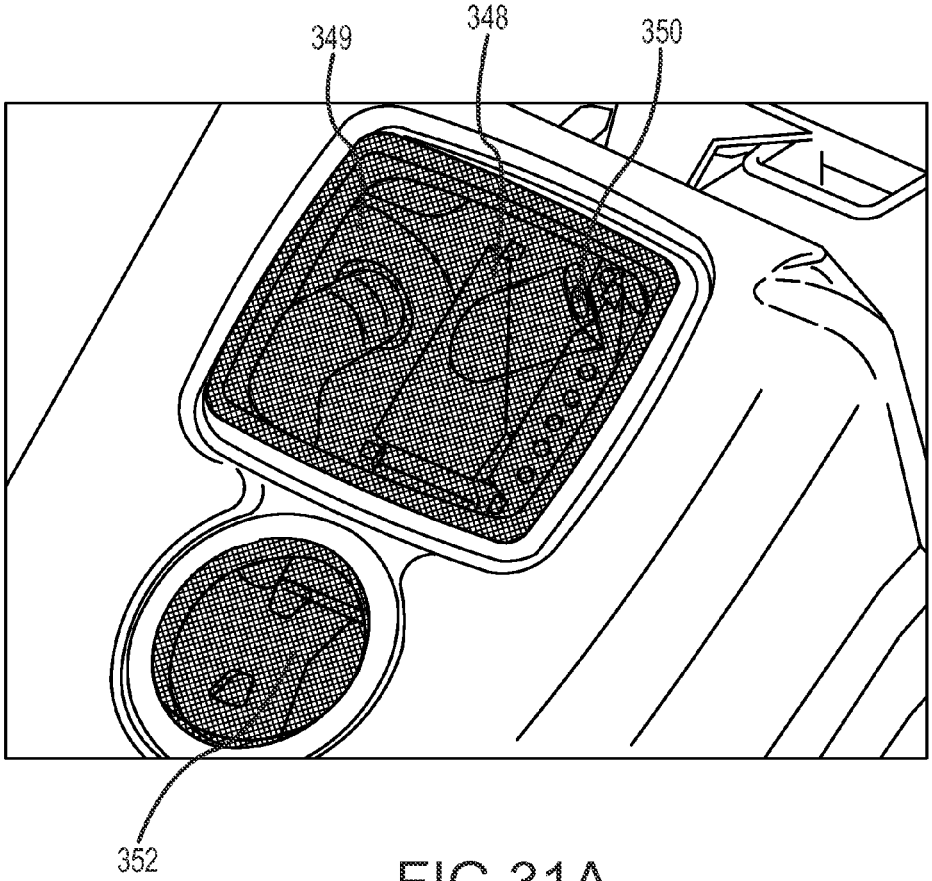
FIGS. 31A-D are views of a waste fluid system showing a strain basket and a drainage port of one embodiment of the present invention.
Figure 31B:
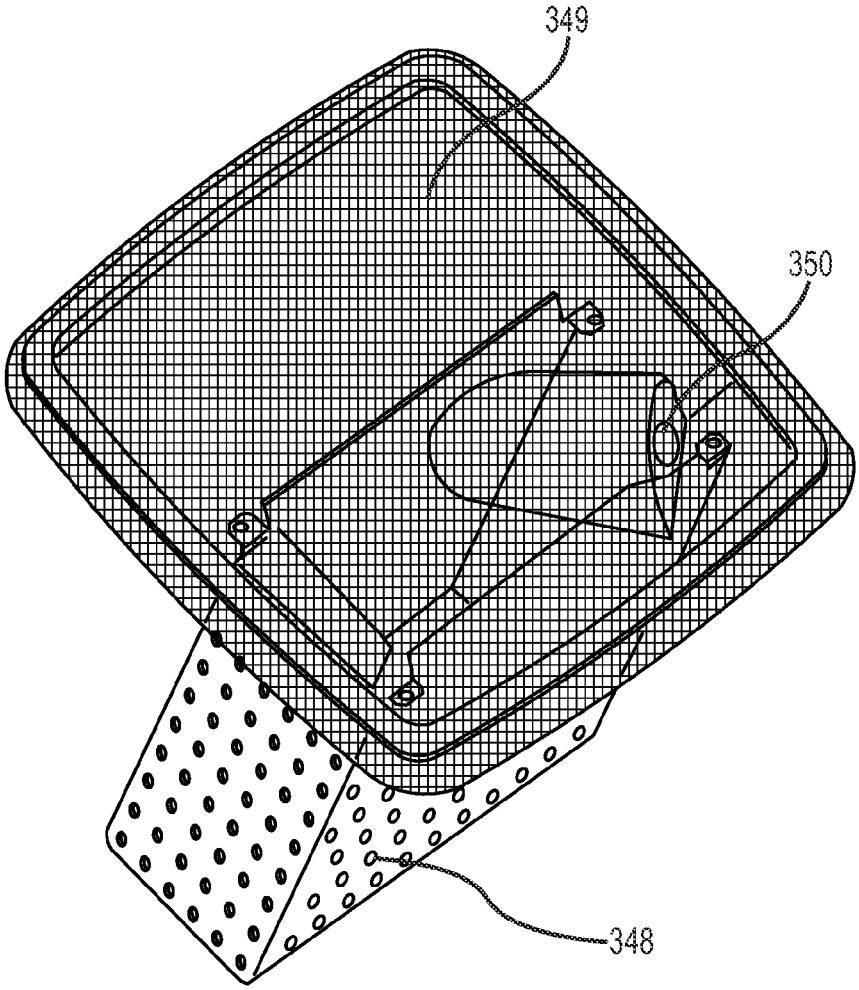
Figure 31C:
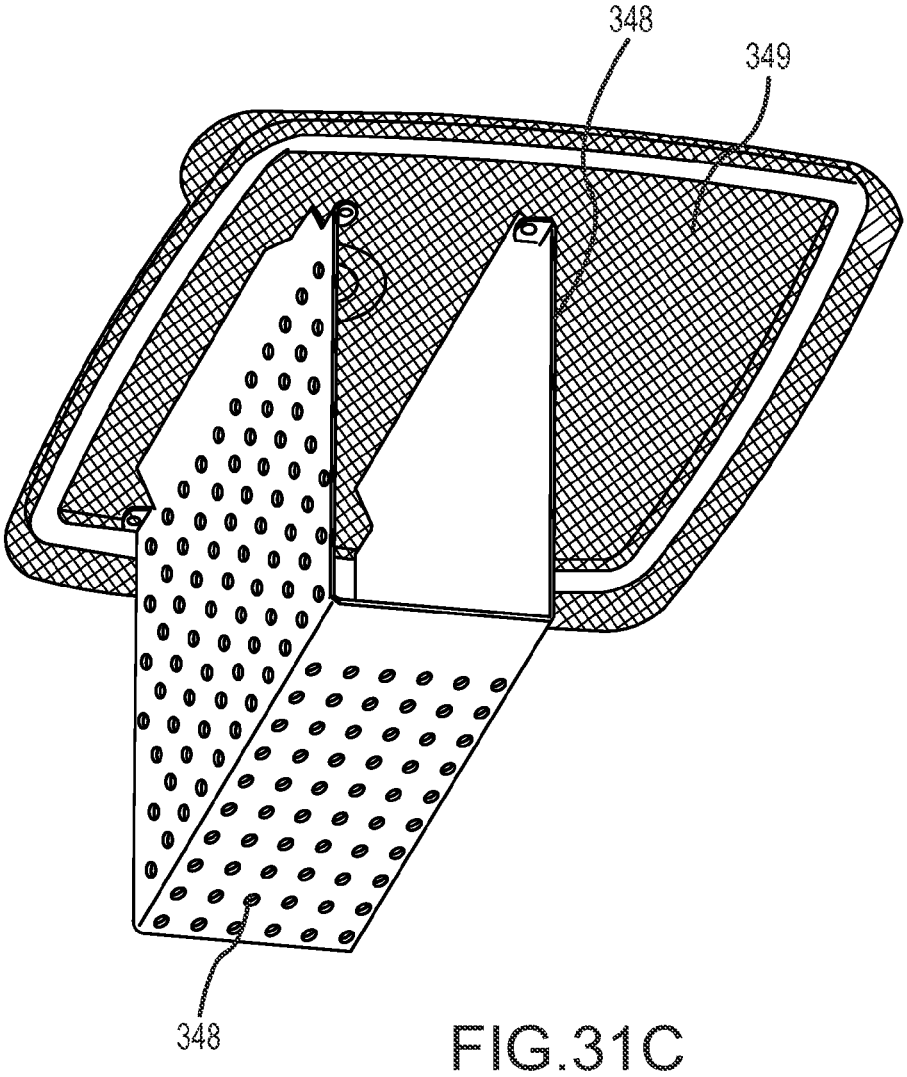
Figure 31D:
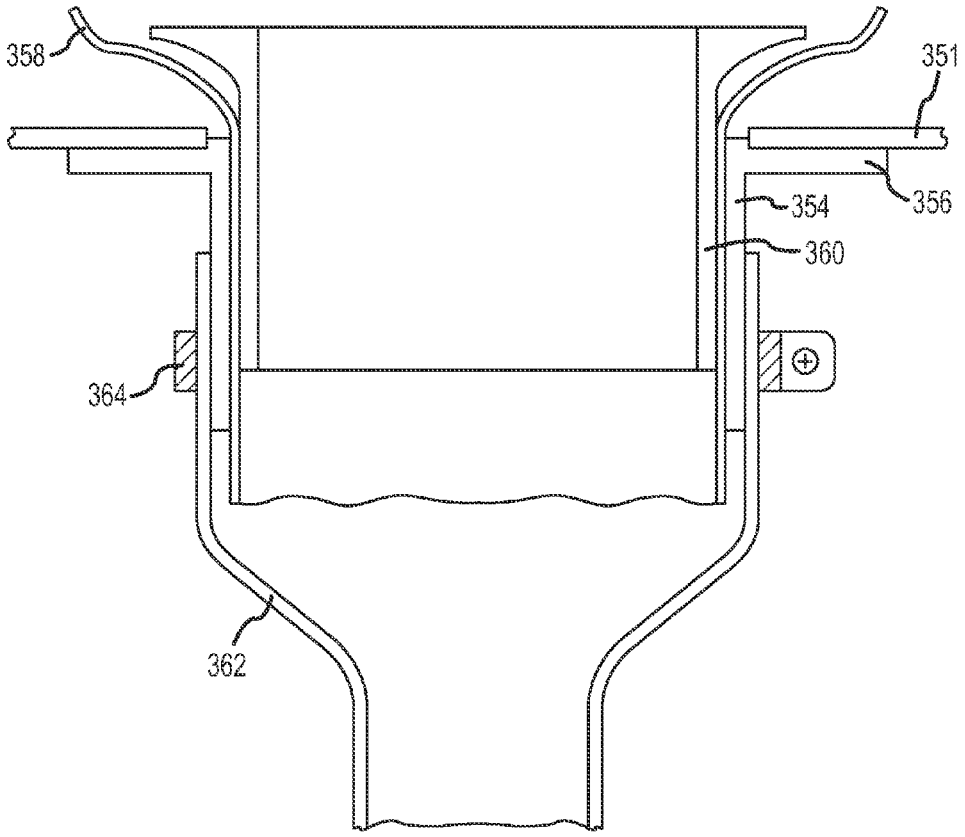
Figure 32A:
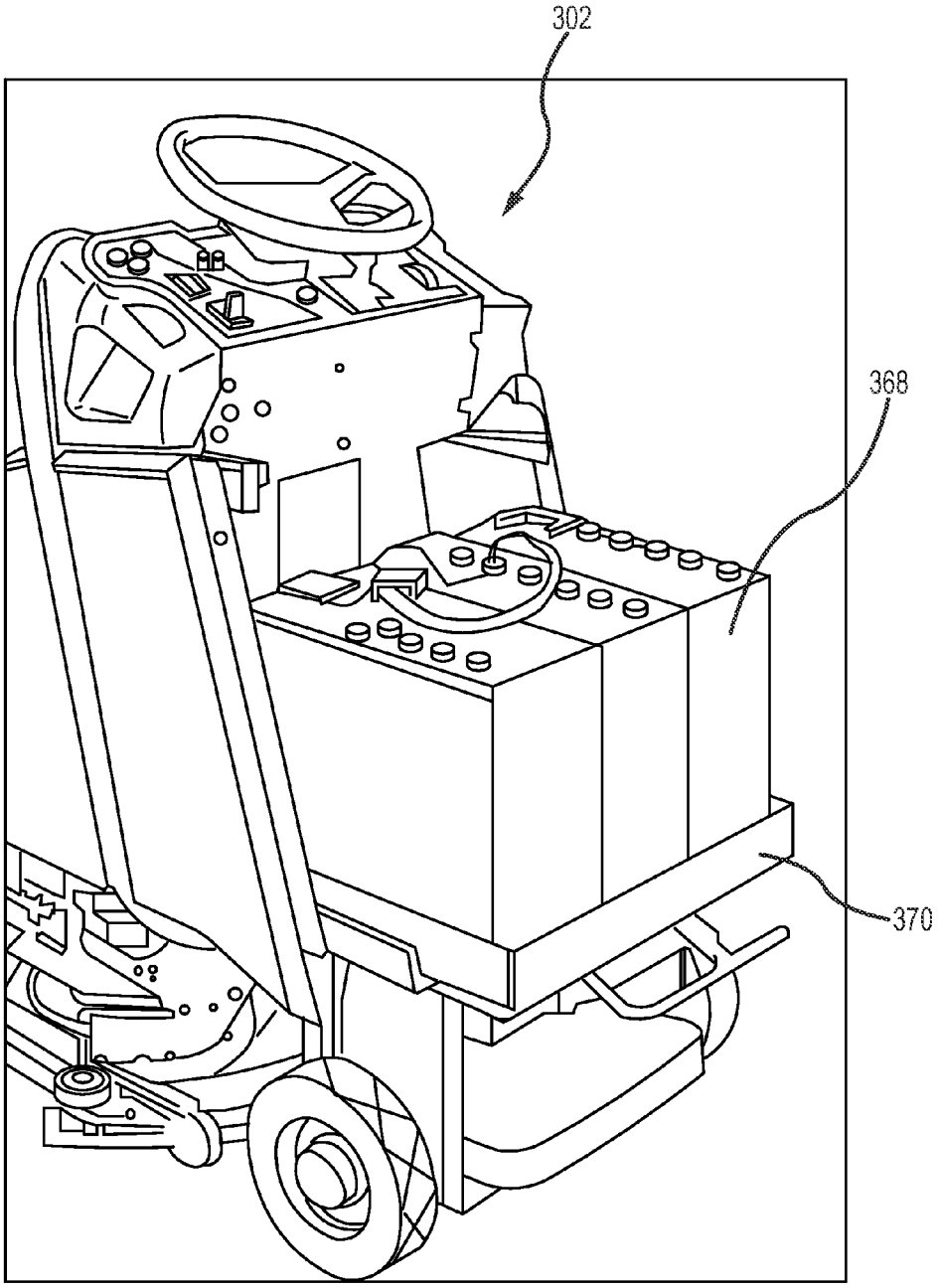
FIGS. 32A-D are views of a rear housing and battery tray of one embodiment of the present invention.
Figure 32B:
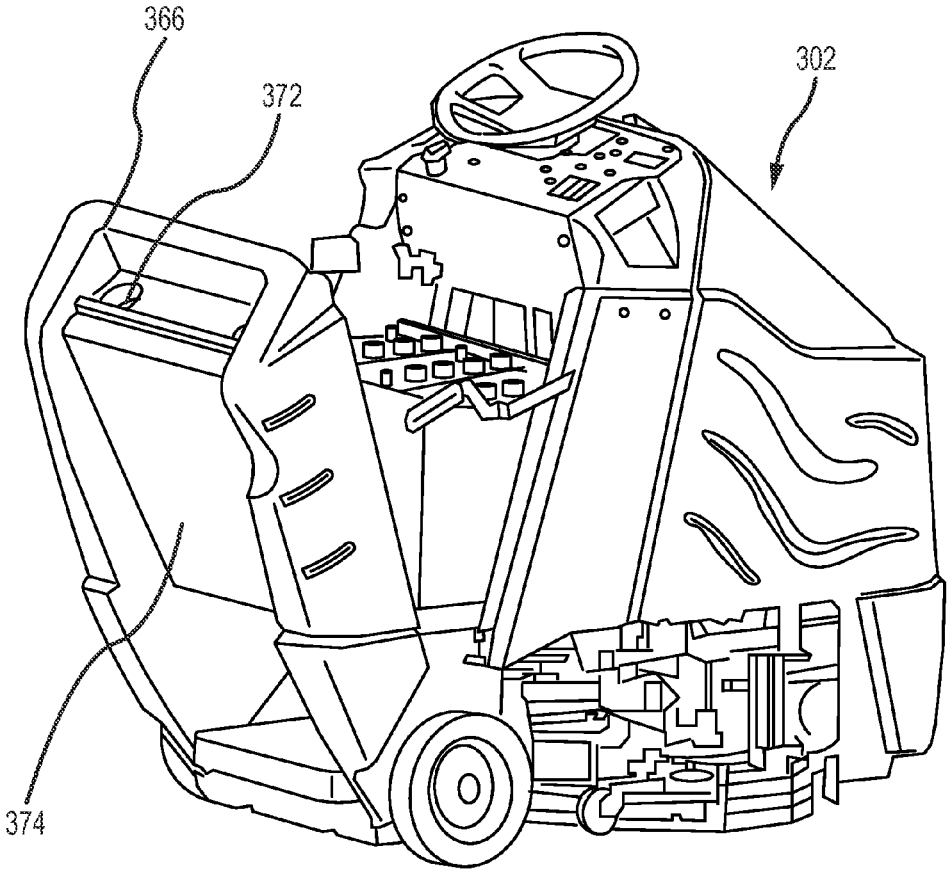
Figure 32C:
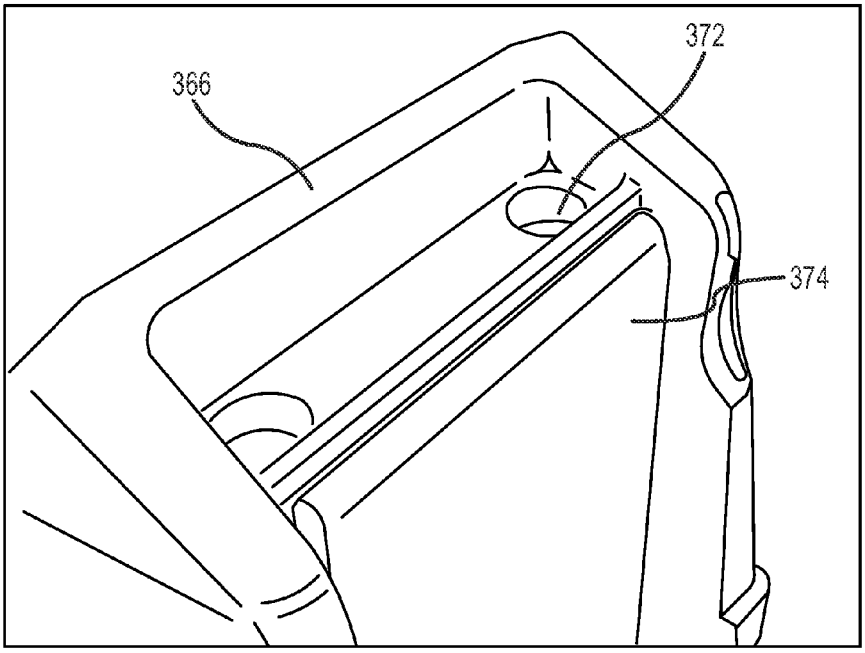
Figure 32D:
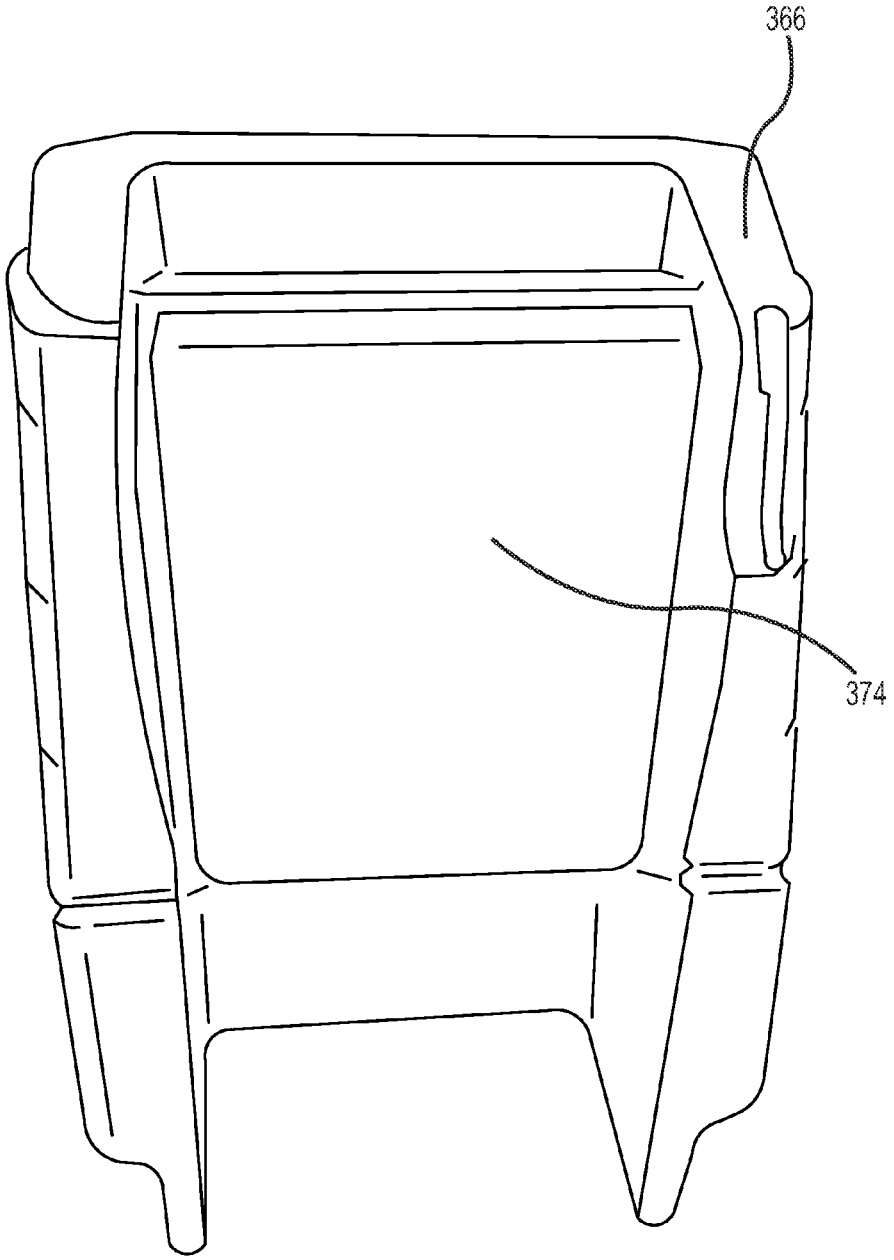

Referring now to FIG. 31D, a fluid discharge system connected to the waste fluid bag 358 of one embodiment of the present invention is shown. More specifically, a fitting 354 with a flange 356 may be used that is connected to the main storage tank 351 of the apparatus. Preferably, the fitting 354 is spun at a high rate of speed and engaged with an aperture in the main waste storage tank 351, thus creating friction induced heat between the two surfaces and welding them together. The opening of the waste fluid bag 358 is then fed through the fitting 354 and a mandrel 360 is added to sandwich the waste fluid bag 358 therebetween. The mandrel 360 is made out of a rigid material, such as aluminum to ensure an open flow path. A drain hose 362 is slid over the outer surface of the fitting 354 and is secured with a clamp 364. One skilled in the art will appreciate that the drain hose 364 is capped during use, wherein the user disconnects the cap to drain the waste water from the waste fluid bag 358. To ensure the waste fluid bag 358 is entirely empty, a new solution may be added to the tank, thus squeezing the waste fluid bag 358 to expel all the contained waste water.

Referring now to FIG. 32A-D, the rear portion of a floor treatment apparatus 302 is shown. More specifically, the rear of the apparatus 302 includes a rotatable and removable rear housing 366. The rear housing 366 of the present invention is capable of selective rotation about an axis parallel to the rear axle of the apparatus 302. Alternatively, the rear housing 366 may be completely removable. This aspect of the present invention provides the ability to access batteries 368 (preferably at least 3 separate batteries) that may provide power to the apparatus 302. The batteries 368 may reside on a removable tray 370 that is slidingly engaged to the apparatus 302, thus providing easy access for maintenance. The tray 370 resides on tracks that interface with a plurality of wheels, bearings, etc. The tray also includes a locking feature that securedly maintains the batteries 368 inside the vehicle. The rear housing 366 also includes other features, such as a cavity for securing various items and drink holders 372. A pad 374 may also be included that provides greater protection and comfort to the user.

Figure 33:
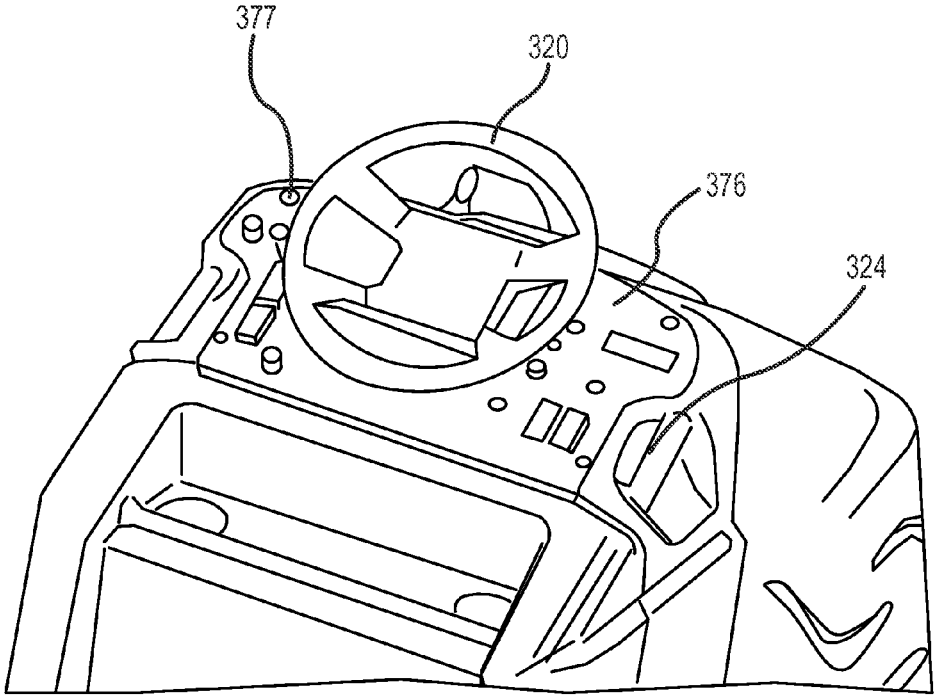
FIG. 33 is a perspective view of a control panel and handles of one embodiment of the present invention.

Referring now to FIG. 33, a control panel 376 and associated structure of one embodiment of the present invention is shown. Embodiments of the present invention include a control panel 376 that includes minimal fasteners 377 for interconnection to the floor treatment apparatus 302. That is, thumb screws, or similar type of fasteners may be included such that quick and easy removal of the control panel 376 may be achieved to facilitate repair.

Embodiments of the present invention also include hand grips 324 adjacent to the control panel 376 to provide support for the operator. More specifically, during tight turns the inertial forces acting upon an individual may cause an operator to fall. Hand grips 324, which may be integrated onto the chassis of the apparatus, will give the operator a place to hold onto the device for added comfort and provide an additional safety feature. In addition they provide support when operating control switches located adjacent to handle grip.

Figure 34:
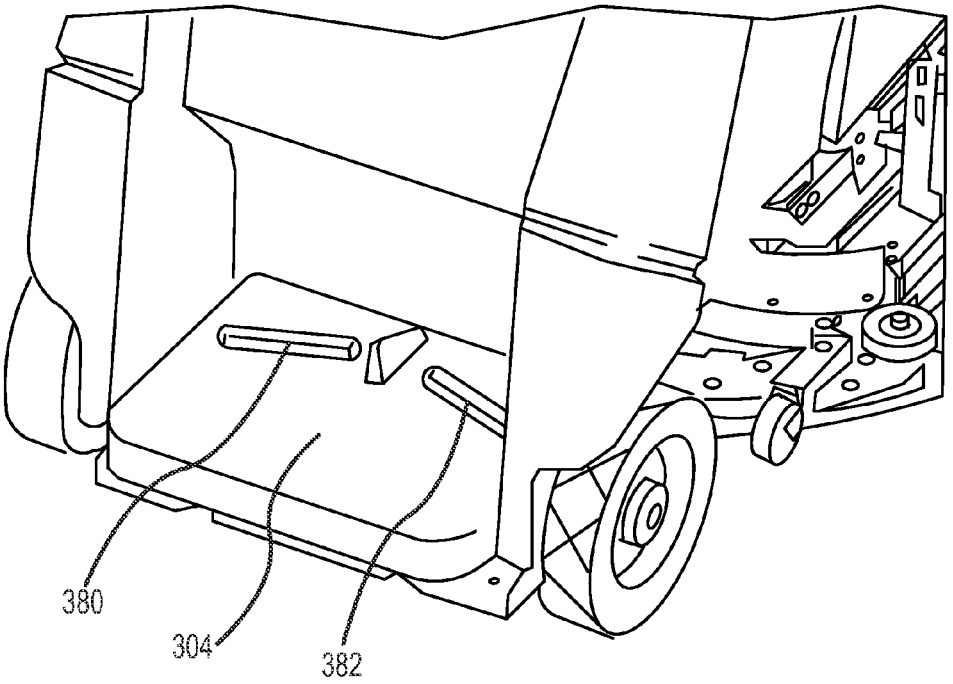
FIG. 34 is a perspective view of an operator platform with a plurality of switches of one embodiment of the present invention.

Referring now to FIG. 34, the platform 304 of one embodiment of the present invention is shown. More specifically, one embodiment of the present invention includes a platform 304 with an operator presence switch 380, a platform switch (not shown) and a throttle 382. The platform 304 also may include a suspension system and be cushioned to increase operator comfort. The platform 304 may be foldable such that the envelope of the apparatus 302 may be selectively reduced. In some embodiments of the present invention the platform 304 is located above an axis defined by the centers of the wheels located near the rear of the floor cleaning machine, as shown at least in FIGS. 30A-30D, and 37A. In some embodiments of the present invention, the platform 304 is located below an axis defined by the centers of the wheels located near the rear of the floor cleaning machine, as shown at least in FIG. 32B. In some other embodiments of the present invention, the outer surface of the wheels located near the rear of the floor cleaning machine define a cylindrical volume, and the platform 304 is located such that a portion penetrates the volume defined by the wheels, as shown at least in FIGS. 30A-30D, 32A, 32B, 34 and 38. In some embodiments of the present invention, the platform 304 is located below an uppermost point of the wheels located near the rear of the floor cleaning machine. As shown in FIG. 32, one embodiment of the present invention includes a platform with a left sidewall and a right sidewall that extend above the surface that receives the operator's feet. Embodiments of the present invention may also include a front wall extending from a front, inner surface that receives the operator's feet. Further, as shown in FIG. 27B, the platform may be associated with rear wheels that are not interconnected.

The operator presence switch 380 of one embodiment of the present invention is designed to act as a safety feature that interrupts the throttle pedal when not depressed. This ensures that the operator has both feet positioned on the platform when the machine is in use. Upon deactivation of the switch, for example if the operator removes a foot from the switch, a neutral mode may be engaged such that no power or forward or rearward motion of the device is possible. In addition, the operator presence switch 380 may ensure sufficient weight is maintained on the platform as a safety feature.

In the typical use, the platform switch is in operable connection with the platform, such that it is activated when the operator stands on the platform. The operator must then engage a reset device, preferably on the control panel, to initiate motion. The purpose of the platform switch and reset switch acts as a safety feature such that the machine does not immediately move when the operator steps on to the peddle platform. Upon deactivation of the switch, for example if the operator steps from the apparatus, a neutral mode may be engaged such that no power and forward or rearward motion is possible.

The throttle 382 of some embodiments of the present invention is adapted to selectively increase or decrease the speed of the apparatus depending on the desires of the operator. More specifically, various speed ranges may be included: neutral, first, second, third, reverse, etc. (or slow, medium, fast, etc.). In some embodiments, cleaning operations are performed at slow speeds, while transportation from location to location is performed at higher speeds. When the operator sets the speed range to first, for example, the activation of the throttle 382 will propel the apparatus within that speed range, such that it cannot transition from the first range to the second range without a manual shift of the range. Embodiments of the present invention include a hand speed range selector, wherein the throttle 382 turns the desired speed range to an activated mode. The neutral mode may also be set by the operator, wherein no amount of throttle 382 engagement will increase the speed of the apparatus. In addition, as mentioned briefly above, when the operator removes his or her foot from the operator presence switch 380, the apparatus automatically disengages the throttle. One skilled in the art will appreciate however, that a throttle 382 may be provided that provides selective speed increments, such as employed on an automobile, without departing from the scope of the invention.

Embodiments of the present invention also include a braking mechanism. For example, when an operator removes his or her foot from the operator presence switch 380, throttle, or disengages the platform switch, a braking mechanism may be employed such that any motion of the apparatus automatically or gradually ceases. The braking mechanism may be electro mechanical, mechanical or hydraulic. Alternatively, the foot brake may be provided adjacent to the throttle 382 or operator presence switch 380 that provides the same halting capability. Further, hand or emergency brakes may be employed adjacent to the control panel of the apparatus.

Figure 35B:
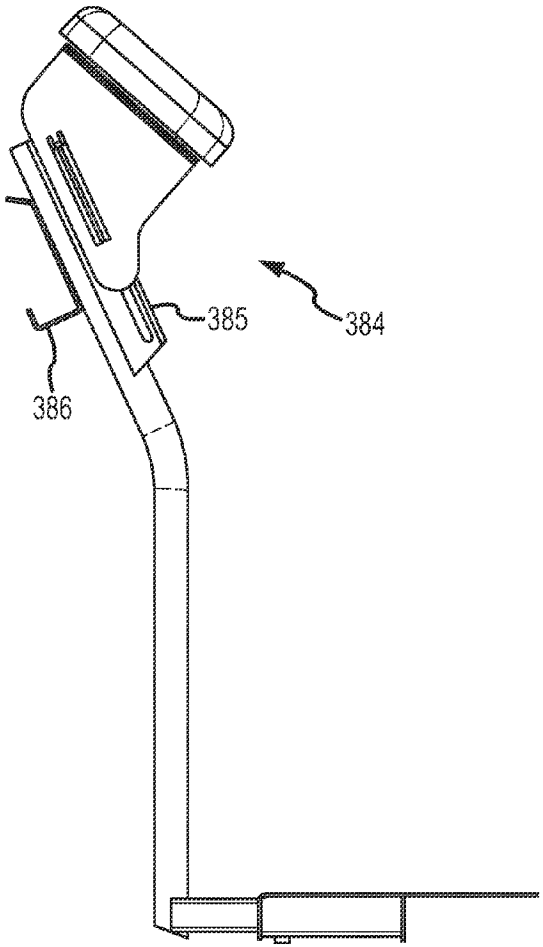
FIGS. 35A-B is are views of a seat of one embodiment of the present invention.
Figure 35A:
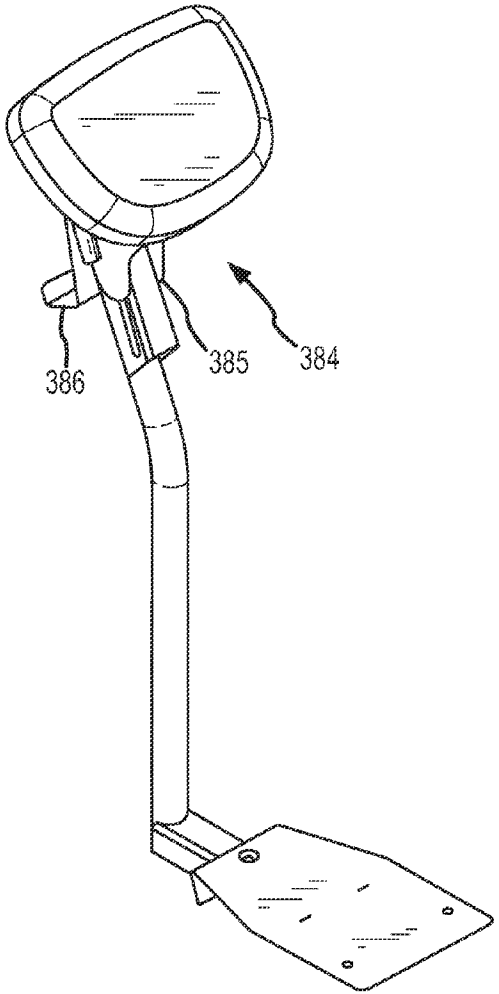
Figure 36A:
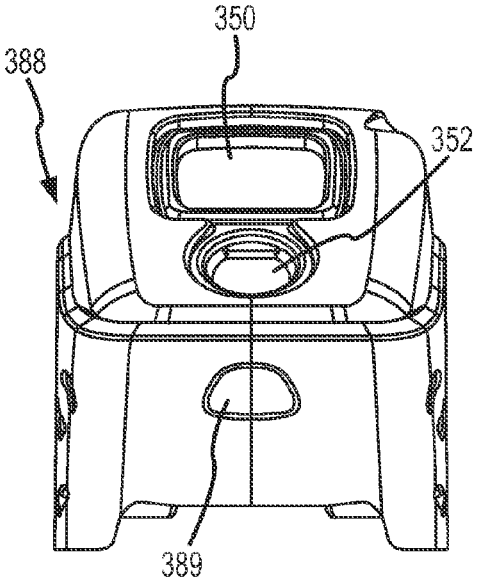
FIGS. 36A-D are views of a tank and front cowling of one embodiment of the present invention.
Figure 36B:
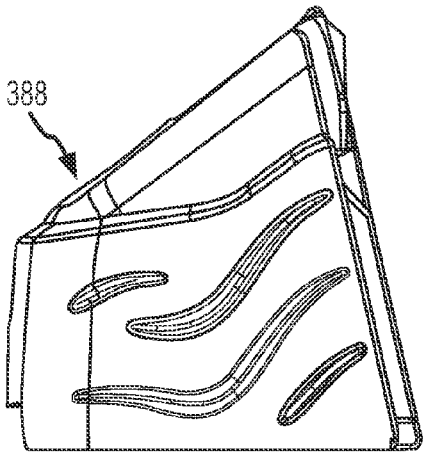
Figure 36C:
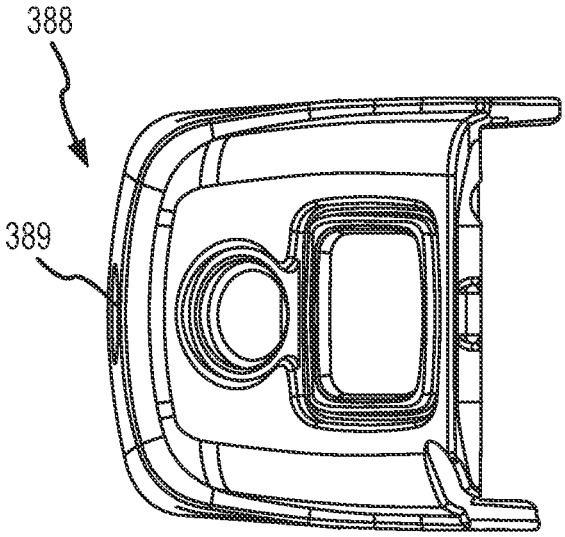
Figure 36D:
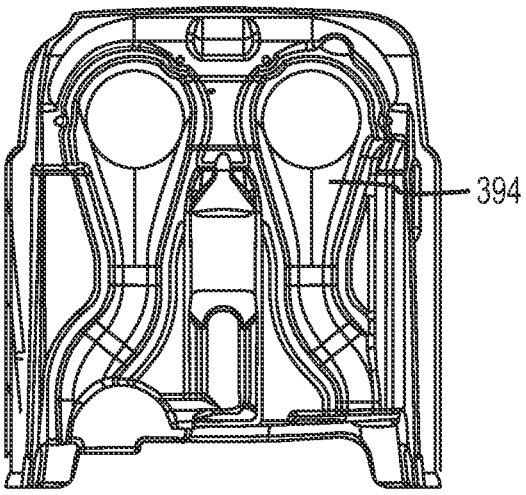

Referring now to FIG. 35A-B, a seat 384 of one embodiment of the present invention is shown. More specifically, embodiments of the present invention include a selectively connectable seating device 384 for engagement with the chassis to increase the operator comfort. Seats 384 of some embodiments of the present invention are selectively adjustable 385, thus making them easy to accommodate any sized individual. In operation, a receiver hitch, or similar connection mechanism, is connected to the rear portion of the platform 304 and a mating device for interconnection to the receiver hitch, or other device, is provided on the seat 384. The seat 384 may also include a plurality of hooks, shelves, cup holders, etc. for the securement of cords, bags, or any other type of cleaning or comfort related item. Further, the receiver hitch may be used when the seat 384 is engaged or not engaged, for example, to transport other items such as a supplemental wheeled device that may accommodate extra power sources, cleaning supplies, tanks, etc.

Referring now to FIG. 36A-D, a main storage tank 351 of one embodiment of the present invention is shown. Some embodiments of the present invention include a main storage tank 351 equipped with a plurality of lights 389 and/or horns that facilitate cleaning and/or act as additional safety features. Alternatively, lights may be integrated into bumpers positioned adjacent to the main storage tank 351 or on the sides of the apparatus.

Although not shown, a filter may be in fluid communication with the fluid pump. This filter is designed to capture any debris that may adversely affect the operation of the pump. On many cleaning machines, the filter is placed in a hard to access location, such that repair or monitoring is very difficult. Thus, one embodiment of the present invention includes a filter situated on the outer surface of the housing, perhaps on the control panel. Thus, the operator has ample opportunity to monitor the integrity of the filter and make quick repairs when necessary.

Figure 37A:
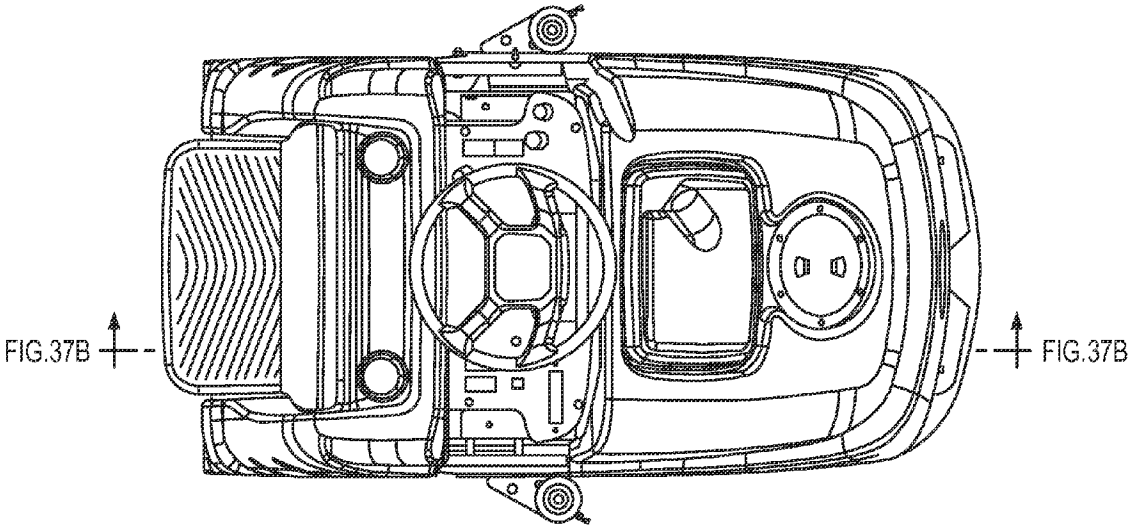
FIGS. 37A-B are views of a vacuum fan interconnected to the front cowling of one embodiment of the present invention.
Figure 37B:
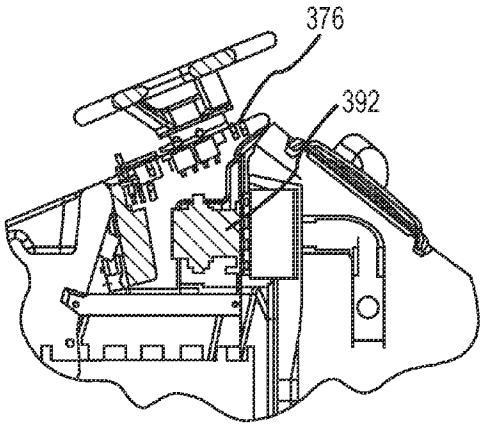

Referring now to FIG. 37A-B, a vacuum fan 392 connected to the front housing 388 of one embodiment of the present invention is shown. More specifically, a vacuum fan 392 provides suction to remove debris filled fluids from the floor. The fan 392 is preferably situated under the control panel 376 of the vehicle, such that the intake cooling air drawn in by the vacuum fan 392 is channeled adjacent to the control panel 376 to cool componentry associated therewith.

In addition, the main storage tank 351 may be made out of a formable material such that exhaust channels 394 may be machined or molded into the main storage tank 351. The channels 394 direct the exhaust air from the vacuum 392 to an exit muffler of the apparatus. The channels 394 also act as a baffle to remove noise energy from the exhaust gases, thus making the entire system quieter.

Figure 38:
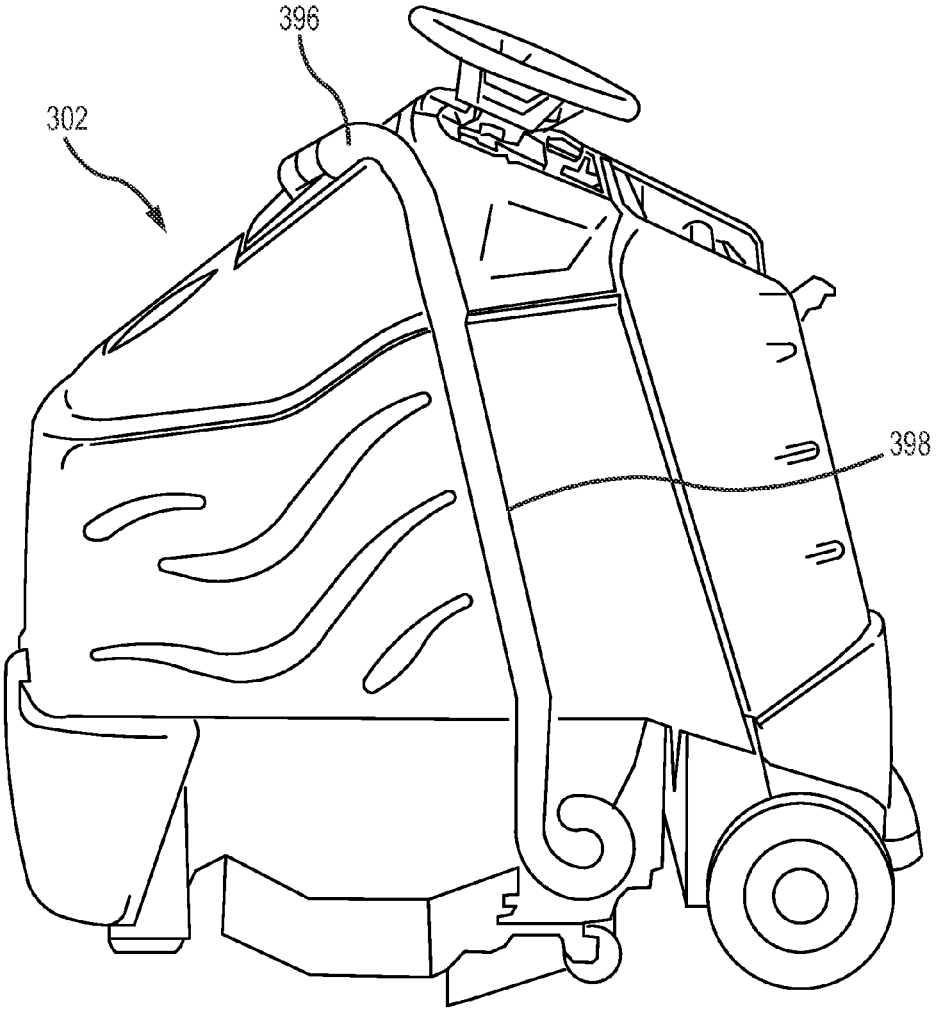
FIG. 38 is a right elevation view of one embodiment of the present invention showing the waste water return hose.

Referring now to FIG. 38, a waste fluid return hose 396 is shown. More specifically, one embodiment of the present invention decreases its profile by inserting the waste water return hose 396 into a hose channel 398 integrated into the outside surface of the apparatus 302. The hose 396 being on the outside also has the added advantage of making it very accessible, such that it can be removed and inspected for clogs or breaches.

Further, some embodiments of the present invention are provided with tip over stops adjacent to the front corners of the apparatus. The stops may be replaceable and ensure that the apparatus does not tip over during tight turns. The tip over stops are generally constructed out of a material harmless to flooring, such as Teflon, silicone, rubber, plastic, etc. In addition, one skilled in the art will appreciate that rollers may be employed that are situated a predetermined distance from the floor to perform the same function.

Referring again to FIGS. 19-38, a manner of making the present invention is shown and described herein. As has been explained, the present invention is similar to the floor treatment devices used in the art. However, unlike many prior art devices, the present invention provides a location for which the operator can stand or sit, thus enabling him or her to more efficiently perform their tasks. In addition, instead of using brute strength to perform steering the cleaning device, a steering mechanism and associated hardware are provided to aid in the smooth transition from one direction to another. Also, the present invention device has a compact profile and mechanism which allows for 360° cleaning of tight spaces. Further, to construct the remote control version of the system, software known in the art may be installed in the housing 308 to allow for the system to be remotely controlled or learn the cleaning surface as it operates. In addition, a series of cameras may be interconnected to the housing 308 to provide remote viewing to an operator offsite.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A floor treatment apparatus comprising:

a multi-part enclosure comprising a main enclosure, a front enclosure portion, and a rear enclosure portion, the multi-part enclosure having a front surface, a rear surface, an upper surface, a lower surface, a left surface, and a right surface;

a first wheel operably interconnected to the lower surface adjacent to the left surface and located closer to the rear surface than the front surface;

a second wheel operably interconnected to the lower surface adjacent the right surface and located closer to the rear surface than the front surface;

a standing surface located closer to the lower surface than the upper surface and substantially between at least a portion of the right surface and at least a portion of the left surface, and extending from a portion of the rear surface, wherein a portion of the standing surface is positioned substantially adjacent to an axis extending between a center of the first wheel and a center of the second wheel;

a floor treatment assembly operably connected to the lower surface of the enclosure;

a power source positioned substantially within the multi-part enclosure;

an electric monowheel drive motor associated with the power source;

a third wheel associated with the electric monowheel drive motor and operably connected adjacent the lower surface of the enclosure;

a steering mechanism associated with the third wheel;

a steering wheel operably interconnected by a shaft to the steering mechanism wherein the steering wheel is associated with the front enclosure portion, which is capable of selective rotation relative to the main enclosure about a first axis that is parallel to an axis extending between a center of the first wheel and a center of the second wheel, the front enclosure portion including a control panel, and wherein the steering wheel maintains a position relative to the front enclosure portion when the front enclosure portion is rotated away from the main enclosure; and wherein the rear enclosure portion is capable of selective rotation about a second axis parallel to the axis extending between the center of the first wheel and the center of the second wheel.

2. The floor treatment apparatus of claim 1, wherein a portion of the standing surface penetrates a three-dimensional cylindrical volume that is defined by an outer surface of the first wheel and the second wheel.

3. The floor treatment apparatus of claim 1, wherein the standing surface includes a means for controlling speed and an operator presence device, which is operatively connected to and which selectively interrupts operation of the means for controlling speed.

4. The floor treatment apparatus of claim 3, further comprising a brake which is operative to perform a braking function when at least one of the means for controlling speed and operator presence device is disengaged.

5. The floor treatment apparatus of claim 1, wherein the floor treatment assembly includes a device for capturing debris and fluid and directing them to a suction assembly, the device for capturing debris and fluid being associated with the lower surface of the enclosure.

6. The floor treatment apparatus of claim 1, wherein the floor treatment assembly is at least one of a brush, a scrubber, a burnishing pad, and a squeegee.

7. The floor treatment apparatus of claim 1, wherein the standing surface includes a left sidewall and a right sidewall that extend above a surface that receives an operator's feet.

8. The floor treatment apparatus of claim 1, wherein the standing surface includes a front wall extending from a surface that receives an operator's feet.

9. The floor treatment apparatus of claim 8, wherein the front wall and an innermost portion of the standing surface is located in a cavity integrated into the enclosure.

10. The floor treatment apparatus of claim 1, wherein a portion of the standing surface extends behind a rearmost portion of the first wheel and the second wheel.

11. The floor treatment apparatus of claim 1, wherein the first wheel and the second wheel are not interconnected.

12. A floor treatment apparatus comprising:

a multi-part housing comprising a main housing, a front housing portion, and a rear housing portion, the multi-part housing having a front surface, a rear surface, an upper surface, a lower surface, a left surface, and a right surface;

a first wheel operably interconnected to the lower surface adjacent to the left surface and located closer to the rear surface than the front surface;

a second wheel operably interconnected to the lower surface adjacent the right surface and located closer to the rear surface than the front surface;

a standing surface located closer to the lower surface than the upper surface and substantially between at least a portion of the right surface and at least a portion of the left surface, and extending from a portion of the rear surface, wherein a portion of the standing surface is positioned substantially proximate to an axis extending between the first wheel and the second wheel;

a steering wheel operably interconnected by a shaft to an assembly associated with a drive wheel wherein the steering wheel is operably interconnected to the front housing portion, which is capable of selective rotation relative to the main housing about a first axis that is parallel to an axis extending between a center of the first wheel and a center of the second wheel, the front housing portion including a control panel, and wherein the steering wheel maintains a position relative to the front housing portion when the front housing portion is rotated away from the main housing;

a floor treatment assembly operably connected to a chassis that is associated with the multi-part housing; and wherein the rear housing portion is capable of selective rotation away from the main housing.

13. The floor treatment apparatus of claim 12, wherein the standing surface includes a means for controlling speed and an operator presence device, which is operatively connected to and which selectively interrupts operation of the means for controlling speed.

14. The floor treatment apparatus of claim 13, further comprising a brake which is operative to perform a braking function when at least one of the means for controlling speed and operator presence device is disengaged.

15. The floor treatment apparatus of claim 12, wherein the standing surface includes a left sidewall and a right sidewall that extend above a surface that receives an operator's feet.

16. The floor treatment apparatus of claim 12, wherein a water storage tank is interconnected to the rear housing portion.

17. The floor treatment apparatus of claim 12, further comprising an electric drive motor associated with the drive wheel and a plurality of batteries associated with the electric drive motor.

18. The floor treatment apparatus of claim 12, wherein the first wheel and the second wheel are not interconnected.

19. A floor treatment apparatus comprising:

a multi-part housing comprising a main housing, a front housing portion, and a rear housing portion, the multi-part housing having a front surface, a rear surface, an upper surface, a lower surface, a left surface, and a right surface;

a standing surface that extends substantially between at least a portion of the right surface, at least a portion of the left surface and at least a portion of the rear surface, the standing surface having a throttle and an operator presence device operatively connected to and which selectively interrupts operation of the throttle;

a wheel operably connected adjacent the lower surface of the multi-part housing;

a steering wheel operably interconnected by a shaft to a steering mechanism wherein the steering wheel is associated with the front housing portion that hingedly rotates relative to the main housing, the front housing portion includes a control panel, and the steering wheel maintaining a static position relative to the front housing portion when the front housing portion is rotated away from the main housing;

a floor treating device connected adjacent to the lower surface of the multi-part housing; and a debris collection device connected adjacent to the lower surface of the multi-part housing.

20. The floor treatment apparatus of claim 19, further comprising a brake which is operative to perform a braking function when at least one of the throttle and operator presence device is disengaged.

* * * * *